US012209331B2

(12) United States Patent
Bakhtiary Davijani et al.

(10) Patent No.: US 12,209,331 B2
(45) **Date of Patent: *Jan. 28, 2025**

(54) METHODS OF GENERATING HIGHLY-CRYSTALLINE RECOMBINANT SPIDER SILK PROTEIN FIBERS

(71) Applicant: Bolt Threads, Inc., Emeryville, CA (US)

(72) Inventors: Amir Ahmad Bakhtiary Davijani, Oakland, CA (US); Steven Tom, Berkeley, CA (US); Maxime Boulet-Audet, El Cerrito, CA (US); Paul Andre Guerette, Oakland, CA (US); Lindsay Wray, Benicia, CA (US); Nicole Elizabeth Subler, Berkeley, CA (US); Zoya Nasir Zulfiqar, Oakland, CA (US); Hua Li, Davis, CA (US); Jessica Wang, Oakland, CA (US)

(73) Assignee: BOLT THREADS, INC., Emeryville, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/527,617

(22) Filed: Nov. 16, 2021

(65) Prior Publication Data

US 2022/0127756 A1 Apr. 28, 2022

Related U.S. Application Data

(63) Continuation of application No. 16/141,787, filed on Sep. 25, 2018, now Pat. No. 11,208,736.

(60) Provisional application No. 62/563,022, filed on Sep. 25, 2017.

(51) Int. Cl.

| | |
|---|---|
| ***D01D 5/06*** | (2006.01) |
| ***D01D 1/02*** | (2006.01) |
| ***D01F 4/02*** | (2006.01) |
| ***D01F 6/68*** | (2006.01) |
| ***D02J 1/22*** | (2006.01) |
| ***D02J 13/00*** | (2006.01) |

(52) U.S. Cl.

CPC ..... *D01D 5/06* (2013.01); *D01D 1/02* (2013.01); *D01F 4/02* (2013.01); *D01F 6/68* (2013.01); *D02J 1/221* (2013.01); *D02J 13/005* (2013.01)

(58) Field of Classification Search

None

See application file for complete search history.

(56) References Cited

U.S. PATENT DOCUMENTS

| | | | |
|---|---|---|---|
| 5,171,505 | A | 12/1992 | Lock |
| 6,268,169 | B1 | 7/2001 | Fahnestock |
| 6,620,917 | B1 | 9/2003 | Mello et al. |
| 6,992,065 | B2 | 1/2006 | Okumu |
| 7,014,807 | B2 | 3/2006 | O'Brien |
| 7,057,023 | B2 | 6/2006 | Islam et al. |
| 9,074,302 | B2 | 7/2015 | Lo et al. |
| 2003/0155670 | A1† | 8/2003 | O'Brien |
| 2003/0183978 | A1 | 10/2003 | Asakura |
| 2004/0102614 | A1 | 5/2004 | Islam et al. |
| 2005/0260706 | A1 | 11/2005 | Kaplan et al. |
| 2012/0244143 | A1 | 9/2012 | Lo et al. |
| 2014/0058066 | A1* | 2/2014 | Sekiyama ..... D01D 5/16 530/353 |
| 2018/0080147 | A1 | 3/2018 | Ishida et al. |
| 2018/0216260 | A1† | 8/2018 | Breslauer |
| 2019/0161522 | A1 | 5/2019 | Romer et al. |
| 2020/0031886 | A1† | 1/2020 | Morinaga |

FOREIGN PATENT DOCUMENTS

| | | | |
|---|---|---|---|
| WO | 2014/012099 | A1 | 1/2014 |
| WO | 2015/042164 | A2 | 3/2015 |
| WO | 2016/201369 | A1 | 12/2016 |
| WO | 2018/053204 | A1 | 3/2018 |

OTHER PUBLICATIONS

Albertson et al., "Effects of different post-spin stretching conditions on the mechanical properties of synthetic spider silk fibers", J Mech Behav Biomed Mater, Jan. 2014, pp. 225-234.

An et al., "Inducing β-Sheets Formation in Synthetic Spider Silk Fibers by Aqueous Post-Spin Stretching", Biomacromolecules, 12, No. 6 (2011): 2375-2381.

Arcidiacono et al., "Aqueous Processing and Fiber Spinning of Recombinant Spider Silks", Macromolecules 2002, pp. 1262-1266.

Cebe et al., "Beating the Heat—Fast Scanning Melts silk Beta Sheet Crystals", Scientific Reports 3, No. 1 (2013): pp. 1-7.

Fang et al., "An Effective and Simple Process for Obtaining High Strength Silkworm (*Bombyx mori*) Silk Fiber", Fibers and Polymers 2015, vol. 16, No. 12, pp. 2609-2616.

Hardy et al., "Polymeric materials based on silk proteins", Progress in Polymer Science 35 (2010), pp. 1093-1115.

Holland et al., "Comparing the rheology of native spider and silkworm spinning dope", Nature Materials, vol. 5, No. 11, Nov. 2006.

International Application No. PCT/US2018/052754, International Preliminary Report on Patentability, mailed Apr. 9, 2020.

International Preliminary Reporton Patentablility for PCT/US2019/046222, dated Feb. 25, 2021, 11 pages.

International Search Report and The Written Opinion for PCT/US19/46222, dated Aug. 12, 2019, 21 pages.

(Continued)

*Primary Examiner* — Suzanne M Noakes

(74) *Attorney, Agent, or Firm* — MARSHALL, GERSTEIN & BORUN LLP

(57) ABSTRACT

Provided herein are scalable methods of processing wet-spun fiber comprising recombinant spider silk polypeptides to generate a three-dimensional crystalline lattice of beta-sheet structures in the fiber.

27 Claims, 21 Drawing Sheets

Specification includes a Sequence Listing.

(56) References Cited

OTHER PUBLICATIONS

International Search Report and The Written Opinion for PCT/US2020/041735, dated Oct. 22, 2020, 14 pages.
Kojic et al., "Ex vivo rheology of spider silk", The Journal of Experimental Biology 209, 2006, pp. 4355-4362.
Ku et al., "Predicting melting temperature directly from protein sequences", Computational Biology and Chemistry 33 (2009), pp. 445-450.
Liivak et al., "A Microfabricated Wet-Spinning Apparatus To Spin Fibers of Silk Proteins. Structure-Property Correlations", Macromolecules 1998, 31, pp. 2947-2951.
Munro, T. et al., "Investigation of Synthetic Spider Silk Crystallinity and Alignment via Electrothermal, Pyroelectric, Literature XRD, and Tensile Techniques," Macromolecular Materials and Engineering, Jan. 30, 2017, vol. 302, No. 4.
Ngai et al., "The Protein "Glass" Transition and the Role of the Solvent", J. Phys. Chem. B 2008, 112, pp. 3826-3832.
O'Brien et al., "Nylons from Nature: Synthetic Analogs to Spider Silk", Advanced Materials 1998, 10, No. 15, pp. 1185-1195.
PCT International Search Report and Written Opinion, PCT Application No. PCT/US18/52754, dated Dec. 10, 2018, 11 pages.
Peng et al., "Recombinant spider silk from aqueous solutions via a bio-inspired microfluidic chip", Scientific Reports, 2016, 6:36473. DOI: 10.1038/srep36473.
Rengasamy et al., "Studies on Structure and Properties of Nephila-Spider Silk Dragline", Autex Research Journal, Mar. 2005, vol. 5, No. 1, pp. 30-39.
Seidel et al., "Artificial Spinning of Spider Silk", Macromolecules 1998, 31, pp. 6733-6736.
Shi et al., "Review: Bio-based films from zein, keratin, pea, and rapeseed protein feedstocks", Journal of Materials Science, Mar. 2014, pp. 1915-1930.
Yoshioka et al., "Molecular Orientation Enhancement of Silk by the Hot-Stretching-Induced Transition from a-Helix-HFIP Complex to β-Sheet", Biomacromolecules 2016, 17, pp. 1437-1448.
Qingfa Peng, et al., Role of Humidity on the Structures of Properties of Regenerated Silk Fibers, Progress in Natural Science: Materials International 25, No. 5 (2015): 430-436.†

* cited by examiner
† cited by third party

Precursor

Air drawn

Hot drawn

METHODS OF GENERATING HIGHLY-CRYSTALLINE RECOMBINANT SPIDER SILK PROTEIN FIBERS

CROSS-REFERENCE TO RELATED APPLICATIONS

This application is a continuation of U.S. Non-Provisional application Ser. No. 16/141,787, filed Sep. 25, 2018, which claims the benefit of U.S. Provisional Application No. 62/563,022, filed Sep. 25, 2017, the contents of which are incorporated by reference in its entirety.

SEQUENCE LISTING

The instant application contains a Sequence Listing which has been submitted electronically in ASCII format and is hereby incorporated by reference in its entirety. Said ASCII copy, created on Nov. 16, 2021, is named BTT-014C1_CRF_sequencelisting.txt and is 61,803 bytes in size.

FIELD OF THE INVENTION

The present invention relates to scalable methods of processing wet-spun fiber comprising recombinant spider silk polypeptides to generate a three-dimensional crystalline lattice of beta-sheet structures in the fiber.

BACKGROUND OF THE INVENTION

Protein-based materials are of increasing interest as an alternative to petroleumbased products. To this end, considerable effort has been made to develop methods of making materials and fibers from regenerated protein sources derived from plants (e.g., zein, soy, wheat gluten) and animals (e.g. casein, keratin and collagen). Fiber made from regenerated protein dates back to the 1890s and has been made using various traditional wet-spinning techniques.

Because proteins typically form brittle structures, plasticizers such as polyols, lipids and sugars have been combined with regenerated protein sources to generate fibers and materials that are less susceptible to breaking and deformation. Plasticizers interact with the tertiary structures of proteins and can alter the physio-chemical properties of the proteins. For example, plasticizers may be used to lower the glass transition and melting temperature of a protein, thus allowing the protein to be manipulated and reformed into new tertiary structures while preventing degradation of the protein.

A substantial limitation in using regenerated and recombinant protein sources to create materials is variability in purity of the protein and the presence of impurities such as lipids and sugars which may act as plasticizers, thus producing materials with variable properties. Accordingly, innovations related to novel fibers or materials comprising proteins typically entail precise characterization of any plasticizers used and rheological analysis of the protein composition used to form the materials. See e.g. U.S. Pat. Nos. 5,528,293; 7,066,995; US 2014/0060383.

Silk proteins such as silk fibroin and spidroins have a complex secondary and tertiary structures which make them an ideal candidate for the creation of protein-based materials. Specifically, silk proteins form complex beta-sheet structures that are extremely stable and only denature at very high temperatures, far above the melting temperature of the protein.

While there has been significant work performed in generating fibers and materials from recombinant spider silk polypeptides using traditional spinning and molding processes (see U.S. Pat. No. 7,057,023), much of this work has been proof-of-principle work that is not reproducible or scalable for mass commercialization. Specifically, none of the work has precisely characterized the recombinant spider silk polypeptide that is used as an input to these processes and the molecular structures formed by the recombinant spider silk polypeptide in the material that is output from the processes. Since impurities and ambient water bound to the protein may plasticize or otherwise interact with the recombinant spider silk polypeptides, failure to understand the impact of these components can produce materials with varying tertiary structures and mechanical properties. Accordingly, there is a need for processes of manufacturing materials from recombinant spider silk polypeptides which use the specific physio-chemical properties of recombinant spider silk polypeptide compositions to create fibers comprising stable and reproducible tertiary structures.

SUMMARY OF THE INVENTION

Provided herein, according to some embodiments of the invention, is a drawn fiber comprising recombinant spider silk polypeptide, wherein the fiber is generated by: dissolving a powder comprising the recombinant spider silk polypeptide into a solvent to generate a spin dope; extruding the spin dope into a coagulation bath to form a precursor fiber; collecting the precursor fiber without drawing the precursor fiber; and drawing the precursor fiber over a hot surface to generate a drawn fiber, wherein the drawn fiber has a crystallinity index of at least 4%, at least 5%, at least 6%, or at least 7% as measured using X-ray diffraction.

In some embodiments, the powder comprising the recombinant spider silk polypeptide is comprised of at least 60% recombinant spider silk polypeptide by weight. In some embodiments, the powder comprising the recombinant spider silk polypeptide is comprised of at least 70% recombinant spider silk polypeptide by weight. In some embodiments, the powder comprising the recombinant spider silk polypeptide is comprised of at least 80% recombinant spider silk polypeptide by weight.

In some embodiments, the drawn fiber is drawn over the hot surface at a draw ratio of at least 2×. In some embodiments, the drawn fiber is drawn over the hot surface at a draw ratio of at least 3×. In some embodiments, the drawn fiber is drawn over the hot surface at a draw ratio of at least 4×. In some embodiments, the drawn fiber is drawn over the hot surface at a draw ratio of at least 6×.

In some embodiments, the draw ratio is computed by determining the draw ratio at failure. In some embodiments, the draw ratio at failure comprises determining the distribution of maximum elongation at break of one or more precursor fibers using an apparatus designed to draw the fiber over a hot surface while increasing the draw ratio.

In some embodiments, the generation of the fiber further comprises drawing the drawn fiber over a hot surface one or more times.

In some embodiments, the drawing the drawn fibers over a hot surface one of more times comprises: determining a draw ratio at failure of the precursor fiber; and dividing the draw ratio at failure of the precursor fiber over the one or more times.

In some embodiments, the generation of the drawn fiber comprises annealing the precursor fiber prior to drawing the fiber. In some embodiments, annealing the precursor fiber comprises annealing the precursor fiber with alcohol vapor.

In some embodiments, the solvent is formic acid. In some embodiments, the solvent is NMMO.

In some embodiments, the drawn fiber has increased beta-sheet formation relative to the precursor fiber. In some embodiments, the drawn fiber has increased beta-sheet formation proportional to the draw ratio used to draw the fiber over the hot surface.

In some embodiments, the hot surface is at least 190 degrees Celsius. In some embodiments, the hot surface is at least 200 degrees Celsius. In some embodiments, the hot surface is at least 20 degrees Celsius greater than the glass transition temperature of the precursor fiber.

In some embodiments, the recombinant spider silk polypeptide is 18B (SEQ ID NO: 1).

In some embodiments, the tenacity of the drawn fiber is greater than 20 cN/tex. In some embodiments, the tenacity of the drawn fiber is greater than 25 cN/tex. In some embodiments, the tenacity of the drawn fiber is greater than 26 cN/tex.

In some embodiments, the Herman orientation factor of the drawn fiber is approximately the same as native silk fiber. In some embodiments, the drawn fiber has more than 1.5 times, more than 2 times, or more than 2.5 times increased beta-sheet content as compared to air drawn fibers not drawn over a hot surface. In some embodiments, the drawn fiber has an increased 3D β-sheet content as compared to air drawn fibers not drawn over a hot surface.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead placed upon illustrating the principles of various embodiments of the invention.

DETAILED DESCRIPTION OF THE INVENTION

Figure 1:
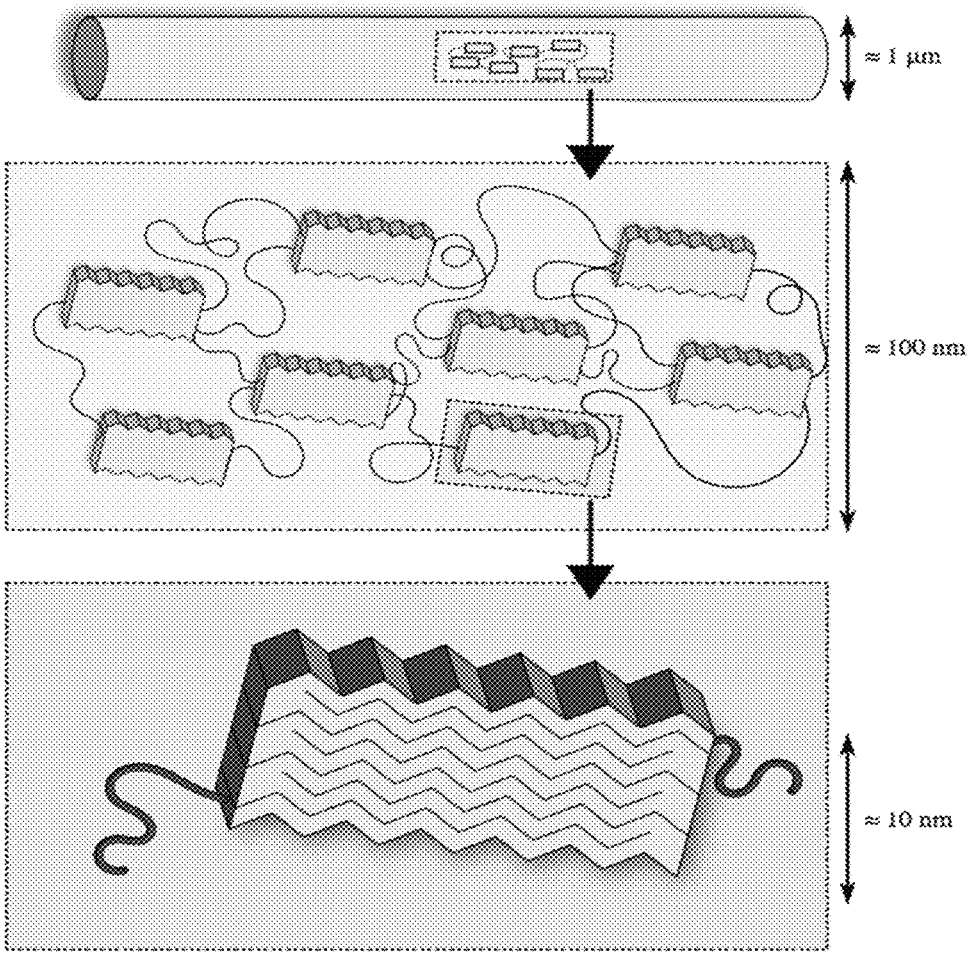
FIG. 1 depicts the tertiary structures formed in native silk fibroin and spidroin polypeptides.

The details of various embodiments of the invention are set forth in the description below. Other features, objects, and advantages of the invention will be apparent from the description. Unless otherwise defined herein, scientific and technical terms used in connection with the present invention shall have the meanings that are commonly understood by those of ordinary skill in the art. Further, unless otherwise required by context, singular terms shall include the plural and plural terms shall include the singular. The terms "a" and "an" includes plural references unless the context dictates otherwise. Generally, nomenclatures used in connection with, and techniques of, biochemistry, enzymology, molecular and cellular biology, microbiology, genetics and protein and nucleic acid chemistry and hybridization described herein are those well-known and commonly used in the art.

The following terms, unless otherwise indicated, shall be understood to have the following meanings:

The term "polynucleotide" or "nucleic acid molecule" refers to a polymeric form of nucleotides of at least 10 bases in length. The term includes DNA molecules (e.g., cDNA or genomic or synthetic DNA) and RNA molecules (e.g., mRNA or synthetic RNA), as well as analogs of DNA or RNA containing non-natural nucleotide analogs, non-native internucleoside bonds, or both. The nucleic acid can be in any topological conformation. For instance, the nucleic acid can be single-stranded, double-stranded, triple-stranded, quadruplexed, partially double-stranded, branched, hairpinned, circular, or in a padlocked conformation.

Unless otherwise indicated, and as an example for all sequences described herein under the general format "SEQ ID NO:", "nucleic acid comprising SEQ ID NO:1" refers to a nucleic acid, at least a portion of which has either (i) the sequence of SEQ ID NO:1, or (ii) a sequence complementary to SEQ ID NO:1. The choice between the two is dictated by the context. For instance, if the nucleic acid is used as a probe, the choice between the two is dictated by the requirement that the probe be complementary to the desired target.

An "isolated" RNA, DNA or a mixed polymer is one which is substantially separated from other cellular components that naturally accompany the native polynucleotide in its natural host cell, e.g., ribosomes, polymerases and genomic sequences with which it is naturally associated.

An "isolated" organic molecule (e.g., a silk protein) is one which is substantially separated from the cellular components (membrane lipids, chromosomes, proteins) of the host cell from which it originated, or from the medium in which the host cell was cultured. The term does not require that the biomolecule has been separated from all other chemicals, although certain isolated biomolecules may be purified to near homogeneity.

The term "recombinant" refers to a biomolecule, e.g., a gene or protein, that (1) has been removed from its naturally occurring environment, (2) is not associated with all or a portion of a polynucleotide in which the gene is found in nature, (3) is operatively linked to a polynucleotide which it is not linked to in nature, or (4) does not occur in nature. The term "recombinant" can be used in reference to cloned DNA isolates, chemically synthesized polynucleotide analogs, or polynucleotide analogs that are biologically synthesized by heterologous systems, as well as proteins and/or mRNAs encoded by such nucleic acids.

An endogenous nucleic acid sequence in the genome of an organism (or the encoded protein product of that sequence) is deemed "recombinant" herein if a heterologous sequence is placed adjacent to the endogenous nucleic acid sequence, such that the expression of this endogenous nucleic acid sequence is altered. In this context, a heterologous sequence is a sequence that is not naturally adjacent to the endogenous nucleic acid sequence, whether or not the heterologous sequence is itself endogenous (originating from the same host cell or progeny thereof) or exogenous (originating from a different host cell or progeny thereof). By way of example, a promoter sequence can be substituted (e.g., by homologous recombination) for the native promoter of a gene in the genome of a host cell, such that this gene has an altered expression pattern. This gene would now become "recombinant" because it is separated from at least some of the sequences that naturally flank it.

A nucleic acid is also considered "recombinant" if it contains any modifications that do not naturally occur to the corresponding nucleic acid in a genome. For instance, an endogenous coding sequence is considered "recombinant" if it contains an insertion, deletion or a point mutation introduced artificially, e.g., by human intervention. A "recombinant nucleic acid" also includes a nucleic acid integrated into a host cell chromosome at a heterologous site and a nucleic acid construct present as an episome.

The term "peptide" as used herein refers to a short polypeptide, e.g., one that is typically less than about 50 amino acids long and more typically less than about 30 amino acids long. The term as used herein encompasses analogs and mimetics that mimic structural and thus biological function.

The term "polypeptide" encompasses both naturally-occurring and non-naturally-occurring proteins, and fragments, mutants, derivatives and analogs thereof. A polypeptide may be monomeric or polymeric. Further, a polypeptide may comprise a number of different domains each of which has one or more distinct activities.

The term "isolated protein" or "isolated polypeptide" is a protein or polypeptide that by virtue of its origin or source of derivation (1) is not associated with naturally associated components that accompany it in its native state, (2) exists in a purity not found in nature, where purity can be adjudged with respect to the presence of other cellular material (e.g., is free of other proteins from the same species) (3) is expressed by a cell from a different species, or (4) does not occur in nature (e.g., it is a fragment of a polypeptide found in nature or it includes amino acid analogs or derivatives not found in nature or linkages other than standard peptide bonds). Thus, a polypeptide that is chemically synthesized or synthesized in a cellular system different from the cell from which it naturally originates will be "isolated" from its naturally associated components. A polypeptide or protein may also be rendered substantially free of naturally associated components by isolation, using protein purification techniques well known in the art. As thus defined, "isolated" does not necessarily require that the protein, polypeptide, peptide or oligopeptide so described has been physically removed from its native environment.

The term "polypeptide fragment" refers to a polypeptide that has a deletion, e.g., an amino-terminal and/or carboxy-terminal deletion compared to a full-length polypeptide. In a preferred embodiment, the polypeptide fragment is a contiguous sequence in which the amino acid sequence of the fragment is identical to the corresponding positions in the naturally-occurring sequence. Fragments typically are at least 5, 6, 7, 8, 9 or 10 amino acids long, preferably at least 12, 14, 16 or 18 amino acids long, more preferably at least 20 amino acids long, more preferably at least 25, 30, 35, 40 or 45, amino acids, even more preferably at least 50 or 60 amino acids long, and even more preferably at least 70 amino acids long.

A protein has "homology" or is "homologous" to a second protein if the nucleic acid sequence that encodes the protein has a similar sequence to the nucleic acid sequence that encodes the second protein. Alternatively, a protein has homology to a second protein if the two proteins have "similar" amino acid sequences. (Thus, the term "homologous proteins" is defined to mean that the two proteins have similar amino acid sequences.) As used herein, homology between two regions of amino acid sequence (especially with respect to predicted structural similarities) is interpreted as implying similarity in function.

When "homologous" is used in reference to proteins or peptides, it is recognized that residue positions that are not identical often differ by conservative amino acid substitutions. A "conservative amino acid substitution" is one in which an amino acid residue is substituted by another amino acid residue having a side chain (R group) with similar chemical properties (e.g., charge or hydrophobicity). In general, a conservative amino acid substitution will not substantially change the functional properties of a protein. In cases where two or more amino acid sequences differ from each other by conservative substitutions, the percent sequence identity or degree of homology may be adjusted upwards to correct for the conservative nature of the substitution. Means for making this adjustment are well known to those of skill in the art. See, e.g., Pearson, 1994, *Methods Mol. Biol.* 24:307-31 and 25:365-89 (herein incorporated by reference).

The twenty conventional amino acids and their abbreviations follow conventional usage. See *Immunology-A Synthesis* (Golub and Gren eds., Sinauer Associates, Sunderland, Mass., $2^{nd}$ ed. 1991), which is incorporated herein by reference. Stereoisomers (e.g., D-amino acids) of the twenty conventional amino acids, unnatural amino acids such as α-, α-disubstituted amino acids, N-alkyl amino acids, and other unconventional amino acids may also be suitable components for polypeptides of the present invention. Examples of unconventional amino acids include: 4-hydroxyproline, γ-carboxyglutamate, ε-N,N,N-trimethyllysine, ε-N-acetyllysine, O-phosphoserine, N-acetylserine, N-formylmethionine, 3-methylhistidine, 5-hydroxylysine, N-methylarginine, and other similar amino acids and imino acids (e.g., 4-hydroxyproline). In the polypeptide notation used herein, the left-hand end corresponds to the amino terminal end and the right-hand end corresponds to the carboxy-terminal end, in accordance with standard usage and convention.

The following six groups each contain amino acids that are conservative substitutions for one another: 1) Serine (S), Threonine (T); 2) Aspartic Acid (D), Glutamic Acid (E); 3) Asparagine (N), Glutamine (Q); 4) Arginine (R), Lysine (K); 5) Isoleucine (I), Leucine (L), Methionine (M), Alanine (A), Valine (V), and 6) Phenylalanine (F), Tyrosine (Y), Tryptophan (W).

Sequence homology for polypeptides, which is sometimes also referred to as percent sequence identity, is typically measured using sequence analysis software. See, e.g., the Sequence Analysis Software Package of the Genetics Computer Group (GCG), University of Wisconsin Biotechnology Center, 910 University Avenue, Madison, Wis. 53705. Protein analysis software matches similar sequences using a measure of homology assigned to various substitutions, deletions and other modifications, including conservative amino acid substitutions. For instance, GCG contains programs such as "Gap" and "Bestfit" which can be used with default parameters to determine sequence homology or sequence identity between closely related polypeptides, such as homologous polypeptides from different species of organisms or between a wild-type protein and a mutein thereof. See, e.g., GCG Version 6.1.

A useful algorithm when comparing a particular polypeptide sequence to a database containing a large number of sequences from different organisms is the computer program BLAST (Altschul et al., *J. Mol. Biol.* 215:403-410 (1990); Gish and States, *Nature Genet.* 3:266-272 (1993); Madden et al., *Meth. Enzymol.* 266:131-141 (1996); Altschul et al., *Nucleic Acids Res.* 25:3389-3402 (1997); Zhang and Madden, *Genome Res.* 7:649-656 (1997)), especially blastp or tblastn (Altschul et al., *Nucleic Acids Res.* 25:3389-3402 (1997)).

Preferred parameters for BLASTp are: Expectation value: 10 (default); Filter: seg (default); Cost to open a gap: 11 (default); Cost to extend a gap: 1 (default); Max. alignments: 100 (default); Word size: 11 (default); No. of descriptions: 100 (default); Penalty Matrix: BLOWSUM62.

Preferred parameters for BLASTp are: Expectation value: 10 (default); Filter: seg (default); Cost to open a gap: 11 (default); Cost to extend a gap: 1 (default); Max. alignments: 100 (default); Word size: 11 (default); No. of descriptions: 100 (default); Penalty Matrix: BLOWSUM62. The length of polypeptide sequences compared for homology will generally be at least about 16 amino acid residues, usually at least about 20 residues, more usually at least about 24 residues, typically at least about 28 residues, and preferably more than about 35 residues. When searching a database containing sequences from a large number of different organisms, it is preferable to compare amino acid sequences. Database searching using amino acid sequences can be measured by algorithms other than blastp known in the art. For instance, polypeptide sequences can be compared using FASTA, a program in GCG Version 6.1. FASTA provides alignments and percent sequence identity of the regions of the best overlap between the query and search sequences. Pearson, *Methods Enzymol.* 183:63-98 (1990) (incorporated by reference herein). For example, percent sequence identity between amino acid sequences can be determined using FASTA with its default parameters (a word size of 2 and the PAM250 scoring matrix), as provided in GCG Version 6.1, herein incorporated by reference.

Throughout this specification and claims, the word "comprise" or variations such as "comprises" or "comprising," will be understood to imply the inclusion of a stated integer or group of integers but not the exclusion of any other integer or group of integers.

The term "wet spinning" as used herein refers to a method of forming fibers from a polymer wherein the polymer is dissolved in solution and extruded into a substance that makes the dissolved polymer coagulate.

The term "coagulation bath" as used herein refers to a liquid bath comprising a substance that makes fibers coagulate.

The term "drawing" as used herein with reference to a fiber refers to the application of force to stretch a wet-spun fiber along its longitudinal axis after extrusion of the fiber into a coagulation bath. The term "undrawn fibers" refers to fibers that have been extruded into a coagulation bath but have not been subject to any drawing force. The term "draw ratio" is a term of art commonly defined as the ratio between the collection rate and the feeding rate. At constant volume, it can be determined from a ratio of the initial diameter ($D_i$) and final diameter ($D_f$) of the fiber (i.e., $D_i/D_f$).

The term "glass transition temperature" as used herein refers to the temperature at which a substance transitions from a hard, rigid or "glassy" state into a more pliable, "rubbery" state.

The term "melting temperature" as used herein refers to the temperature at which a substance transitions from a rubbery state to a less-ordered liquid phase. As used herein, the term melting temperature does not refer to the temperature at which recombinant proteins containing beta-sheets are denatured.

The term "plasticizer" as used herein refers to any molecule that interacts with a polypeptide sequence to prevent the polypeptide sequence from forming tertiary structures and bonds and/or increases the mobility of the polypeptide sequence to promote plasticity and flexibility. Some plasticizers enable the formation of structure. For example, water enables ß-sheet formation in silk.

Exemplary methods and materials are described below, although methods and materials similar or equivalent to those described herein can also be used in the practice of the present invention and will be apparent to those of skill in the art. All publications and other references mentioned herein are incorporated by reference in their entirety. In case of conflict, the present specification, including definitions, will control. The materials, methods, and examples are illustrative only and not intended to be limiting.

Overview

Provided herein are scalable methods of post-processing wet-spun fiber comprising recombinant silk proteins. These techniques discussed herein employ stable heat sources in conjunction with known quantities of plasticizers to draw fibers, resulting in an increase in the beta-sheet formation in the drawn fibers and the production of a three-dimensional lattice of beta-sheet structures. These techniques are designed to be scalable and therefore optimal for the large-scale production of recombinant silk fibers.

Recombinant Silk Proteins

The present disclosure describes embodiments of the invention including fibers synthesized from synthetic proteinaceous copolymers (i.e., recombinant polypeptides). Suitable proteinaceous co-polymers are discussed in U.S. Patent Publication No. 2016/0222174, published Aug. 45, 2016, U.S. Patent Publication No. 2018/0111970, published Apr. 26, 2018, and U.S. Patent Publication No. 2018/0057548, published Mar. 1, 2018, each of which are incorporated by reference herein in its entirety.

In some embodiments, the synthetic proteinaceous copolymers are made from silk-like polypeptide sequences. In some embodiments, the silk-like polypeptide sequences are 1) block copolymer polypeptide compositions generated by mixing and matching repeat domains derived from silk polypeptide sequences and/or 2) recombinant expression of block copolymer polypeptides having sufficiently large size (approximately 40 kDa) to form useful molded body compositions by secretion from an industrially scalable microorganism. Large (approximately 40 kDa to approximately 100 kDa) block copolymer polypeptides engineered from silk repeat domain fragments, including sequences from almost all published amino acid sequences of spider silk polypeptides, can be expressed in the modified microorganisms described herein. In some embodiments, silk polypeptide sequences are matched and designed to produce highly expressed and secreted polypeptides capable of molded body formation.

In some embodiments, block copolymers are engineered from a combinatorial mix of silk polypeptide domains across the silk polypeptide sequence space. In some embodiments, the block copolymers are made by expressing and secreting in scalable organisms (e.g., yeast, fungi, and gram positive bacteria). In some embodiments, the block copolymer polypeptide comprises 0 or more N-terminal domains (NTD), 1 or more repeat domains (REP), and 0 or more C-terminal domains (CTD). In some aspects of the embodiment, the block copolymer polypeptide is >100 amino acids of a single polypeptide chain. In some embodiments, the block copolymer polypeptide comprises a domain that is at least 80%, 81%, 82%, 83%, 84%, 85%, 86%, 87%, 88%, 89%, 90%, 91%, 92%, 93%, 94%, 95%, 96%, 97%, 98%, or 99% identical to a sequence of a block copolymer polypeptide as disclosed in International Publication No. WO/2015/042164, "Methods and Compositions for Synthesizing Improved Silk Fibers," incorporated by reference in its entirety.

Several types of native spider silks have been identified. The mechanical properties of each natively spun silk type are believed to be closely connected to the molecular composition of that silk. See, e.g., Garb, J. E., et al., Untangling spider silk evolution with spidroin terminal domains, *BMC Evol. Biol.,* 10:243 (2010); Bittencourt, D., et al., Protein families, natural history and biotechnological aspects of spider silk, *Genet. Mol. Res.,* 11:3 (2012); Rising, A., et al., Spider silk proteins: recent advances in recombinant production, structure-function relationships and biomedical applications, *Cell. Mol. Life Sci.,* 68:2, pg. 169-184 (2011); and Humenik, M., et al., Spider silk: understanding the structure-function relationship of a natural fiber, *Prog. Mol. Biol. Transl. Sci.,* 103, pg. 131-85 (2011). For example:

Aciniform (AcSp) silks tend to have high toughness, a result of moderately high strength coupled with moderately high extensibility. AcSp silks are characterized by large block ("ensemble repeat") sizes that often incorporate motifs of poly serine and GPX. Tubuliform (TuSp or Cylindrical) silks tend to have large diameters, with modest strength and high extensibility. TuSp silks are characterized by their poly serine and poly threonine content, and short tracts of poly alanine. Major Ampullate (MaSp) silks tend to have high strength and modest extensibility. MaSp silks can be one of two subtypes: MaSp1 and MaSp2. MaSp1 silks are generally less extensible than MaSp2 silks, and are characterized by poly alanine, GX, and GGX motifs. MaSp2 silks are characterized by poly alanine, GGX, and GPX motifs. Minor Ampullate (MiSp) silks tend to have modest strength and modest extensibility. MiSp silks are characterized by GGX, GA, and poly A motifs, and often contain spacer elements of approximately 100 amino acids. Flagelliform (Flag) silks tend to have very high extensibility and modest strength. Flag silks are usually characterized by GPG, GGX, and short spacer motifs.

The properties of each silk type can vary from species to species, and spiders leading distinct lifestyles (e.g. sedentary web spinners vs. vagabond hunters) or that are evolutionarily older may produce silks that differ in properties from the above descriptions (for descriptions of spider diversity and classification, see Hormiga, G., and Griswold, C. E., Systematics, phylogeny, and evolution of orb-weaving spiders, *Annu. Rev. Entomol.* 59, pg. 487-512 (2014); and Blackedge, T. A. et al., Reconstructing web evolution and spider diversification in the molecular era, *Proc. Natl. Acad. Sci. U.S.A.,* 106:13, pg. 5229-5234 (2009)). However, synthetic block copolymer polypeptides having sequence similarity and/or amino acid composition similarity to the repeat domains of native silk proteins can be used to manufacture on commercial scales consistent molded bodies that have properties that recapitulate the properties of corresponding molded bodies made from natural silk polypeptides.

In some embodiments, a list of putative silk sequences can be compiled by searching GenBank for relevant terms, e.g. "spidroin" "fibroin" "MaSp", and those sequences can be pooled with additional sequences obtained through independent sequencing efforts. Sequences are then translated into amino acids, filtered for duplicate entries, and manually split into domains (NTD, REP, CTD). In some embodiments, candidate amino acid sequences are reverse translated into a DNA sequence optimized for expression in *Pichia* (*Komagataella*) *pastoris*. The DNA sequences are each cloned into an expression vector and transformed into *Pichia* (*Komagataella*) *pastoris*. In some embodiments, various silk domains demonstrating successful expression and secretion are subsequently assembled in combinatorial fashion to build silk molecules capable of molded body formation.

Silk polypeptides are characteristically composed of a repeat domain (REP) flanked by non-repetitive regions (e.g., C-terminal and N-terminal domains). In an embodiment, both the C-terminal and N-terminal domains are between 75-350 amino acids in length. The repeat domain exhibits a hierarchical architecture, as depicted in FIG. 1. The repeat domain comprises a series of blocks (also called repeat units). The blocks are repeated, sometimes perfectly and sometimes imperfectly (making up a quasi-repeat domain), throughout the silk repeat domain. The length and composition of blocks varies among different silk types and across different species. Table 1A lists examples of block sequences from selected species and silk types, with further examples presented in Rising, A. et al., Spider silk proteins: recent advances in recombinant production, structure-function relationships and biomedical applications, *Cell Mol. Life Sci.,* 68:2, pg 169-184 (2011); and Gatesy, J. et al., Extreme diversity, conservation, and convergence of spider silk fibroin sequences, *Science,* 291:5513, pg. 2603-2605 (2001). In some cases, blocks may be arranged in a regular pattern, forming larger macro-repeats that appear multiple times (usually 2-8) in the repeat domain of the silk sequence. Repeated blocks inside a repeat domain or macro-repeat, and repeated macro-repeats within the repeat domain, may be separated by spacing elements. In some embodiments, block sequences comprise a glycine rich region followed by a polyA region. In some embodiments, short (~1-10) amino acid motifs appear multiple times inside of blocks. For the purpose of this invention, blocks from different natural silk polypeptides can be selected without reference to circular permutation (i.e., identified blocks that are otherwise similar between silk polypeptides may not align due to circular permutation). The particular permutation selected for a given silk sequence can be dictated by convenience (usually starting with a G) more than anything else. Silk sequences obtained from the NCBI database can be partitioned into blocks and non-repetitive regions.

Fiber-forming block copolymer polypeptides from the blocks and/or macro-repeat domains, according to certain embodiments of the invention, is described in International Publication No. WO/2015/042164, incorporated by reference. Natural silk sequences obtained from a protein database such as GenBank or through de novo sequencing are broken up by domain (N-terminal domain, repeat domain, and C-terminal domain). The N-terminal domain and C-terminal domain sequences selected for the purpose of synthesis and assembly into fibers or molded bodies include natural amino acid sequence information and other modifications described herein. The repeat domain is decomposed into repeat sequences containing representative blocks, usually 1-8 depending upon the type of silk, that capture critical amino acid information while reducing the size of the DNA encoding the amino acids into a readily synthesizable fragment. In some embodiments, a properly formed block copolymer polypeptide comprises at least one repeat domain comprising at least 1 repeat sequence, and is optionally flanked by an N-terminal domain and/or a C-terminal domain.

In some embodiments, a repeat domain comprises at least one repeat sequence. In some embodiments, the repeat sequence is 150-300 amino acid residues. In some embodiments, the repeat sequence comprises a plurality of blocks. In some embodiments, the repeat sequence comprises a plurality of macro-repeats. In some embodiments, a block or a macro-repeat is split across multiple repeat sequences.

In some embodiments, the repeat sequence starts with a glycine, and cannot end with phenylalanine (F), tyrosine (Y), tryptophan (W), cysteine (C), histidine (H), asparagine (N), methionine (M), or aspartic acid (D) to satisfy DNA assembly requirements. In some embodiments, some of the repeat sequences can be altered as compared to native sequences. In some embodiments, the repeat sequences can be altered such as by addition of a serine to the C terminus of the polypeptide (to avoid terminating in F, Y, W, C, H, N, M, or D). In some embodiments, the repeat sequence can be modified by filling in an incomplete block with homologous sequence from another block. In some embodiments, the repeat sequence can be modified by rearranging the order of blocks or macrorepeats.

In some embodiments, non-repetitive N- and C-terminal domains can be selected for synthesis. In some embodiments, N-terminal domains can be by removal of the leading signal sequence, e.g., as identified by SignalP (Peterson, T. N., et. Al., SignalP 4.0: discriminating signal peptides from transmembrane regions, *Nat. Methods,* 8:10, pg. 785-786 (2011).

In some embodiments, the N-terminal domain, repeat sequence, or C-terminal domain sequences can be derived from *Agelenopsis aperta, Aliatypus gulosus, Aphonopelma seemanni, Aptostichus* sp. AS217, *Aptostichus* sp. AS220, *Araneus diadematus, Araneus gemmoides, Araneus ventricosus, Argiope amoena, Argiope argentata, Argiope bruennichi, Argiope trifasciata, Atypoides riversi, Avicularia juruensis, Bothriocyrtum californicum, Deinopis Spinosa, Diguetia canities, Dolomedes tenebrosus, Euagrus chisoseus, Euprosthenops australis, Gasteracantha mammosa, Hypochilus thorelli, Kukulcania hibernalis, Latrodectus hesperus, Megahexura fulva, Metepeira grandiosa, Nephila antipodiana, Nephila clavata, Nephila clavipes, Nephila madagascariensis, Nephila pilipes, Nephilengys cruentata, Parawixia bistriata, Peucetia viridans, Plectreurys tristis, Poecilotheria regalis, Tetragnatha kauaiensis*, or *Uloborus diversus.*

In some embodiments, the silk polypeptide nucleotide coding sequence can be operatively linked to an alpha mating factor nucleotide coding sequence. In some embodiments, the silk polypeptide nucleotide coding sequence can be operatively linked to another endogenous or heterologous secretion signal coding sequence. In some embodiments, the silk polypeptide nucleotide coding sequence can be operatively linked to a 3×FLAG nucleotide coding sequence. In some embodiments, the silk polypeptide nucleotide coding sequence is operatively linked to other affinity tags such as 6-8 His residues.

In some embodiments, the recombinant spider silk polypeptides are based on recombinant spider silk protein fragment sequences derived from MaSp2, such as from the species *Argiope bruennichi*. In some embodiments, the synthesized fiber contains protein molecules that include two to twenty repeat units, in which a molecular weight of each repeat unit is greater than about 20 kDa. Within each repeat unit of the copolymer are more than about 60 amino acid residues, often in the range 60 to 100 amino acids that are organized into a number of "quasi-repeat units." In some embodiments, the repeat unit of a polypeptide described in this disclosure has at least 95% sequence identity to a MaSp2 dragline silk protein sequence.

The repeat unit of the proteinaceous block copolymer that forms fibers with good mechanical properties can be synthesized using a portion of a silk polypeptide. These polypeptide repeat units contain alanine-rich regions and glycine-rich regions, and are 150 amino acids in length or longer. Some exemplary sequences that can be used as repeats in the proteinaceous block copolymers of this disclosure are provided in in co-owned PCT Publication WO 2015/042164, incorporated by reference in its entirety, and were demonstrated to express using a *Pichia* expression system.

In some embodiments, the spider silk protein comprises: at least two occurrences of a repeat unit, the repeat unit comprising: more than 150 amino acid residues and having a molecular weight of at least 10 kDa; an alanine-rich region with 6 or more consecutive amino acids, comprising an alanine content of at least 80%; a glycine-rich region with 12 or more consecutive amino acids, comprising a glycine content of at least 40% and an alanine content of less than 30%; and wherein the fiber comprises at least one property selected from the group consisting of a modulus of elasticity greater than 550 cN/tex, an extensibility of at least 10% and an ultimate tensile strength of at least 15 cN/tex.

In some embodiments, the quasi-repeat unit of the polypeptide can be described by the formula $\{GGY\text{-}[GPG\text{-}X_1]_{n1}\text{-}GPS\text{-}(A)_{n2}\}$ (SEQ ID NO: 3), where $X_1$ is independently selected from the group consisting of SGGQQ (SEQ ID NO; 4), GAGQQ (SEQ ID NO: 5), GQGPY (SEQ ID NO: 6), AGQQ (SEQ ID NO: 7) and SQ, n1 is a number from 4 to 8, and n2 is a number from 6 to 20. The repeat unit is composed of multiple quasi-repeat units. In additional embodiments, 3 "long" quasi repeats are followed by 3 "short" quasi-repeat units. As mentioned above, short quasi-repeat units are those in which n1=4 or 5. Long quasi-repeat units are defined as those in which n1=6, 7 or 8. In some embodiments, all of the short quasi-repeats have the same $X_1$ motifs in the same positions within each quasi-repeat unit of a repeat unit. In some embodiments, no more than 3 quasi-repeat units out of 6 share the same $X_1$ motifs.

In additional embodiments, a repeat unit is composed of quasi-repeat units that do not use the same $X_1$ more than two occurrences in a row within a repeat unit. In additional embodiments, a repeat unit is composed of quasi-repeat units where at least 1, 2, 3, 4, 5, 6, 7, 8, 9, 10, 11, 12, 13, 14, 15, 16, 17, 18, 19 or 20 of the quasi-repeats do not use the same $X_1$ more than 2 times in a single quasi-repeat unit of the repeat unit.

In some embodiments, the recombinant polypeptide comprises the polypeptide sequence of SEQ ID NO: 1 (i.e., 18B). In some embodiments, the repeat unit is a polypeptide comprising SEQ ID NO: 2. These sequences are provided in Table 1:

TABLE 1

Exemplary polypeptides sequences of recombinant protein and repeat unit

| SEQ ID | Polypeptide Sequence |
|---|---|
| SEQ ID NO: 1 | GGYGPGAGQQGPGSGGQQGPGGQGPYGSGQQGPGGAGQQGPGG<br>QGPYGPGAAAAAAAAAGGYGPGAGQQGPGGAGQQGPGSQGPGG<br>QGPYGPGAGQQGPGSQGPGSGGQQGPGGQGPYGPSAAAAAAAA<br>AGGYGPGAGQRSQGPGGQGPYGPGAGQQGPGSQGPGSGGQQGP<br>GGQGPYGPSAAAAAAAAGGYGPGAGQQGPGSQGPGSGGQQGPG<br>GQGPYGPGAAAAAAAAVGGYGPGAGQQGPGSQGPGSGGQQGPGG<br>QGPYGPSAAAAAAAAGGYGPGAGQQGPGSQGPGSGGQQGPGGQ<br>GPYGPSAAAAAAAAGGYGPGAGQQGPGSGGQQGPGGQGPYGSG<br>QQGPGGAGQQGPGGQGPYGPGAAAAAAAAAGGYGPGAGQQGPG<br>GAGQQGPGSQGPGGQGPYGPGAGQQGPGSQGPGSGGQQGPGGQ<br>GPYGPSAAAAAAAAAGGYGPGAGQRSQGPGGQGPYGPGAGQQG<br>PGSQGPGSGGQQGPGGQGPYGPSAAAAAAAAGGYGPGAGQQGP<br>GSQGPGSGGQQGPGGQGPYGPGAAAAAAAVGGYGPGAGQQGPG<br>SQGPGSGGQQGPGGQGPYGPSAAAAAAAAGGYGPGAGQQGPGS<br>QGPGSGGQQGPGGQGPYGPSAAAAAAAAGGYGPGAGQQGPGSG<br>GQQGPGGQGPYGSGQQGPGGAGQQGPGGQGPYGPGAAAAAAAA<br>AGGYGPGAGQQGPGGAGQQGPGSQGPGGQGPYGPGAGQQGPGS<br>QGPGSGGQQGPGGQGPYGPSAAAAAAAAAGGYGPGAGQRSQGP<br>GGQGPYGPGAGQQGPGSQGPGSGGQQGPGGQGPYGPSAAAAAA<br>AAGGYGPGAGQQGPGSQGPGSGGQQGPGGQGPYGPGAAAAAAA<br>VGGYGPGAGQQGPGSQGPGSGGQQGPGGQGPYGPSAAAAAAAA<br>GGYGPGAGQQGPGSQGPGSGGQQGPGGQGPYGPSAAAAAAAA |

TABLE 1-continued

Exemplary polypeptides sequences of recombinant protein and repeat unit

| SEQ ID | Polypeptide Sequence |
|---|---|
| SEQ ID NO: 2 | GGYGPGAGQQGPGSGGQQGPGGQGPYGSGQQGPGGAGQQGPGG<br>QGPYGPGAAAAAAAAAGGYGPGAGQQGPGGAGQQGPGSQGPGG<br>QGPYGPGAGQQGPGSQGPGSGGQQGPGGQGPYGPSAAAAAAAA<br>AGGYGPGAGQRSQGPGGQGPYGPGAGQQGPGSQGPGSGGQQGP<br>GGQGPYGPSAAAAAAAAGGYGPGAGQQGPGSQGPGSGGQQGPG<br>GQGPYGPGAAAAAAAAVGGYGPGAGQQGPGSQGPGSGGQQGPGG<br>QGPYGPSAAAAAAAAGGYGPGAGQQGPGSQGPGSGGQQGPGGQ<br>GPYGPSAAAAAAAA |

In some embodiments, the structure of fibers formed from the described recombinant spider silk polypeptides form beta-sheet structures, beta-turn structures, or alpha-helix structures. In some embodiments, the secondary, tertiary and quaternary protein structures of the formed fibers are described as having nanocrystalline beta-sheet regions, amorphous beta-turn regions, amorphous alpha helix regions, randomly spatially distributed nanocrystalline regions embedded in a non-crystalline matrix (i.e., a glassy matrix), or randomly oriented nanocrystalline regions embedded in a non-crystalline matrix. While not wishing to be bound by theory, the structural properties of the proteins within the spider silk are theorized to be related to fiber mechanical properties. Crystalline regions in a fiber have been linked with the tensile strength of a fiber, while the amorphous regions have been linked to the extensibility of a fiber. The major ampullate (MA) silks tend to have higher strengths and less extensibility than the flagelliform silks, and likewise, the MA silks have higher volume fraction of crystalline regions compared with flagelliform silks. Furthermore, theoretical models based on the molecular dynamics of crystalline and amorphous regions of spider silk proteins, support the assertion that the crystalline regions have been linked with the tensile strength of a fiber, while the amorphous regions have been linked to the extensibility of a fiber. Additionally, the theoretical modeling supports the importance of the secondary, tertiary and quaternary structure on the mechanical properties of RPFs. For instance, both the assembly of nano-crystal domains in a random, parallel and serial spatial distributions, and the strength of the interaction forces between entangled chains within the amorphous regions, and between the amorphous regions and the nano-crystalline regions, influenced the potential mechanical properties of the resulting fibers.

In some embodiments, the molecular weight of the silk protein may range from 20 kDa to 2000 kDa, or greater than 20 kDa, or greater than 10 kDa, or greater than 5 kDa, or from 5 to 400 kDa, or from 5 to 300 kDa, or from 5 to 200 kDa, or from 5 to 100 kDa, or from 5 to 50 kDa, or from 5 to 500 kDa, or from 5 to 1000 kDa, or from 5 to 2000 kDa, or from 10 to 400 kDa, or from 10 to 300 kDa, or from 10 to 200 kDa, or from 10 to 100 kDa, or from 10 to 50 kDa, or from 10 to 500 kDa, or from 10 to 1000 kDa, or from 10 to 2000 kDa, or from 20 to 400 kDa, or from 20 to 300 kDa, or from 20 to 200 kDa, or from 40 to 300 kDa, or from 40 to 500 kDa, or from 20 to 100 kDa, or from 20 to 50 kDa, or from 20 to 500 kDa, or from 20 to 1000 kDa, or from 20 to 2000 kDa.

Characterization of Recombinant Spider Silk Polypeptide Powder Impurities

Different recombinant spider silk polypeptides have different physiochemical properties such as melting temperature and glass transition temperature based on the strength and stability of the secondary and tertiary structures formed by the proteins. FIG. 1 illustrates exemplary tertiary structures formed by silk polypeptides in native silk fiber (i.e. fiber produced by insects). Silk polypeptides form beta-sheet structures in a monomeric form. In the presence of other monomers, the silk polypeptides form a three-dimensional crystalline lattice of beta-sheet structures. The beta-sheet structures are separated from, and interspersed with, amorphous regions of polypeptide sequences.

Beta-sheet structures are extremely stable at high temperatures—the melting temperature of beta-sheets is approximately 257° C. as measured by fast scanning calorimetry. See Cebe et al., Beating the Heat—Fast Scanning Melts Silk Beta-sheet Crystals, Nature Scientific Reports 3:1130 (2013). As beta-sheet structures are thought to stay intact above the glass transition temperature of silk polypeptides, it has been postulated that the structural transitions seen at the glass transition temperature of silk polypeptides are due to increased mobility of the amorphous regions between the beta-sheets.

Plasticizers lower the glass transition temperature and the melting temperature of silk proteins by increasing the mobility of the amorphous regions and potentially disrupting beta-sheet structure. Suitable plasticizers used for this purpose include water, polyalcohols (polyols) and urea. As hydrophilic portions of silk polypeptides can bind ambient water present in the air as humidity, bound ambient water may plasticize silk polypeptides.

In addition, in instances where recombinant spider silk polypeptides are produced by fermentation and recovered as recombinant spider silk polypeptide powder from the same, there may be impurities present in the recombinant spider silk polypeptide powder that act as plasticizers or otherwise inhibit the formation of tertiary structures. For example, residual lipids and sugars may act as plasticizers and thus influence the glass transition temperature of the protein by interfering with the formation of tertiary structures.

Various well-established methods may be used to assess the purity and relative composition of recombinant spider silk polypeptide powder. Size Exclusion Chromatography separates molecules based on their relative size and can be used to analyze the relative amounts of recombinant spider silk polypeptide in its aggregate and monomeric forms as well as the amount of high, low and intermediate molecular weight impurities in the recombinant spider silk polypeptide powder. Similarly, Rapid High Performance Liquid Chromatography may be used to measure various compounds present in a solution such as monomeric forms of the recombinant spider silk polypeptide. Ion Exchange Liquid Chromatography may be used to assess the concentrations of various trace molecules in solution, including impurities such as lipids and sugars. Other methods of chromatography and quantification of various molecules such as mass spectrometry are well established in the art.

Depending on the embodiment, the recombinant spider silk polypeptide powder may have a purity calculated based on the amount of the recombinant spider silk polypeptide in is monomeric and aggregate forms by weight relative to the other components of the powder. In various instances, the purity can range from 50% by weight to 90% by weight, depending on the type of recombinant spider silk polypeptide and the techniques used to recover, separate and post-process the recombinant spider silk polypeptide powder.

Dope Rheology and Protein Structures

Rheology is commonly used in fiber spinning to analyze the physio-chemical characteristics of the material that is spun into fiber such as polymers. Different rheological characteristics may impact the ability to spin material into fibers and the mechanical characteristics of the spun fibers. Rheology can be also used to indirectly study the secondary, tertiary and quaternary structures formed by recombinant spider silk polypeptides under different temperatures and conditions. Depending on the embodiment, shear rheometers and/or extensional rheometers may be used to analyze different rheological properties by oscillatory and extensional rheology.

In some embodiments, small amplitude oscillatory shear (SAOS) rheology is used to measure various rheological properties including but not limited to the loss tangent ($G''/G'$), complex viscosity ($\eta^*$) and phase angle ($\delta$). In these embodiments, a SAOS rheometer outputs a stress response as a function of oscillation frequency, $\omega$, which can be broken down into elastic and viscous contributions. The elastic component, the solid-like behavior, is measured by the storage modulus (or elastic modulus), $G'(\omega)$, while the viscous component, the fluid-like behavior, is measured by loss modulus (or viscous modulus), $G''(\omega)$. The rheometer also measures the ratio of $G''/G'$, called the loss tangent, or tan ($\delta$), which describes the extent to which the complex fluid is liquid-like ($\tan(\delta) \gg 1$) or solid-like ($\tan(\delta) \ll 1$). The rheometer outputs the values of the phase angle, $\delta$, which spans from 90° (ideal liquid) to 0° (ideal solid). At G' and G" crossover, $\delta$ is 45°, and the material is transitioning from being more liquid-like to more solid-like. In addition, the complex viscosity $\eta^*$, defined by $\eta^*=G^*(\omega)/\omega$, is also measured by the rheometer. In embodiments where the silk polypeptide is a recombinant silk protein that is wet spun into fiber, different rheological characteristics such as complex viscosity, loss tangent, and phase angle may be assessed based on a spin dope comprising the recombinant spider silk polypeptide dissolved into an appropriate solvent. Similarly, in embodiments where the silk polypeptide is melt spun into fiber, different rheological characteristics may be assessed based on a spin dope comprising the silk polypeptide and a plasticizer.

Depending on the embodiment, various rheology metrics may be used to determine whether a spin dope comprising recombinant spider silk polypeptide is suitable for wet spinning. For example, in some embodiments, a complex viscosity as measured at 10 Hz of less than 30 Pa s, less than 25 Pa s, less than 20 Pa s, less than 15 Pa s can indicate that a spin dope comprising recombinant spider silk polypeptide is not suitable for wet spinning. Similarly, in some embodiments, a complex viscosity as measured at 10 Hz of higher than 70 Pa s, higher than 75 Pa s, higher than 80 Pa s, higher than 85 Pa s can indicate that a spin dope comprising recombinant spider silk polypeptide is not suitable for wet spinning. In some embodiments, the phase angle of the spin dope comprising recombinant spider silk polypeptide may between 50-90°, 55-85°, 65-85°, 65-80°, 70-80°, 70-85°, 65-70°, or 50-65°.

In some embodiments, Differential Scanning calorimetry is used to determine the glass transition temperature of the recombinant spider silk polypeptide and/or fiber containing the same. In a specific embodiment, Modulated Differential Scanning calorimetry is used to measure the glass transition temperature.

Depending on the embodiment and the type of recombinant spider silk polypeptide, the glass transition temperature may have a range of values. However, a measured glass transition temperature that is much lower that is typically observed for a recombinant spider silk polypeptide in its solid form may indicate that impurities or the presence of other plasticizers.

In addition, Fourier Transform Infrared (FTIR) spectroscopy data may be combined with rheology data to provide both a direct characterization of tertiary structures in the recombinant silk powder and/or spin dope containing the same. FTIR can be used to quantify secondary structures in silk polypeptides and/or dope comprising the silk polypeptides as discussed below in the section entitled "Fourier Transform Infrared (FTIR) Spectroscopy."

Depending on the embodiment, FTIR may be used to quantify beta-sheet structures present in the recombinant spider silk polypeptide powder and/or spin dope containing the same. In addition, in some embodiments, FTIR may be used to quantify impurities such as sugars and lipids present in the recombinant spider silk polypeptide powder. However, various chaotropes and solubilizers used in different protein pre-processing methods may diminish the number of tertiary structures in recombinant spider silk polypeptide powder or spin dope containing the same. Accordingly, there may be no correspondence between the amount of beta-sheet structures in recombinant spider silk polypeptide powder before and after is it spun into fiber. Similarly, there may be little to no correspondence between the glass transition temperature of a powder before and after it is spun into fiber.

In some embodiments, rheological data characterizing the recombinant spider silk polypeptides may be combined with FTIR to analyze secondary and tertiary structures formed in by the polypeptides. In a specific embodiment, rheological data may be captured in conjunction with FTIR spectra. For exemplary methods of combining rheology and FTIR, see Boulet-Audet et al., Silk protein aggregation kinetics revealed by Rheo-IR, Acta Biomaterialia 10:776-784(2014), the entirety of which is herein incorporated by reference.

Similarly, various methods of characterizing impurities in the recombinant silk powder may be combined with rheological and/or FTIR data to analyze the relationship between the presence of impurities and the formation of secondary and tertiary structures.

Wet Spinning Recombinant Silk Proteins

Depending on the embodiment, the recombinant spider silk polypeptides may be wet-spun into fiber using various established methods. Exemplary methods of wet-spinning recombinant spider silk polypeptides are discussed in detail in U.S. Pat. No. 7,057,023, the entirety of which is herein incorporated by reference.

In most wet spinning embodiments, recombinant spider silk polypeptides are dissolved to form a spin dope. Suitable solvents for use in a spin dope include but are not limited to formic acid, aqueous solutions (e.g., eADF4), dimethyl sulfoxide (DMSO), N, N-dimethylformamide (DMF), hexafluoroisopropanol (HFIP), hexafluoroacetone hydrate, trifluoroacetic acid, water, phosphoric acid and any combination thereof. Other suitable solvents are listed in Koeppel and Holland, Progress and Trends in Artificial Silk Spinning: A Systematic Review, ACS Biomater. Sci. Eng. 3:226-237 (2017), the entirety of which is herein incorporated by reference. Depending on the solvent used, various salts may be added to the spin dope. In some embodiments, N-methyl morpholine N-oxide (NMMO) is used as a solvent for recombinant spider silk polypeptide.

In various embodiments, the concentration of solvent and recombinant silk protein in the spin dope may be varied based on the properties of the silk polypeptide and the type of solvent used. Concentrations may be adjusted in part based on rheological data such as the complex viscosity or the phase angle. In specific embodiments where formic acid is used to dissolve the 18B protein (SEQ ID NO: 1), suitable concentrations of recombinant silk protein by weight in the spin dope range from: 20-60% by weight, 20-50% by weight, 20-40% by weight, 30-40% by weight, 30-60% by weight, or 30-50% by weight. In embodiments where NMMO is used to dissolve the 18B protein, suitable concentrations of recombinant silk protein by weight in the spin dope range from 20-60% by weight, 20-50% by weight, 20-40% by weight, 30-40% by weight, 30-60% by weight, or 30-50% by weight.

In some embodiments, a plasticizer will be added to the spin dope. Suitable plasticizers include water, polyols (e.g. glycerol), lactic acid, methyl hydroperoxide, ascorbic acid, 1,4-dihydroxybenzene (1,4 Benzenediol) Benzene-1,4-diol, phosphoric acid, ethylene glycol, propylene glycol, triethanolamine, acid acetate, propane-1,3-diol or any combination thereof.

In some embodiments, various agents may be added to the spin dope to alter the rheological characteristics of the spin dope such as elongational viscosity, shear viscosity and linear viscoelasticity. Suitable agents used to alter the elongational viscosity include polyethylene glycol (PEG), Tween, Sodium dodecyl sulfate, polyethylene oxide, or any combination thereof. Other suitable agents are well known in the art.

In various embodiments, the spin dope may be subject to mixing or agitation to ensure a homogeneous spin dope. Suitable methods of mixing the spin dope include but are not limited to centrifugal mixers, high-shear mixers, and twin screw mixing. Other mixing methods are well established in the art. In instances where NMMO is used as a solvent, the spin dope may be subject to heat during mixing to form a viscous solution. In some instances, the spin dope may be degassed using centrifugation.

In some embodiments, a pigment or dye may be added to the spin dope to perform "solution dying" of the fiber. Solution dying is an optimal method of dying fiber as it eliminates large amounts of wastewater involved in dying finished fibers and textiles. Dyes may form covalent or cationic bonds with the recombinant silk protein to provide a colorfast fiber. Any type of dye and/or pigment may be used for solution dying including but not limited to cationic dyes, anionic dyes, zwitterionic dyes and dispersions of pigment.

Depending on the required initial denier of the extruded fiber, spin dope comprising the recombinant silk protein may be extruded through spinnerets with varying orifice sizes. In most embodiments, the orifice will range from 50-200 μm, 50-100 μm, 50-150 μm, 100-150 μm, 100-200 μm or 150-200 μm. In some embodiments, the ideal orifice size will be based on the final draw ratio of the fiber. For example, a higher initial denier of an extruded fiber may be subject to a higher draw ratio than a smaller initial denier extruded fiber.

In instances where NMMO is used as a solvent, an air gap may be used to separate the extrusion device from the coagulation bath. Depending on the embodiment, the air gap may range in size from 2-5 cm, 2-10 cm, 2-20 cm, 5-10 cm, 5-20 cm, or 10-30 cm.

In various embodiments, different coagulation baths may be used, alone or sequentially. In some embodiments, alcohol such as ethanol or methanol will be used as a coagulation agent to precipitate or otherwise coagulated the extruded spin dope. Suitable alcohols for this purpose include ethanol, methanol or any combination thereof. For example, suitable coagulation bath could contain 80% ethanol and 20% methanol; 60% ethanol and 40% methanol; 40% ethanol and 60% methanol; or 20% ethanol and 80% methanol.

In some embodiments, the coagulation bath will combine a coagulation agent with the solvent used to generate the spin dope. For example, in some embodiments, the coagulation bath will comprise an alcohol and formic acid. In a specific embodiment, the coagulation bath will comprise 90% ethanol and 10% formic acid.

In some embodiments, the coagulation bath will combine a coagulation agent with a plasticizer such as water or any of the plasticizers listed above. In a specific embodiment, the coagulation bath will comprise 90% ethanol and 10% $H_2O$.

Depending on the embodiment, the fiber may be subject to any number of coagulation baths, in any order. In some embodiments, the fiber may be the following series of coagulation baths: a coagulation bath comprising the solvent used for dope spinning, a coagulation bath comprising only alcohol, and a coagulation bath comprising a plasticizer.

Depending on the embodiment, the total residence time in the one or more coagulation baths will range from 5-10 seconds, 5-50 seconds, 10-50 seconds, 10-25 seconds, 20-50 seconds, from 25-50 seconds, from 30-50 seconds, from 35-50 seconds, from 40-50 seconds, from 20-40 seconds, from 20-35 seconds, from 20-30 seconds, and/or from 30-40 seconds. In most embodiments, the residence time will be sufficient to eliminate most or all residual formic acid from the fiber.

In most embodiments of the present invention, the extruded fiber will not be subject to any drawing while it is transferred through the one or more coagulation baths. In other words, the extruded fiber will only be subject to the minimal amount of force necessary to move the fiber through the coagulation bath and collect fiber on the godets. Extruded fiber that is not subject to any drawing strain is herein referred to as "precursor fiber."

Drawing Undrawn Fiber Over a Hot Surface

Precursor fiber may be drawn in order to increase the orientation of the fiber and promote three-dimensional crystalline structure formed by intermolecular and intramolecular beta-sheets. The application of activation strain in drawing promotes molecules to align on the axis of the fiber. Polymeric molecules such as polypeptides are partially aligned when forced to flow through the spinneret hole.

In some embodiments, the precursor fiber may be annealed using alcohol prior to drawing. In specific embodiments, the precursor fiber may be annealed using alcohol vapor (e.g. methanol vapor). In these embodiments, the precursor fiber may be placed in a sealed container with alcohol for a period of time ranging from 1 hour to 24 hours, 1 hour to 6 hours, 1 hour to 12 hours, 1 hour to 24 hours, 2 hours to 6 hours, 4 hours to 12 hours, 6 hours to 18 hours, 6 hours to 24 hours, 12 hours to 24 hours, 12 hours to 48 hours.

In the present invention, the alignment is optimized by passing the precursor fiber over a uniform hot surface while the fiber is drawn. The term "hot surface" as used herein refers to a surface that has provides both a substantially uniform heat and a substantially uniform surface. Using a hot surface as a heat source eliminates variability seen using ambient heat sources, resulting in greater uniformity in results and consequent scalability of the process for commercial mass production of the fiber. In some embodiments, the hot surface will be a metal bar or surface. In other embodiments, the hot surface may be made of ceramic or other materials. Depending on the embodiment, the hot surface can be curved or otherwise configured to facilitate the fiber moving over the hot surface.

In embodiments of the present invention, the undrawn extruded fiber is simultaneously moved over the hot surface in contact with the hot surface as it is drawn. Depending on the embodiment, the temperature of the hot surface can range from 160-210° C., 180-210° C., 190-210° C., 195-210° C., 195-205° C., or 200-205° C.

Depending on the embodiment, the undrawn extruded fiber can be subject to different draw ratios while it is drawn over the hot surface. Depending on the embodiment, the draw ratio may range from 2 to 7. In some embodiments, the maximum stable draw ratio may depend on the temperature of the hot surface.

In some embodiments, the temperature of the hot surface is calculated as a function of the glass transition temperature of the undrawn extruded fiber. For example, the temperature of the hot surface can be calculated to be greater than 5° C., 10° C., 15° C., 20° C., or 25° C. greater than the glass transition temperature of the recombinant silk protein powder and/or the undrawn extruded fiber.

In some embodiments, the maximum draw ratio is determined using an apparatus designed to calculate the draw ratio at which the fiber will break (herein referred to as "draw ratio at failure"). In one embodiment, the apparatus is constructed by attaching parallel steel rods to both the traveler and the end of a linear actuator and positioning the apparatus over a hot surface, the temperature of which could be controlled. In this embodiment, the position of the hot surface is adjustable such that it could be brought in and out of contact with the steel rods so that precursor fibers strung between the rods can be hot drawn at controlled temperatures and rates.

In a specific embodiment, the draw ratio at failure is determined by affixing the precursor fibers between the rods of the batch hot drawing apparatus and bringing the hot surface in contact with the mounted fibers, the linear actuator was used to increase the distance between the rods (thus drawing the fibers) in steps of 5 mm at a rate of 5 mm/s until all of the fibers were broken. In this embodiment, the number of unbroken fibers remaining after each draw step can be recorded, from which the percent elongation at break distribution is approximated.

Depending on the embodiment and the rate at which fiber is passed over the uniform hot surface (referred to herein as the "reel rate"), the hot surface can vary in length (i.e. the size in cm of the hot surface that the fiber is drawn over), thus changing the duration of time that the undrawn extruded fiber is subject to heat and deformation. In most embodiments, the width of the hot bar will be no less than 1 cm. However, in various embodiments the width of the hot surface can range from 1-50 cm, 1-2 cm, 1-3 cm, 1-5 cm, 5-38 cm, 38-50 cm. Depending on the embodiment, the reel rate can range from 1 to 60 meters a minute.

Depending on the reel rate and the length of the hot surface, the total residence time over the hot surface may vary. In most embodiments, the total residence time can range from 0.2 seconds to 3 seconds.

Figure 2A:
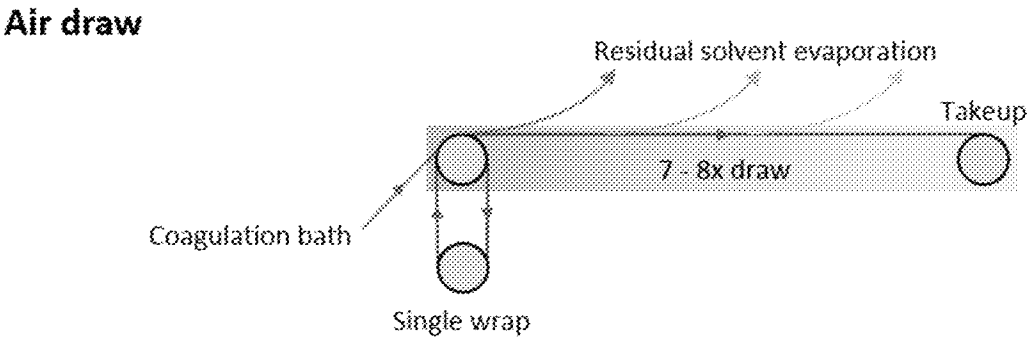
FIG. 2A depicts the drawing process used to generate "Air Draw" fibers according to one embodiment of the present invention.
Figure 2B:
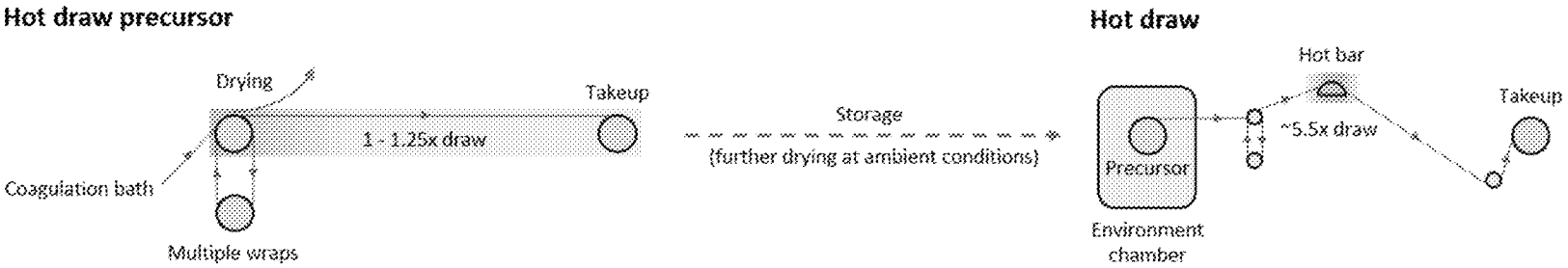
FIG. 2B depicts the drawing process used to generate "Hot Draw" fibers according to one embodiment of the present invention.

In addition, the undrawn fiber may be subject to varying force which provides different draw ratios. In most embodiments, the tensile force will be provided by godets as illustrated in FIGS. 2A and 2B. Depending on the embodiment, the godets will be positioned 40 cm to 300 cm (3 m) apart. In some embodiments, the godets will be placed such that the fiber that is passed over the hot surface is at an angle relative to the hot surface. For example, in instances where the hot surface is curved, the godets may be placed such that the fiber that is passed over the hot surface contact the hot surface and pivots over the hot surface at an angle of 20 to 60 degrees relative to the hot surface (see FIG. 2B).

In various embodiments, the deformation rate (i.e., the amount of deformation that the fiber is subject to with heat and drawing) of the undrawn fiber can vary based on the above factors. Deformation rate may be calculated based on the rate that the undrawn fiber is fed to the hot surface and the rate that the fiber is collected from the hot surface. For example, the fiber may be fed to the hot surface at a rate of 1 meters/minute and collected from the hot surface at a rate of 5 meters/minute. In a specific embodiment, the deformation rate $\dot{\epsilon}(t)$ is calculated using the following equation, where the rate that the fiber is fed to the hot surface is represented $v_1$, the rate that the fiber is collected from the hot surface is $v_2$ and the length the deformation takes place over is $L_0$:

$$\dot{\epsilon}(t) = \frac{v_2 - v_1}{L_0} \qquad \text{Equation 1:}$$

Depending on the embodiment, drawing over a hot surface may be performed in one step or multiple (i.e. two, three, or four) steps. Parameters such as the strain rate, the deformation rate, the reel rate, the temperature of the hot surface and the length of the hot surface may be varied or otherwise different at each step. Performing drawing over multiple steps may affect the overall strain rate of the fiber, which may enhance formation of crystalline beta-sheet structures.

In a specific embodiment, multi-step drawing may be used to achieve an overall draw ratio that is equivalent to the draw ratio at failure. In these embodiments, several drawing steps may be performed. Depending on the embodiment, in some instances, the draw ratio performed at the first drawing step may be larger than that performed at subsequent drawing steps. Depending on the embodiment, the take-up rate may be increased over subsequent drawing steps such that the final take-up rate is 20-40 m/min, 20-50 m/min, 30-60 m/min, or 20-100 m/min.

Fourier Transform Infrared Spectroscopy

Fourier Transform Infrared (FTIR) spectra can be used to assess the secondary and tertiary structures of proteins present in polypeptide powder and/or fibers. Specifically, FTIR spectra can be used to determine the amount of beta-sheets present in the fibers that are subject to different spinning and post-processing conditions. Thus, FTIR spectra may be used to determine the relative amount of beta-sheet structures based on the different techniques. Alternately, the FTIR spectra may be compared to native insect silk.

Depending on the embodiment, FTIR spectra at different wavenumbers may be used to assess the different tertiary structures present in the fibers. In various embodiments, wavenumbers corresponding to Amide I and Amide II bands may be used to assess various protein structures such as turns, beta-sheets, alpha helices, and side chains. Wavenumbers corresponding to these structures are well known in the art.

In most embodiments, FTIR spectra at wavenumbers corresponding to beta-sheets will be used to assess the quantity of beta-sheet structures in the polypeptide powder and/or fiber. In a specific embodiment, FTIR spectra at 982-949 $cm^{-1}$ (CH2 rocking (A)n), 1695-1690 cm-1 (Amide I) 1620-1625 $cm^{-1}$ (Amide I), 1440-1445 $cm^{-1}$ (asymmetric CH3 bending) and/or 1508 $cm^{-1}$ (Amide II) are used to determine the amount of beta-sheets present. Depending on the embodiment, the different wavenumbers and ranges can measured to determine the amount of beta-sheets present. In some embodiments, the FTIR spectra at 982-949 $cm^{-1}$ is used in order to eliminate interference from overlapping peaks. Exemplary methods of obtaining spectra at these wavenumbers are discussed in detail in Boudet-Audet et al, Identification and classification of silks using infrared spectroscopy, Journal of Experimental Biology, 218:3138-3149 (2015), the entirety of which is herein incorporated by reference.

Three Dimensional Crystal Beta-Sheet Formation of Drawn Fibers

X-ray diffraction (XRD) may be used to determine the amount of repetitive crystalline structures in recombinant spider silk polypeptide fibers. As discussed above, in native spider silk, polypeptide sequences comprising beta-sheets aggregate to form a three-dimensional lattice of beta-sheets. This lattice consists of hydrophobic interactions between different polypeptide sequences forming the beta-sheets. As the three-dimensional lattice is a crystalline structure, XRD may be used to determine the presence of crystalline structures in recombinant spider silk polypeptide fibers.

In some embodiments, XRD samples can be prepared by making a bundle of fibers. Depending on the embodiment and the fiber used, the bundle can have from approximately 50-100 individual filaments per bundle. In some embodiments, the fibers are aligned in a bundle such that they were all parallel and affixed to a frame with the fiber bundle axis perpendicular to the X-ray beam.

Depending on the embodiment, the XRD diffraction pattern can be collected using various wavelengths, beam spots, distance to detector center and recorders as is well known in the art of XRD. The diffraction pattern may be collected at multiple points along the fiber over varying durations. Multiple diffraction patterns may be recorded and averaged. In a specific embodiment, XRD diffraction patterns are collected 3 times for 10 seconds each at three different points along the fiber and the three repeats are averaged. Multiple images may also be taken at each point and averaged for better statistics and enhanced signal to noise ratio.

In most embodiments, radial profiles are constructed by integrating the intensity azimuthally over the desired range of azimuthal angles, $\varphi$, and plotting it as a function of the scattering angle, $2\theta$. An integrated scan is obtained by integrating azimuthally over $\varphi=-90$ to $90°$ and plotting that as a function of $2\theta$. The integrated scan contains information regarding the crystallinity. To extract crystallinity values from the integrated scan, the amorphous and crystalline peaks have to be fitted to the intensity profile. Crystallinity can be calculated with the following equation:

$$CI = \frac{\sum A_c}{\sum A_a + \sum A_c}$$

where $A_c$ is the area of crystalline peaks and $A_a$ is the area of amorphous peaks.

Azimuthal profiles are obtained by integrating the intensity radially over a thin ring, and plotting it as a function of the azimuthal angle. The alignment of the fiber can be then obtained by measuring the full-width half maximum (FWHM) of the azimuthal peak fit. The azimuthal profile of the (200) peak was integrated over 2θ=10.5° to 11.5°, and (120) peak was integrated over 2θ=13° to 13.8°. The Hermans orientation factor is defined as:

$$f=(3\langle\cos^2\phi_3\rangle 1)/2$$

where $<\cos^2\varphi>$ is:

$$\langle\cos^2\phi_3\rangle=1-A\langle\cos^2\phi_1\rangle-B\langle\cos^2\phi_2\rangle$$

where axis 1 is (200), axis 2 is (120) and axis 3 is the fiber axis (002). See Grubb, Fiber Morphology of Spider Silk: The Effects of Tensile Deformation, Macromolecules 30(10): 2860-2867 (1997). An orientation factor of f=1 indicates alignment of crystals parallel to the fiber axis, f=−0.5 indicates crystal alignment perpendicular to fiber axis, and f=0 indicates randomly oriented crystals.

Example 1: Purity of Recombinant 18B Polypeptide Powder 18B polypeptide sequences (SEQ ID NO: 1) comprising the FLAG tag were produced through various lots of large-scale fermentation, recovered and dried in powders ("18B powder"). The various lots of 18B powder are indicated in the table below in the column entitled "Source Ref." The 18B powders were subject to various post-processing techniques. The various types of post-processing techniques are indicated below in the column labeled "Reprocess technique". 18B powders that were not post-processed are labeled "as is."

Two lots of 18B powder (labeled "FACU" in the "Reprocess Technique" column) were subject to post-processing by dissolving the recombinant spider silk polypeptide in formic acid and re-precipitating the recombinant 18B polypeptide powder using isopropyl alcohol. One lot of 18B Powder was subject to re-processing and precipitation using guanidine thiocyanate according to a first protocol (labeled "Gdn Reprocessed" in the "Reprocess Technique" column). One lot of 18B powder was subject to re-processing and precipitation using Guanidine thiocyanate according to a second protocol (labeled "Snow White" in the "Reprocess Technique" column). As discussed above, various other proteins from the same lots were left unprocessed as controls.

Data characterizing the relative amounts of high, low and intermediate molecular weight impurities, monomeric 18B and aggregate 18B in the 18B powder was collected using Size Exclusion Chromatography (SEC) as follows: 18B powder was dissolved in 5M Guanidine Thiocyanate and injected onto a Yarra SEC-3000 SEC-HPLC column to separate constituents on the basis of molecular weight. Refractive index was used as the detection modality. 18B aggregates, 18B monomer, low molecular weight (1-8 kDa) impurities, intermediate molecular weight impurities (8-50 kDa) and high molecular weight impurities (110-150 kDa) were quantified. The relevant composition was reported as mass % and area %. BSA was used as a general protein standard with the assumption that >90% of all proteins demonstrate do/dc values (the response factor of refractive index) within ~7% of each other. Poly(ethylene oxide) was used as a retention time standard, and a BSA calibrator was used as a check standard to ensure consistent performance of the method.

Table 2 (below) lists the area % of the different components quantified using SEC and the mass % of 18B in its aggregate and monomeric forms. As shown in the same table, the 1589 Snow White powder, 1851 Snow White powder and the 128-Gdn reprocessed powder showed the highest purity. 1589 and 1851 Snow White powder produced comparable purity levels. While one of the FACU processed powder showed better purity than the as-is powders, the other was roughly equivalent to the as-is powder. Different sources for the as-is powders yielded different purity levels, with 1707 as-is having the highest purity.

TABLE 2

Size Exclusion Chromatography

| Source Ref | Reprocess technique | High MW Impurity [area %] | Aggregate [area %] | 18B [area %] | IMW Impurity [area %] | LMW Impurity [area %] | Aggregate + 18B [area %] |
|---|---|---|---|---|---|---|---|
| 125 | as-is | 4.16 | 6.60 | 49.80 | 31.43 | 8.02 | 56.40 |
| 126 | as-is | 2.56 | 5.71 | 52.61 | 29.47 | 9.66 | 58.32 |
| 134 | as-is | 2.65 | 5.12 | 52.08 | 34.41 | 5.74 | 58.12 |
| 125 | FACU | 1.71 | 9.02 | 50.27 | 33.14 | 5.86 | 59.28 |
| 126 | FACU | 1.35 | 6.32 | 70.94 | 18.75 | 2.63 | 77.26 |
| 1707 | as-is | 1.6 | 5.2 | 71.6 | 16.3 | 5.4 | 73.77 |
| 128 | Gdn reprocessed | 3.3 | 15.0 | 55.1 | 23.1 | 3.5 | 78.02 |
| 1589 | Snow White | 1.07 | 9.30 | 71.86 | 14.73 | 3.04 | 89.41 |
| 1851 | Snow White | 1.26 | 8.75 | 67.07 | 15.65 | 7.34 | 88.11 |

Example 2: FTIR Data from Recombinant 18B Protein Powder

For each of the above-described samples, FTIR data collection was performed using a Bruker Alpha spectrometer equipped with a diamond-attenuated total reflection accessory. Spectra of were collected with 32 scans at 4 $cm^{-1}$ resolution from 4000 to 600 $cm^{-1}$ by pressing ~10 mg of powder against the internal reflection crystal using an anvil. Absorbance values offset by subtracting the average between 1900 and 1800 $cm^{-1}$ without bands. Spectra were then normalized by dividing the average between 1350 and 1315 $cm^{-1}$ corresponding to the isotropic side chain vibration bands before calculating the average absorbance of the spectral region of interest. For Aliphatic [2996-2822 $cm^{-1}$] a linear baseline was subtracted between the boundaries to remove the contribution of the neighboring amide A band while no baseline was subtracted from the C—O [1100-1000 $cm^{-1}$] and ß-sheet [982-949 $cm^{-1}$] regions.

Table 3 below lists the integrated peak area for different peaks. The aliphatic 2996-2822 $cm^{-1}$ peak represents the absorption to the CH2 and CH3 stretching mode from hydrocarbon chains. The C—O peak at 1100-1000 $cm^{-1}$ represents esters and hydroxyl groups from proteins and polysaccharides. The 982-949 $cm^{-1}$ absorbance constitutes is assigned to the CH3 rocking mode of the (A)n within ß-sheets. For a detailed discussion of the different peak, see Moore, W. H. and S. Krimm, Vibrational Analysis of Peptides, Polypeptides, and Proteins 0.2. Beta-Poly(L-Alanine) and Beta-Poly(L-Alanine glycine), Biopolymers 15(12): 2465-2483 (1976).

As discussed above, the ß-sheets in the powder are not aligned and therefore the samples do not represent ß-sheet formation in the spun fiber.

TABLE 3

FTIR Peak Areas for 18B Powder Samples with standard deviations

| Source Ref | Reprocess type | Aliphatic [2996-2822 $cm^{-1}$] | C—O [1100-1000 $cm^{-1}$] | β-sheet [982-949 $cm^{-1}$] |
|---|---|---|---|---|
| 125 | as-is | 0.070 ± 0.001 | 1.30 ± 0.03 | 0.734 ± 0.001 |
| 126 | as-is | 0.074 ± 0.001 | 1.08 ± 0.01 | 0.687 ± 0.001 |
| 134 | as-is | 0.044 ± 0.002 | 0.78 ± 0.01 | 0.56 ± 0.02 |
| 125 | FACU | 0.052 ± 0.002 | 1.01 ± 0.03 | 0.72 ± 0.02 |
| 126 | FACU | 0.048 ± 0.001 | 0.971 ± 0.002 | 0.700 ± 0.006 |
| 1707 | as-is | 0.058 ± 0.007 | 0.658 ± 0.006 | 0.44 ± 0.01 |
| 128 | Gdn reprocessed | 0.73 ± 0.003 | 1.20 ± 0.01 | 0.70 ± 0.03 |
| 1589 | Snow White | 0.041 ± 0.02 | 0.71 ± 0.01 | 0.54 ± 0.02 |

Example 3: Glass Transition Temperature of the Recombinant 18B Protein Powder Modulated Differential Scanning calorimetry (MDSC) was used to determine the glass transition temperature of the different samples. A DSC, TA Instruments Q2000 was used to generate thermograms. Prior to the measurement, the instrument was calibrated using indium and sapphire to verify heat flow and heat capacity respectively, followed by an empty pan to verify the baseline. 5-10 mg of sample was pressed into a non-hermetically sealed aluminum pan and placed in the DSC cell along with an empty reference pan. The cell was purged with nitrogen at 20 ml/min for the duration of the experiment. Protein powder was heated at 125° C. for 1 hour to remove excess water, followed by a modulated ramp (3° C./min+/−0.6° C., 1 minute period) from −20° C. to 220° C. The Tg (glass transition temperature) was then determined from the reversing heat capacity thermogram by finding the point on the curve halfway between the tangents extrapolated from the onset and offset of the transition.

The glass transition temperatures are tabulated below.

TABLE 4

Glass Transition Temperatures of 18B Powder Samples

| Source Ref | Reprocess type | Tg [° C.] |
|---|---|---|
| 125 | as-is | 182.01 |
| 126 | as-is | 180.40 |
| 134 | as-is | 180.70 |
| 125 | FACU | 152.93 |
| 126 | FACU | 163.14 |
| 1707 | as-is | 177.08 |
| 128 | Cinderella | 177.75 |
| 1589 | Snow White | 176.18 |

Example 4: Spin Dope Preparation and Rheology of the Spin Dopes

The above-discussed samples of 18B powder were dissolved in formic acid and mixed using a Thinky Planetary Centrifugal Mixer 400ARE-TWIN at 1600 RPM to generate spin dopes. Prior to dissolution, the 18B powder was baked to reduce the moisture content of the powder down to less than 4% by weight.

A Malvern Kinexus Lab+ Rotational Rheometer was used to measure the complex viscosity and the phase angle of the spin dopes. Parameters were set to a temperature of 22° C., a frequency of 100-0.1 Hz, and a strain of 1%. An interval of 3 points/decade was used to determine an average value for a given frequency.

Table 5 below includes the concentration by weight of the 18B powder in the spin dope, the complex viscosity and the phase angle as measured at 10 Hz. Data was not collected for 125-FACU.

TABLE 5

18B Powder Concentration in Spin Dope, Complex Viscosity and Phase Angle

| Source ID | Process type | 18B Powder Concentration by weight [%] | Complex Viscosity [Pa s] | Phase Angle [°] |
|---|---|---|---|---|
| 125 | as-is | 35 | 36.1 | 59.91 |
| 126 | as-is | 35 | 63.45 | 55.93 |
| 134 | as-is | 36 | 64.65 | 63.28 |
| 126 | FACU | 38.5 | 37.12 | 78.70 |
| 1707 | as-is | 36 | 58.75 | 72.19 |
| 128 | Cinderella | 34.5 | 57.8 | 69.84 |
| 1589 | Snow White | 35.4 | 42.56 | 82.34 |
| 1851 | Snow White | 36 | 42.42 | 79.09 |

Example 5: Hot Draw and Air Draw

FIG. 2A illustrates the method used to wet spin and process the control ("Air Draw") fibers. The spin dopes comprising the different 18B samples at the above concentrations by weight were extruded using a 125 μm spinneret at into room temperature (approximately 22° C.) coagulation baths as listed below. The coagulation baths were also maintained at room temperature (approximately 22° C.). The Air Draw fibers were then subject to a single wrap on a set of godets under minimal draw (i.e. a draw ratio of ~1×), the still-wet fibers were then drawn between two godets spaced at a distance of 2.1 m to a draw ratio of 7-8× at room temperature at a relative humidity of approximately 55-65%. The reel rate was 15-23 m/min. The Air Draw fiber was then wound on a take-up godet.

FIG. 2B illustrates the method used to wet spin and process fiber that were subject to rapid deformation over a uniform hot surface ("Hot Draw"). Spin dopes comprising the different 18B samples were extruded using a 125 μm spinneret at room temperature (approximately 22° C.) into coagulation baths as listed below. The coagulation baths were also maintained at room temperature (approximately 22° C.). The Air Draw fibers were then subject to a single wrap on godets no drawn and then passed to a take-up godet under minimal draw (i.e. a ~1× draw). The still-wet fibers were then allowed to dry over a period of at least 12 hours. The dried fiber was then passed over a hot surface between two godets spaced at a distance of 60 cm at a draw ratio of approximately 5.5× at a relative humidity of approximately 55-65%. The hot surface was a steel bar with a "D" shaped curved profile heated to 200° C. The total length of the hot surface the fibers traveled over was 1 cm. The fiber approaching and leaving the hot surface was at an angle of 10-30 degrees relative to the hot surface. The feed reel rate used was approximately 1 m/min and the take-up reel rate was approximately 5.5 m/min. Total residence time over the hot surface was 0.6 seconds.

The Air Draw and Hot Draw fibers were tested to determine their tenacity and initial modulus. Testing was performed using a TexTechno Favimat+ single fiber tester with optional Robot 2 feed system. Single fibers were tested at 65% relative humidity according to ASTM Standard D1776 to measure tenacity and initial modulus.

Figure 3A:
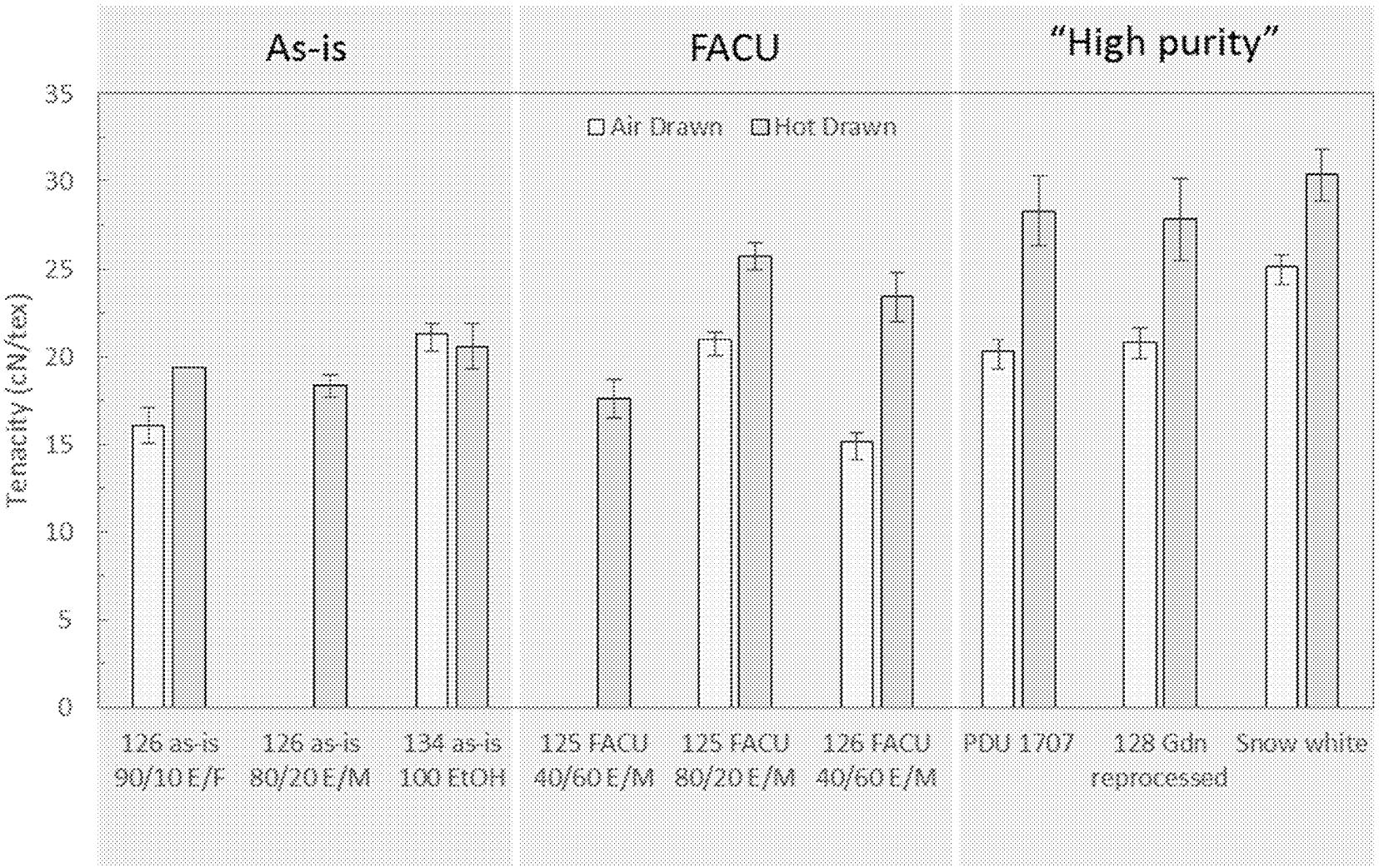
FIG. 3A depicts the tenacity of Air Draw and Hot Draw fibers according to some embodiments.
Figure 3B:
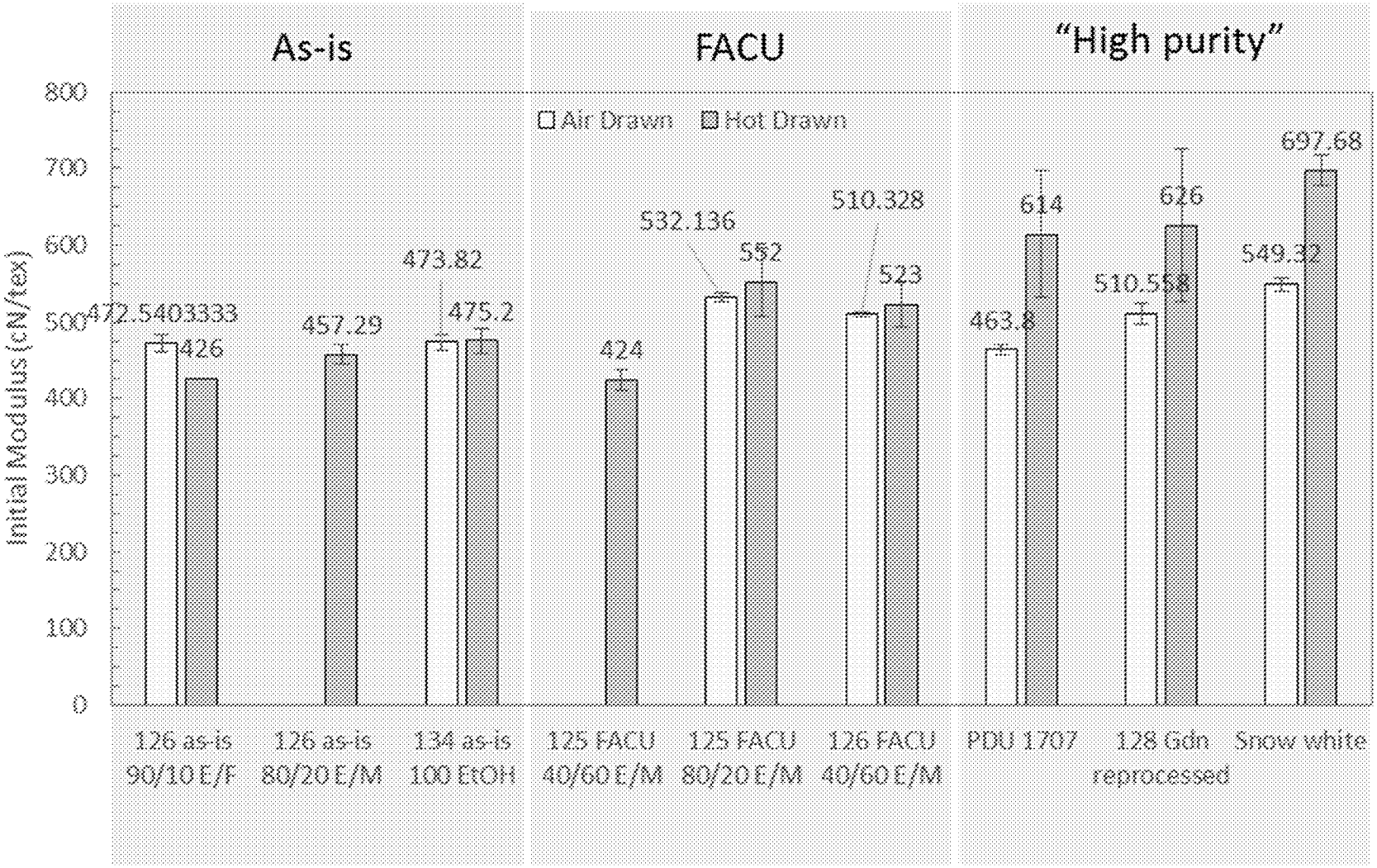
FIG. 3B depicts the initial modulus of Air Draw and Hot Draw fibers according to some embodiments.

Table 6 below lists the tenacity and initial modulus of Air Draw and Hot Draw fibers. Also tabulated is the percentage content by volume of formic acid, methanol and ethanol in the coagulation bath used. FIGS. 3A and 3B are bar graphs respectively illustrating the tenacity and initial modulus of the Air Draw and Hot Draw Fibers. As shown in the table and FIGS. 3A and 3B there was a significant difference observed in the tenacity.

TABLE 6

Tenacity and initial modulus of Air Draw and Hot Draw fibers

| Source Ref | Process type | Formic acid coag bath content [vol %] | Ethanol coag bath content [vol %]2 | Methanol coag bath content [vol %] | Air Draw Tenacity (cN/tex) | Hot Draw Tenacity (cN/tex) | Air Draw Initial Modulus (cN/tex) | Hot Draw Initial Modulus (cN/tex) |
|---|---|---|---|---|---|---|---|---|
| 126 | as-is | 10 | 90 | 0 | 16.07 | 19.4 | 472.54 | 426 |
| 126 | as-is | 0 | 80 | 20 | | 18.32 | | 457.29 |
| 134 | as-is | 0 | 100 | 0 | 21.34 | 20.57 | 473.82 | 475.2 |
| 125 | FACU | 0 | 40 | 60 | | 17.61 | | 424 |
| 125 | FACU | 0 | 80 | 20 | 21.01 | 25.73 | 532.14 | 552 |
| 126 | FACU | 0 | 40 | 60 | 15.14 | 23.4 | 510 | 523 |
| 1707 | as-is | 0 | 40 | 60 | 20.38 | 28.3 | 463.3 | 614 |
| 128 | Cinderella | 0 | 40 | 60 | 20.84 | 27.8 | 510 | 626 |
| 1851 | Snow White | 0 | 40 | 60 | 25.1 | 30.36 | 549.32 | 697.98 |

Example 6: Measuring ß-Sheet Content Using FTIR

FTIR was performed on various Hot Draw fibers that were drawn at different draw ratios. Specifically, fibers generated using a formic acid dope comprising the 144 As-is powder described above at a concentration of 36% by weight. Dope was extruded through a 125 μm spinneret into a coagulation bath comprising 90% ethanol, 3.5-5.5% methanol and 4-6% isopropanol to form precursor fibers. The coagulation bath and spinneret were maintained at room temperature (approximately 22° C.). Precursor fibers were subject to minimal draw (i.e. a draw ratio of ~1×) as they were passed through the coagulation bath and wound on a take-up godet. The precursor fibers were dried overnight prior to hot drawing.

The various fibers were subject to different draw ratios (1×, 1.25×, 2.5×, 3.75×, 4.5×, 4.95×) while being drawn over the hot surface to determine the effect, if any, on beta-sheet formation. The hot surface was a steel bar with a "D" shaped curved profile heated to 200° C. The total length of the hot surface the fibers travelled over was 1 cm. The fiber approaching and leaving the hot surface was at an angle of 10-30 degrees relative to the hot surface. Godets used to draw the fibers were spaced 60 cm apart. The feed reel rate used was 1 m/min and the take-up reel rates were 1, 1.25, 2.5, 3.75, 4.5 and 4.95 m/min corresponding to the above-discussed draw ratios.

FTIR was performed on the hot drawn fibers using a Bruker Alpha spectrometer equipped with a diamond attenuated total reflection accessory preceded by a wire grid polarizer selecting mostly S (perpendicular) polarized light. Recombinant polypeptide powder and the precursor fiber were included as controls. To quantify the molecular alignment three spectra of each orientation (0 and 90° relative to the polarization electric field) were collected with 32 scans at 4 $cm^{-1}$ resolution from 4000 to 600 $cm^{-1}$.

The average values for the peak corresponding to 982-949 $cm^{-1}$ were calculated based on the following steps. Absorbance values offset subtracting the average between 1900 and 1800 $cm^{-1}$ without bands. Spectra were then normalized by dividing the average between 1350 and 1315 $cm^{-1}$ corresponding to the isotropic (non-oriented) side chain vibration bands. The ß-sheet band was integrated by averaging the absorbance values between 982 and 949 $cm^{-1}$. The Dichroic ratio ("R") was by dividing integrated values collected at 0° by the corresponding spectra at 90°. The second order parameter <P2> alignment metric was then calculated from using <P2>=(R−1/R+2). A value of 1 indicates a perfectly oriented vibration mode along the fiber axis while −0.5 represents a vibration mode perfectly orientated perpendicular. In contrast, non-oriented modes will produce <P2> near 0. To measure the crystallinity independent of the orientation, we calculated the isotropic absorbance spectra $A_{iso}$=(A0°±2*A90°)/3 before integrating the bands. This also enables the ß-sheet content comparison between samples with varying alignment levels.

TABLE 7

β-sheet Content of Hot Draw and Control Fibers and Powders

| Source Ref | Process type | Powder or Fiber | Hot Draw or Precursor | Draw Ratio | <P2> β-sheet β 982-949 cm−1 | $A_{iso}$ β-sheet β 982-949 cm−1 |
|---|---|---|---|---|---|---|
| 1589 | Snow White | Powder | N/A | 1.00 | 0 | 0.054 ± 0.02 |
| 144 | As-is | Fiber | Precursor | 1.00 | 0.012 ± 0.013 | 0.611 ± 0.011 |
| 144 | As-is | Fiber | Hot Draw | 1.00 | 0.040 ± 0.004 | 0.658 ± 0.011 |
| 144 | As-is | Fiber | Hot Draw | 1.25 | 0.022 ± 0.004 | 0.648 ± 0.002 |
| 144 | As-is | Fiber | Hot Draw | 2.50 | 0.032 ± 0.003 | 0.685 ± 0.004 |
| 144 | As-is | Fiber | Hot Draw | 3.75 | 0.041 ± 0.006 | 0.683 ± 0.009 |
| 144 | As-is | Fiber | Hot Draw | 4.50 | 0.073 ± 0.016 | 0.071 ± 0.027 |
| 144 | As-is | Fiber | Hot Draw | 4.95 | 0.063 ± 0.010 | 0.675 ± 0.009 |
| Tussah | Control | Fiber | Native | NA | 0.27 ± 0.02 | 0.330 ± 0.001 |

Figure 4:
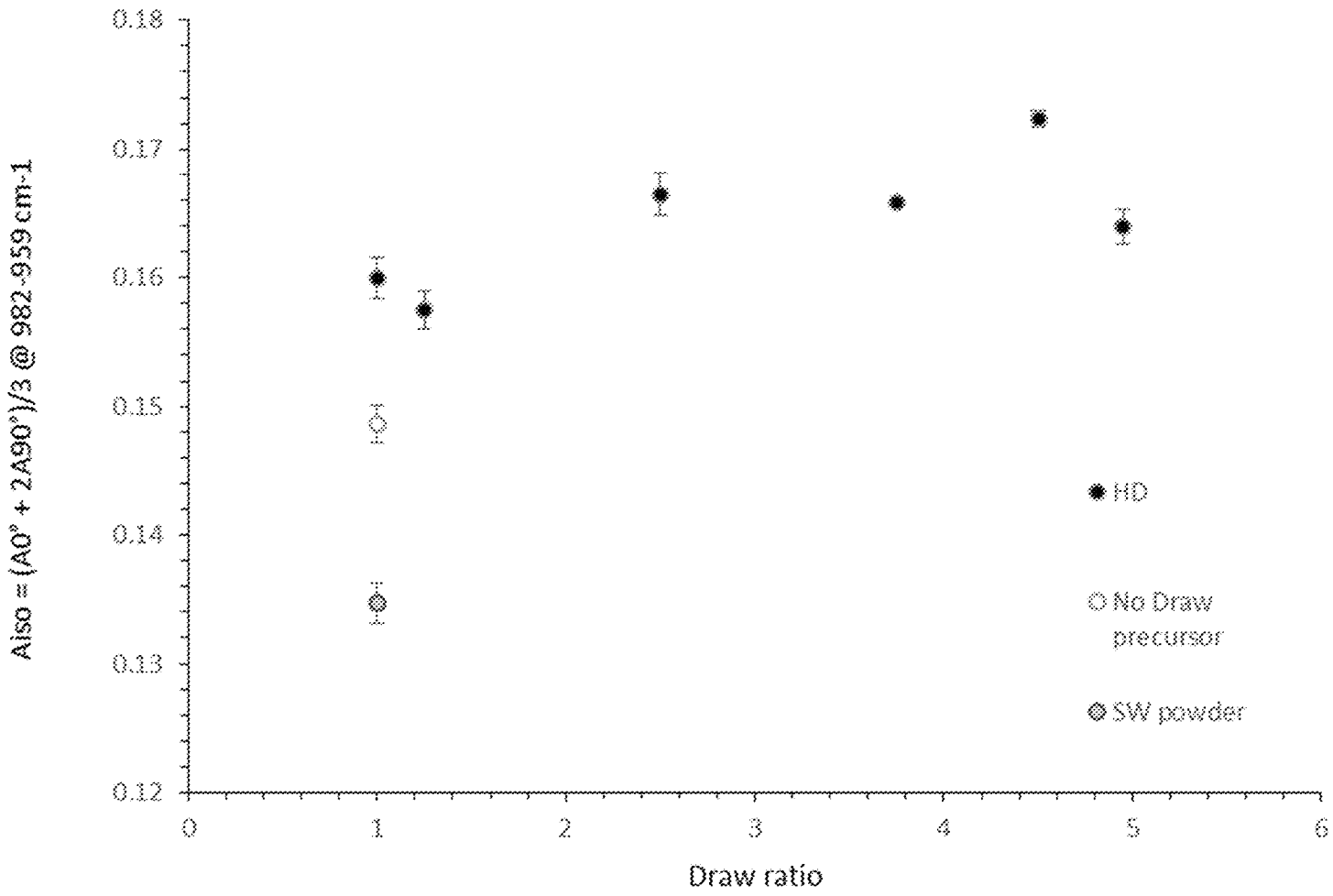
FIG. 4 depicts FTIR analysis corresponding to beta-sheet formation in Hot Draw fibers, precursor fibers and recombinant silk polypeptide powder according to some embodiments.

FIG. 4 illustrates the results observed using this process. There was a marked increase in the $A_{iso}$ and P2 values in the Hot Draw fibers as compared to the undrawn fiber. The increase roughly corresponded to the draw ratio. Thus, the Hot Draw fibers exhibited increased beta-sheet formation relative to the precursor fiber and beta-sheet formation corresponded to the draw ratio applied while passing the precursor fiber over the hot surface.

Example 7: Glass Transition Temperature of the Hot Draw and Precursor Fibers

Modulated Differential Scanning calorimetry (MDSC) was used to determine the glass transition temperature of fiber formed from a subset of the samples discussed above with respect to Example 6 and below with respect to Example 8. A DSC, TA Instruments Q2000 was used to generate thermograms. Prior to the measurement, the instrument was calibrated using indium and sapphire to verify heat flow and heat capacity respectively, followed by an empty pan to verify the baseline. 5-10 mg of sample was pressed into a non-hermetically sealed aluminum pan and placed in the DSC cell along with an empty reference pan. The cell was purged with nitrogen at 20 ml/min for the duration of the experiment. The sample was heated at 125° C. for 1 hour to remove excess water, followed by a modulated ramp (3° C./min+/−0.6° C., 1 minute period) from −20° C. to 220° C. The Tg (glass transition temperature) was then determined from the reversing heat capacity thermogram by finding the point on the curve halfway between the tangents extrapolated from the onset and offset of the transition.

The glass transition temperatures are tabulated below:

TABLE 8

Glass Transition Temperatures of 18B Fiber Samples

| Source Ref | Reprocess Type | Fiber or Powder | Precursor or Hot Draw | Draw Ratio | Glass transition temperature by DSC (deg C.) |
|---|---|---|---|---|---|
| 144 | As-is | Fiber | Precursor | None (~1X) | 169.43 |
| 144 | As-is | Fiber | Hot Draw | 4.95x | 173.93 |
| 1851 | Snow white | Fiber | Hot Draw | 6X | 171.05 |

Example 8: Measuring Crystallinity Using X-Ray Diffraction (XRD)

X-ray diffraction was performed on fibers generated using a formic acid dope comprising the 1851 Snow White powder described above at a concentration of 36% by weight. Dope was extruded through a 125 μm spinneret into a coagulation bath comprising 40% ethanol and 60% methanol to form precursor fibers. The coagulation bath and spinneret were maintained at room temperature (approximately 22° C.).

As a control, Air Draw fibers were subject to a single wrap on a set of godets under minimal draw (i.e. a draw ratio of ~1×), the still-wet fibers were then drawn between two godets spaced at a distance of 2.1 m to a draw ratio of 7-8× at room temperature at a relative humidity of approximately 55-65%. The take-up reel rate was approximately 15-23 m/min. The Air Draw fiber was then wound on a take-up godet.

For the Hot Draw fibers, precursor fibers were subject to minimal draw (i.e. a draw ratio of ~1×) as they were passed through the coagulation bath and wound on a take-up godet. The precursor fibers were dried for several weeks before hot drawing. The hot drawn fiber was drawn in three stages. At each stage, the hot drawn fiber was subjected to a different draw ratio. At the first stage, the draw ratio was 1.69×. At the second stage, the draw ratio was 1.91×. At the third stage, the draw ratio was 1.85×. The combined draw ratio from the three stages was 6×. During each stage, the hot surface used was a steel bar with a "D" shaped curved profile heated to 200° C. The total length of the hot surface the fibers traveled over was 1 cm. The fiber pivots at an angle of 20 to 60 degrees over the hot surface (see FIG. 2B). Godets used to draw the fibers were spaced 60 cm apart. The feed reel rate was 1 m/min and the take-up reel rates were 1.69, 1.91 and 1.85 corresponding to the above-discussed draw ratios.

Precursor, Air Draw and Hot Draw fibers were analyzed using X-ray diffraction. The XRD samples were prepared by making a bundle of fibers with approximately 100 individual filaments per bundle. The fibers were aligned in a bundle such that they were all parallel and affixed to a frame with the fiber bundle axis perpendicular to the X-ray beam. The XRD was carried out at the Stanford Synchrotron Radiation Lightsource beamline 4-2. The wavelength of the X-ray beam was 1.033 Å, with a beam spot size of 100×100 μm and a distance to detector center of 327.5 mm. The pattern was recorded using a Rayonix MX225HE detector. The sample to detector distance was 327.5 mm. The diffraction pattern was collected 3 times for 10 seconds each at three different points along the fiber. The three repeats were averaged. Multiple images were taken at each point and averaged for better statistics and enhanced signal to noise ratio.

Radial profiles were constructed by integrating the intensity azimuthally over the desired range of azimuthal angles, φ, and plotting it as a function of the scattering angle, 2θ. An integrated scan is obtained by integrating azimuthally over φ=−90 to 90° and plotting that as a function of 2θ. The integrated scan contains information regarding the crystallinity. To extract crystallinity values from the integrated scan, the amorphous and crystalline peaks have to be fitted to the intensity profile. Crystallinity can be calculated with the following equation:

$$CI = \frac{\sum A_c}{\sum A_a + \sum A_c}$$

where $A_c$ is the area of crystalline peaks and $A_a$ is the area of amorphous peaks. For consistency in peak fitting, a radial profile at φ=−66 to −60° was plotted and used to fit the amorphous profile. The amorphous halo in X-ray diffraction patterns is typically isotropic. As this slice did not contain crystalline peaks, the amorphous peak was fitted. The parameters for the amorphous fit were then used for fitting the integrated scan and the remaining peaks were fitted. Azimuthal profiles are obtained by integrating the intensity radially over a thin ring and plotting it as a function of the azimuthal angle. The alignment of the fiber can be then obtained by measuring the full-width half maximum (FWHM) of the azimuthal peak fit. The azimuthal profile of the (200) peak was integrated over 2θ=10.5° to 11.5°, and (120) peak was integrated over 2θ=13° to 13.8°. The Hermans orientation factor is defined as:

$$f=(3\langle\cos^2\phi_3\rangle-1)/2$$

where $<\cos^2\varphi>$ is:

$$\langle\cos^2\phi_3\langle=1-A\rangle\cos^2\phi_1\rangle-B\langle\cos^2\phi_2\rangle$$

where axis 1 is (200), axis 2 is (120) and axis 3 is the fiber axis (002). See Grubb, Fiber Morphology of Spider Silk: The Effects of Tensile Deformation, Macromolecules 30(10): 2860-2867 (1997). An orientation factor of f=1 indicates alignment of crystals parallel to the fiber axis, f=−0.5 indicates crystal alignment perpendicular to the fiber axis, and f=0 indicates randomly oriented crystals.

Figure 5:
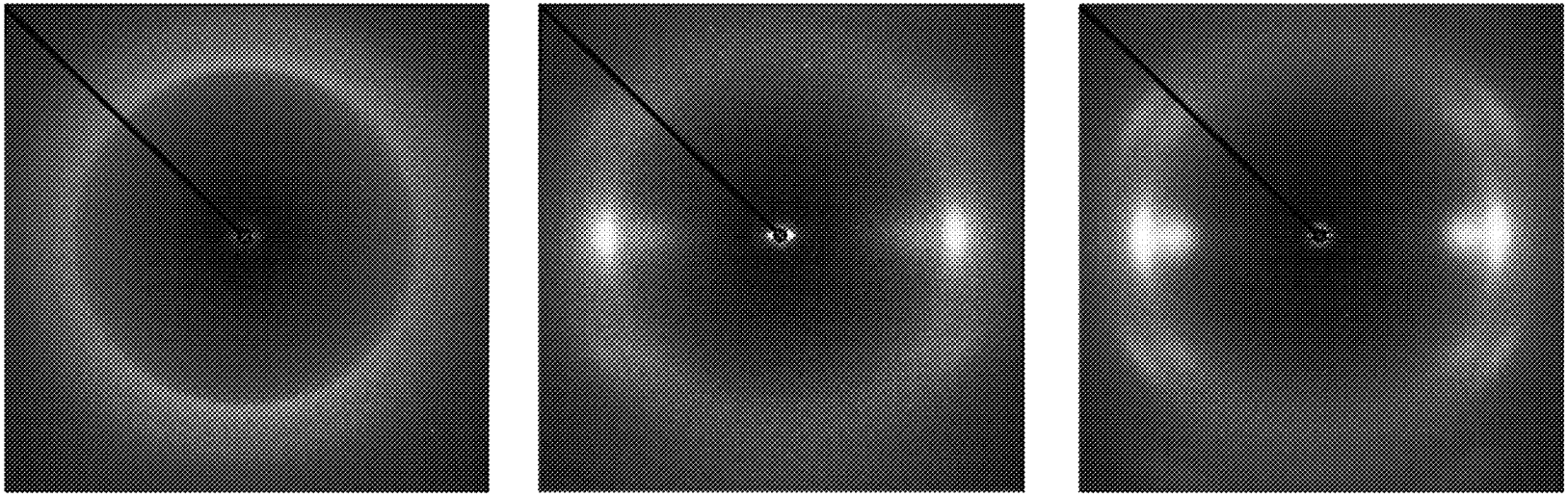
FIG. 5 depicts the 2D X-ray diffraction patterns of the Precursor, Air Drawn and Hot drawn fibers according to a specific embodiment.
Figure 6A:
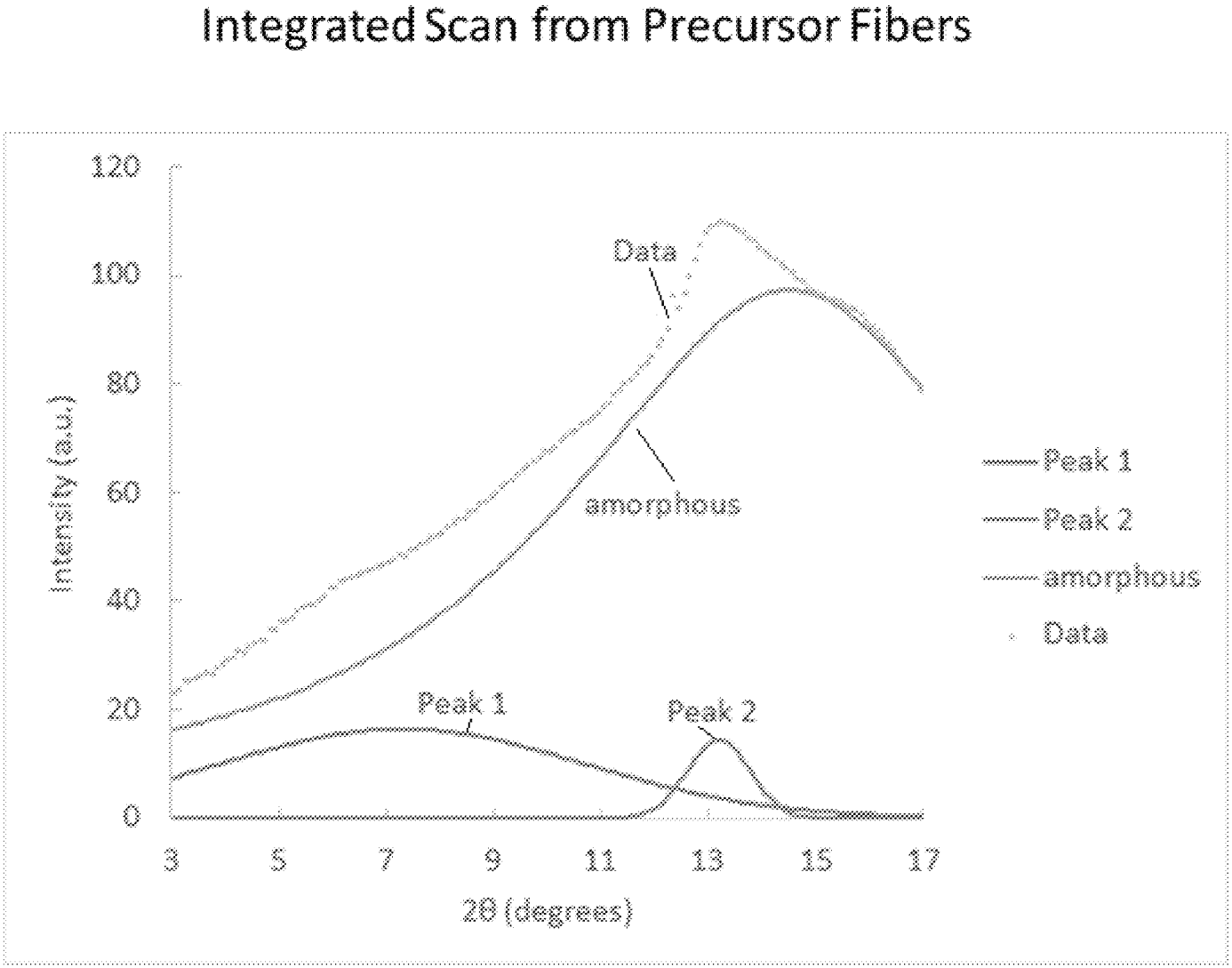
FIG. 6A depicts the integrated scan from precursor fibers according to a specific embodiment.
Figure 6B:
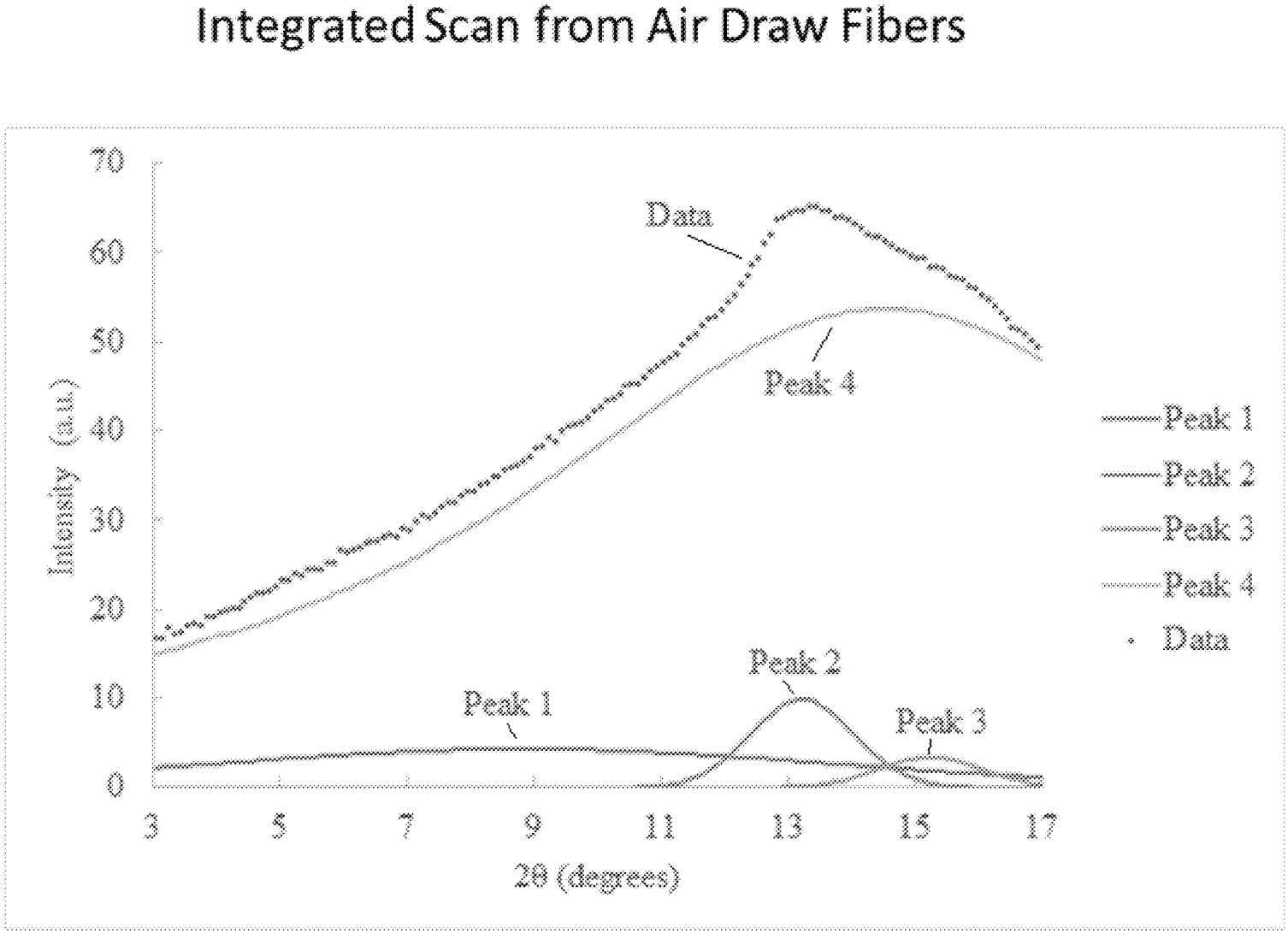
FIG. 6B depicts the integrated scan from Air Draw fibers according to a specific embodiment.
Figure 6C:
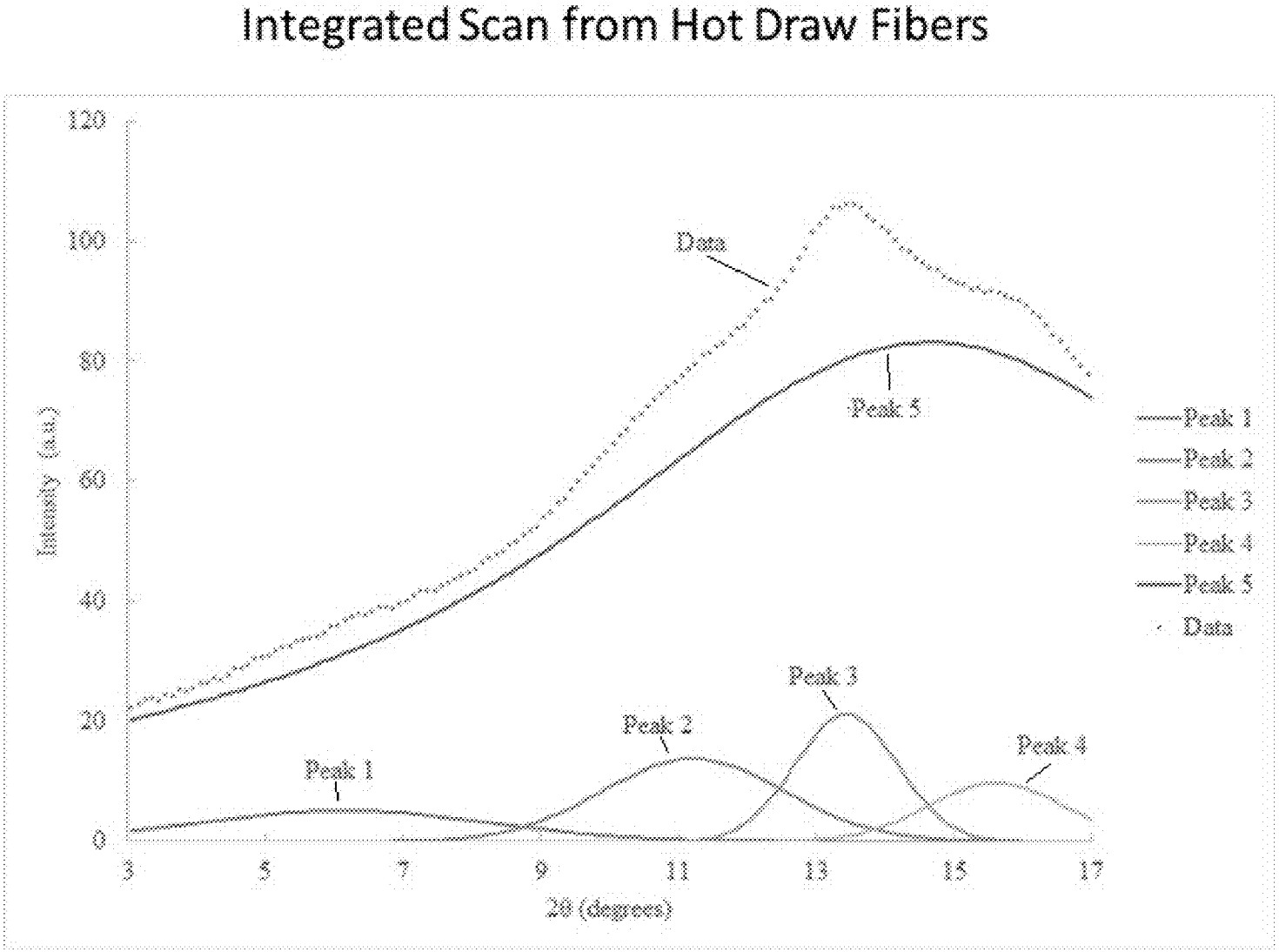
FIG. 6C depicts the integrated scan from Hot Draw fibers according to a specific embodiment.

The 2D diffraction patterns of the Precursor, Air Drawn and Hot drawn fibers are shown in FIG. 5. The integrated scans were generated from the 2D diffraction patterns and fitted with at most 5 peaks. The crystalline peaks at ~11.2°, ~13.3° and ~15.6 correspond to the (200), (120) and (211) reflections of the β-sheets structure. The broad wide peak with the largest area under the curve at ~14.5° corresponds to the amorphous structure and the peak at ~7° is likely due to the crystal to crystal distance. FIGS. 6A, 6B and 6C depict the integrated scans from the precursor fibers, air draw fibers, and hot draw fibers, respectively fitted with the peaks described above. FIG. 6A depicts the integrated scan from precursor fibers. Peak 2 in FIG. 6A corresponds to the crystalline (120) reflection. FIG. 6B depicts the integrated scan from Air Draw fibers. Peaks 2 and 3 in FIG. 6B correspond to (120) and (211) reflections, respectively. FIG. 6C depicts the integrated scan from Hot Draw fibers. Peaks 3, 4 and 5 in FIG. 6C correspond to (200), (120), and (211) reflections, respectively.

Using the area under the curve of each peak, the crystallinity was calculated and tabulated in Table 9. The precursor fiber had the lowest crystallinity of 1.5%. The air drawn fiber had a crystallinity of 2.8%, while the hot drawn fiber had the highest crystallinity of 7.5%. This indicates that the structure resulting from hot draw process has more than 2.5 times higher β-sheets compared to the fibers from the air draw process. In addition, the diffraction pattern of the air drawn fibers lack the (200) peak, while the (200) peak is clearly visible in the hot drawn fibers. This suggests that the hot drawn fibers have formed 3D β-sheets, while the air drawn fibers have mainly formed a 2D structure and lack the interlocking of protein side chains.

Figure 7A:
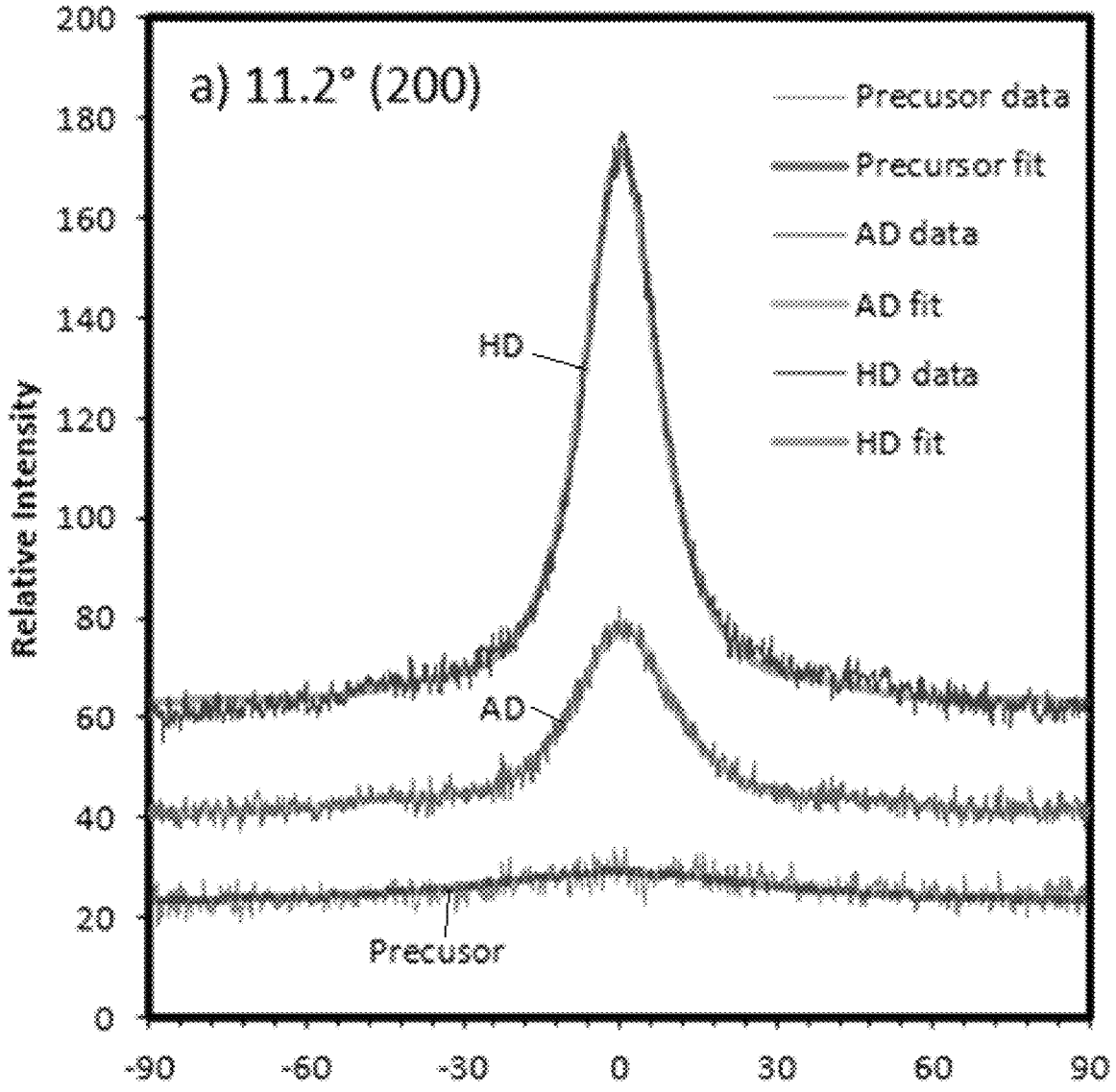
FIG. 7A depicts azimuthal profiles of the fibers according to a specific embodiment.
Figure 7B:
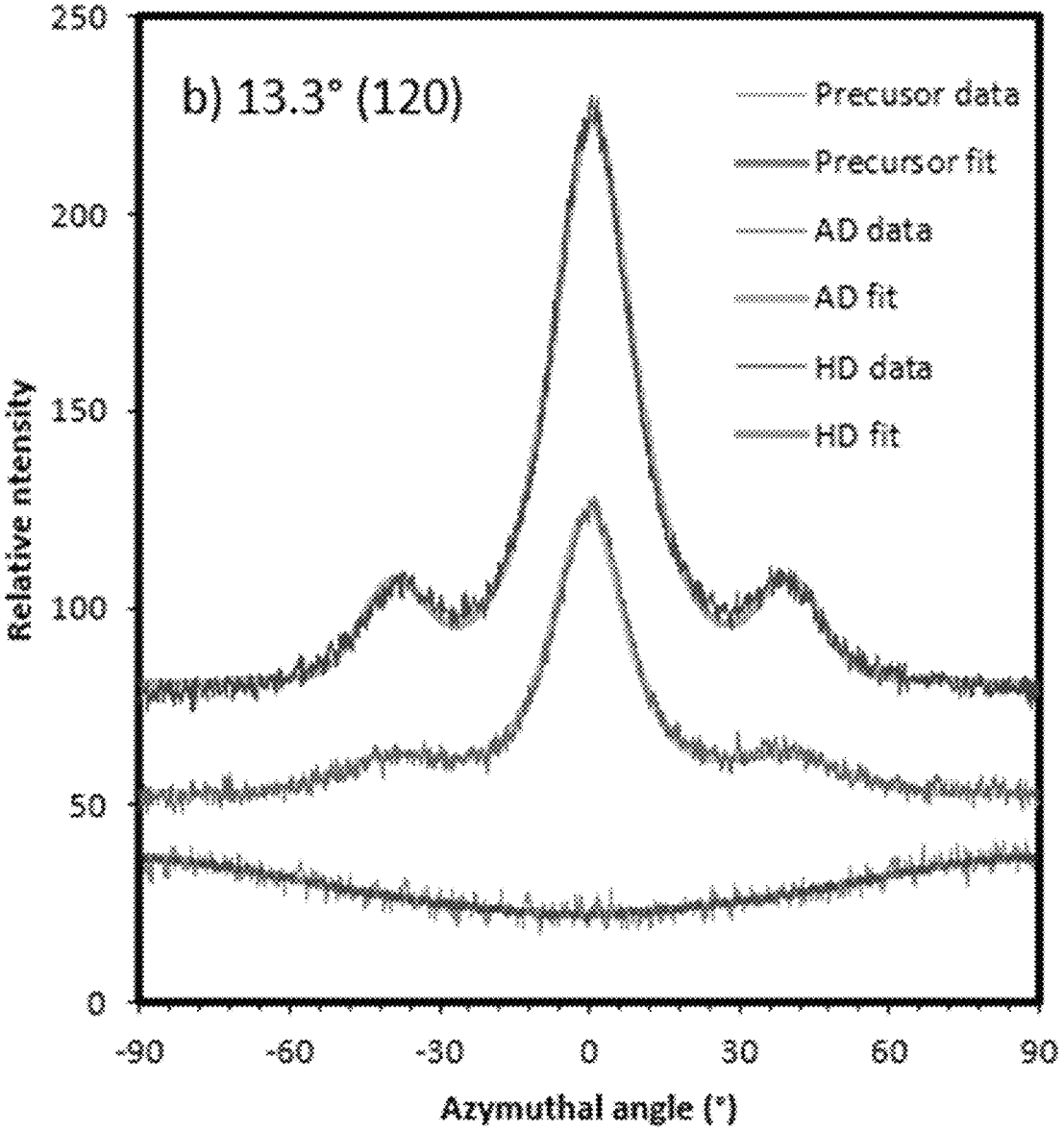
FIG. 7B depicts azimuthal profiles of the fibers according to a specific embodiment.

The azimuthal profiles of the fibers with are shown in FIGS. 7A and 7B, respectively. In addition to the precursor, Hot Draw and Air Draw fibers, Native Tussah silk (*A. pernyi*) was used analyzed as a reference sample. The main (200) and (120) peaks are fitted with an azimuthal fit with a Pearson VII peak and (211)/(201) subsidiary peaks fitted with a Gaussian peak as described in Grubb, Macromolecules 30(10): 2860-2867 (1997). The Full Width at Half Maximum (FWHM) of the crystalline peaks was calculated and tabulated in Table 9. The FWHM of the precursor fiber is large compared to the drawn fibers. The Herman orientation factors of the various fibers were also calculated and included in Table 9. The Herman orientation factor of the hot drawn fiber is slightly higher than that of the air drawn fiber. The (120) peak in this sample is meridional, while all other (200) and (120) peaks are equatorial.

TABLE 9

Structural parameters of Snow White fibers

| Source | Process type | Fiber or Powder | Hot Draw or Precursor | Draw Ratio | Crystallinity Index (%) | FWHM at 11° | FWHM at 13.3° | Herman Orientation Factor |
|---|---|---|---|---|---|---|---|---|
| 1851 | Snow white | Fiber | Precursor | None | 1.54 ± 0.05 | 74 ± 16 | 78 ± 16* | NA |
| 1851 | Snow white | Fiber | Air Drawn | 7X | 2.84 ± 0.02 | 22.7 ± 0.1 | 18.0 ± 0.3 | 0.89 ± 0.01 |
| 1851 | Snow white | Fiber | Hot Draw | 6X | 7.49 ± 0.05 | 17.4 ± 0.4 | 19.5 ± 0.2 | 0.91 ± 0.01 |
| Control | Control | Fiber | Native Tussah Silk (*A. pernyi*) | None | 31 ± 4.9 | 17.6 ± 2.0 | 15.1 ± 0.4 | 0.92 ± 0.01 |

Experiment 9: Manipulating Precursor Fiber Crystallinity to Modulate Properties of Drawn Fiber Various techniques of increasing fiber crystallinity before and after drawing fiber were performed. In order to produce the fibers, 18B powder that was not subjected to any reprocessing was used. The purity of the 18B powder was determined using the same methodology described above in Example 1 and the purity profile is included below in Table 10. The 18B powder was stored at 60° C. under vacuum to reduce the water content to below 4 wt %.

TABLE 10

Purity profile of 18B powder as assessed by size exclusion chromatography.

| Fraction | Average SEC area % | Standard deviation of SEC area % |
|---|---|---|
| High molecular weight impurities | 2.55 | 0.76 |
| 18B aggregates | 5.73 | 0.59 |
| 18B monomer | 47.96 | 0.99 |
| Intermediate molecular weight impurities | 31.65 | 0.2 |
| Low molecular weight impurities | 12.12 | 2.15 |

The 18B powder was dissolved in 98% formic acid at a concentration of 36 wt % using a planetary centrifugal mixer (Thinky ARE-400TWIN) at 1600 revolutions per minute and 1600 rotations per minute. The dope was degassed by centrifugation at 15317 RCF for 30 minutes before loading into a syringe. The dope was extruded via syringe pump at 40 μl/min through a spinneret with a 127 μm diameter capillary, through a 1 cm air gap, and into a coagulation bath of 100% reagent alcohol (88.5-92.5 vol % ethanol; 4-6 vol % isopropanol; 3.5-5.5 vol % methanol). The fiber was reeled through 1.5 m of bath at 1.7 m/min (corresponding to a residence time of 53 s), wrapped once around a godet at the same speed, and then collected on a take-up godet at 3 m/min.

To investigate the modulating effect of annealing prior to hot drawing fiber, finished spools ("precursor fibers") were stored either in a box purged with clean dry air ("CDA-stored") or a sealed box containing a beaker filled with ~200 ml of methanol ("annealed") before characterization or post-processing. Precursors were stored under CDA for times ranging from 16 hours to 2 weeks, or in methanol vapor for times ranging from 16 hours to 24 hours.

Hot drawing of CDA-stored and annealed precursor fibers was performed by passing the fiber over a hot surface (20 cm path length) at 200° C. at a feed rate of 1 m/min, and collecting on a take-up godet at 4.3 m/min. The distance between the feed and take-up godets was 40 cm.

To investigate the beta-sheet formation of the CDA-stored and annealed fibers before and after hot drawing the fibers, the glass transition temperature (Tg) was measured using a dynamic mechanical analyzer (TA Instruments Q800). To prepare the precursor fibers for DMA, sections of fiber were epoxied to paper frames with a 1 cm gauge length, the sides of which were removed after the fiber was clamped inside the instrument furnace. Samples were subjected to a temperature ramp (22 to 250° C. at 3° C./min) while simultaneously subjected to an oscillatory strain (20 μm at 1 Hz). The DMA furnace was purged with clean dry air for the duration of the experiment. The glass transition temperature was calculated from the resulting thermograms by finding the peak maxima of the loss tangent. Table 11 (below) shows that the glass transition temperature significantly increases with methanol annealing, demonstrating a higher-level of crystallinity and beta-sheet formation.

TABLE 11

Glass transition temperatures of CDA-stored and annealed precursor fibers

| Precursor storage condition | Average $T_g$ (storage modulus inflection, ° C.) | 95% confidence interval of average $T_g$ (storage modulus inflection, ° C.) | n |
|---|---|---|---|
| CDA | 147 | 13 | 4 |
| Methanol vapor | 195 | 7 | 3 |

Figure 8:
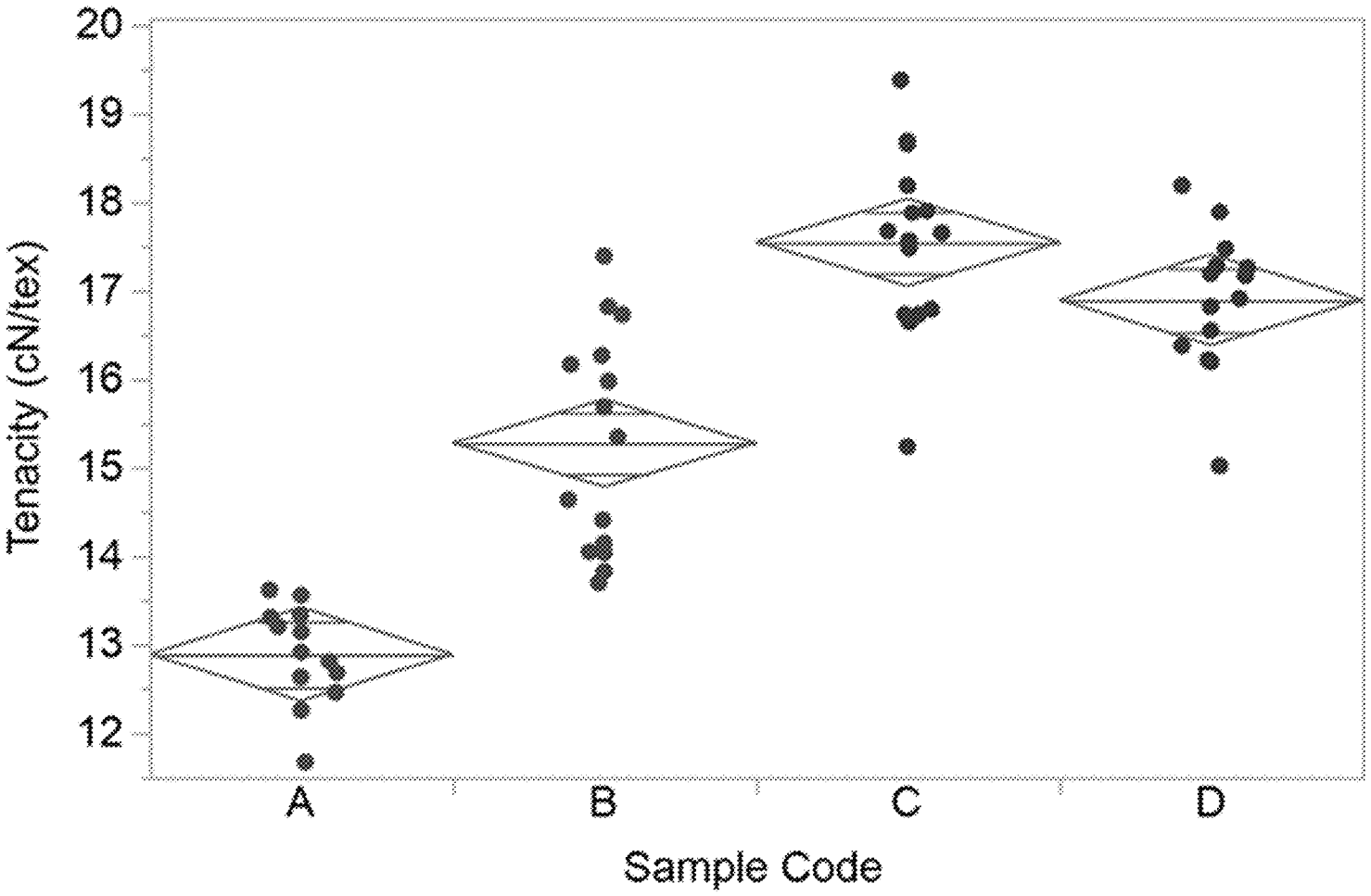
FIG. 8 depicts a graph of tenacities measured from CDA-stored and annealed precursor fibers before and after post-hot draw annealing. A: hot drawn CDA-stored precursor. B: hot drawn CDA-stored precursor after annealing. C: hot drawn annealed precursor. D: hot drawn annealed precursor, annealed again after hot drawing.

In addition, the mechanical properties of precursor and hot drawn fibers were measured using a TexTechno Favimat+ at 65% relative humidity, according to ASTM standard D1776. Table 12 lists the different mean tenacities measured from CDA-stored and annealed precursor fibers before and after post-hot draw annealing. FIG. 8 includes a graph of the same. Data points shown in FIG. 8 represent the measurement of a single filament. Diamonds represent the mean tenacity and the upper and lower 95% confidence intervals of the mean tenacity. A: hot drawn CDA-stored precursor. B: hot drawn CDA-stored precursor after annealing. C: hot drawn annealed precursor. D: hot drawn annealed precursor, annealed again after hot drawing. As shown by these data, annealing steps prior to and after hot draw increased the tenacity of the fiber, likely because of increased three-dimensional crystallinity and beta-sheet structure formation.

TABLE 12

Tenacities of Hot Drawn Fibers

| Sample code | Mean tenacity (cN/tex) | 95% CI of mean tenacity (cN/tex) | n |
|---|---|---|---|
| A | 12.9 | 0.3 | 13 |
| B | 15.3 | 0.7 | 15 |
| C | 17.5 | 0.6 | 15 |
| D | 16.9 | 0.5 | 14 |

Example 10: Hot Drawn Reconstituted *Bombyx mori* Silk Fiber

To observe the effect of "hot drawing" the fiber on silks with different characteristics than recombinant spider silks, fibers were spun from reconstituted *Bombyx mori* (i.e. silkworm) silk. The reconstitution method broadly followed the steps detailed in Rockwood D N, et al. Materials fabrication from *Bombyx mori* silk fibroin, Nat Protoc. 2011; 6(10):1612-31. As a first step, 20 to 49 g of *Bombyx mori* yarns were washed in 1.5 L of 0.5 wt % sodium carbonate solution for more than 8 hours at 37° C. Fibers were then rinsed with demineralized water four times to remove the carbonate before freeze drying. Subsequently, the dried fiber was solubilized in 9.5 M lithium bromide at 200 to 300 mg/mL in a planetary centrifugal mixer (Thinky ARE-400TWIN) set to 1600 RPM for 15 minutes. The solution was centrifuged at 2500 RPM to remove air bubbles before filtering through a 1.3 μm syringe filter. The solution was then transferred to a 30 kDa dialysis cassette to wash the lithium bromide until the permeate conductivity dropped below 50 μS/cm. The dialyzed solution was then flash frozen using liquid nitrogen before freeze drying to sublimate the water off of the silk. The *B. mori* reconstituted silk fibroin (RSF) foam was crushed using a mortar and pestle until forming a fine powder for dope mixing.

Prior to dope preparation, *B. mori* RSF was stored at 60° C. under vacuum to reduce water content to below 4 wt %. Powder was dissolved in 98% formic acid at a concentration of 36 wt % using a planetary centrifugal mixer (Thinky ARE-400TWIN) at 1600 RPM. The dope was degassed by centrifugation at 15317 RCF for 30 minutes before loading into a syringe.

Dope was extruded via syringe pump at 40 μl/min through a spinneret with a 127 diameter capillary, through a 1 cm air gap, and into a coagulation bath of 100% reagent alcohol (88.5-92.5 vol % ethanol; 4-6 vol % isopropanol; 3.5-5.5% methanol). The fiber was reeled through 1.5 m of bath at 1.7 m/min corresponding to a residence time of 53 s and wrapped once around a godet at the same speed. Precursor fibers were then collected on a take-up godet at 3 m/min. Finished spools were stored either in a box purged with clean dry air ("CDA-stored") or a sealed box containing a beaker filled with ~200 ml of methanol ("annealed") before characterization or post-processing. Precursors were stored under CDA for times ranging from 16 hours to 2 weeks, or in methanol vapor for times ranging from 16 hours to 24 hours.

Precursor fibers were continuously hot drawn by passing the fiber over a hot surface (20 cm path length) at 200° C. at a feed rate of 1.5 m/min, and collecting on a take-up godet at 4.8 m/min for a draw ratio of 3.2×. The distance between the feed and take-up godets was 40 cm.

Figure 9:
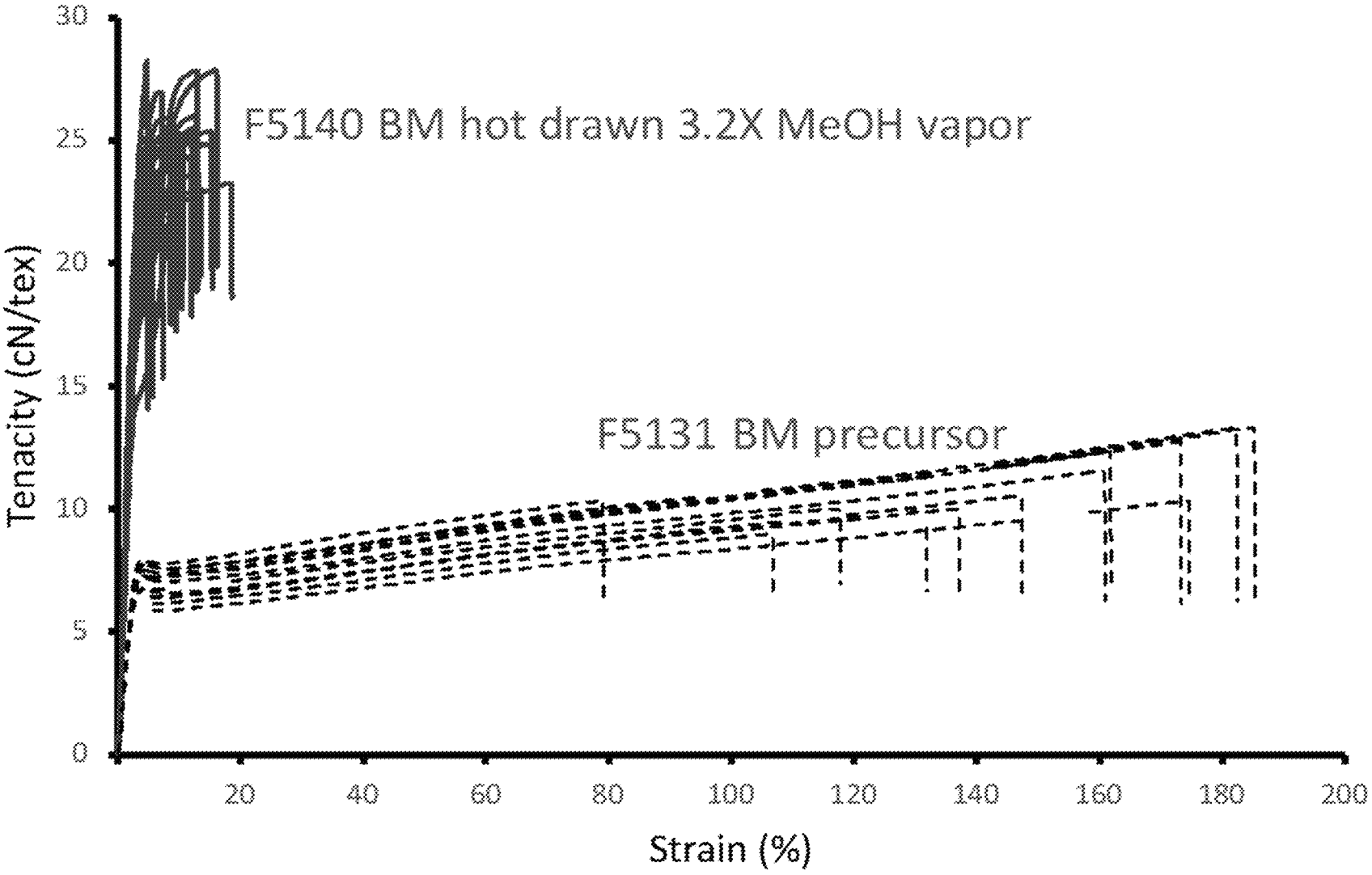
FIG. 9 depicts stress-strain curves corresponding to precursor and hot drawn *Bombyx mori* RSF fibers using a TexTechno Favimat+ at 65% relative humidity, according to ASTM standard D1776.

The mechanical properties of precursor and hot drawn fibers were measured using a TexTechno Favimat+ at 65% relative humidity, according to ASTM standard D1776. Table 13 below lists the mechanical properties of the fibers. Data is presented as the average value±the 95% confidence interval of the mean. Stress-strain curves corresponding to this data are shown in FIG. 9. As shown by this data, the methanol annealed fibers had a higher tenacity, likely due to enhanced formation of beta-sheet and three-dimensional crystalline structures.

TABLE 13

Tenacity, linear density (LD), and elongation at break for continuously hot drawn formic acid dope spun *Bombyx mori* precursors and hot drawn fibers

| | n | LD dTex | 95% CI | Tenacity cN/Tex | 95% CI | Initial modulus cN/Tex | 95% CI | Elongation at break % | 95% CI |
|---|---|---|---|---|---|---|---|---|---|
| F5131_Precursor *Bombyx mori* fiber | 15 | 103 | 6 | 11.0 | 0.8 | 316 | 333 | 149 | 18 |
| F5139_Continous HD As-is_X3.2 BM | 24 | 68 | 3 | 22.1 | 0.7 | 653 | 670 | 16 | 3 |
| F5140_Continuous HD MeOH 24 hrs_X3.2 BM | 22 | 65 | 3 | 25.0 | 0.8 | 868 | 889 | 11 | 2 |

Figure 10:
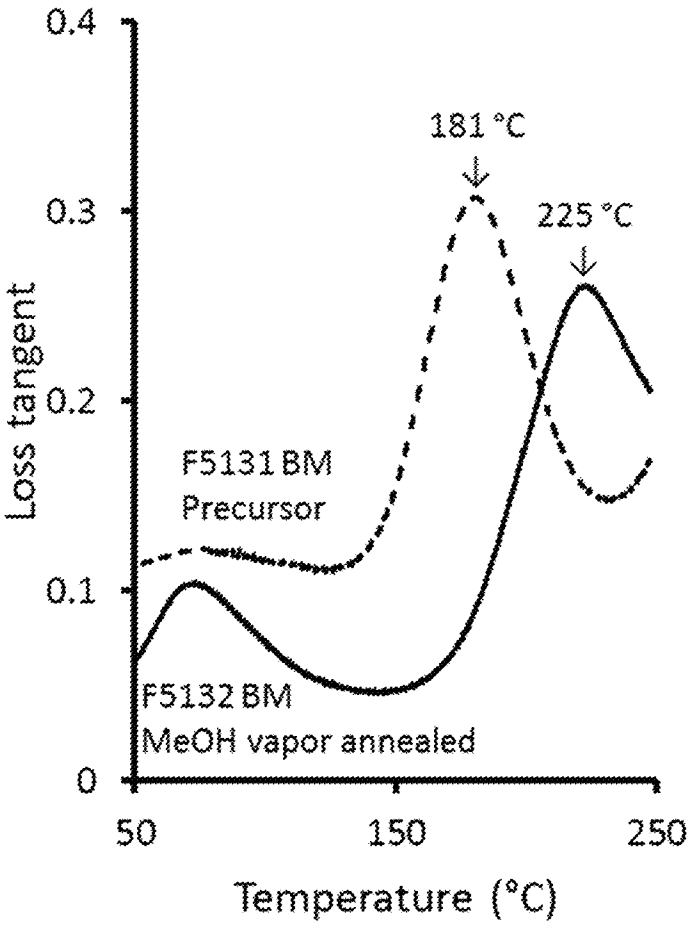
FIG. 10 depicts a plot of the loss modulus and loss tangent curves for CDA-stored and annealed precursor fibers. The maxima indicating the glass transition temperature (Tg) is shown using arrows.
Figure 10:
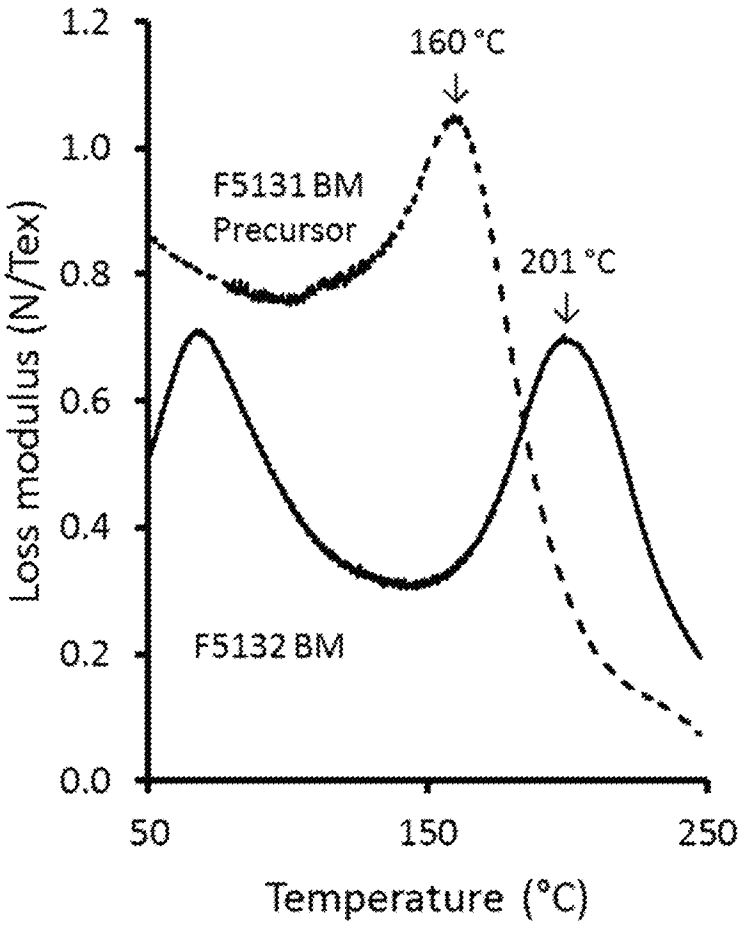

The glass transition temperature ($T_g$) of CDA-stored and annealed precursor fibers was measured using a dynamic mechanical analyzer (TA Instruments Q800). To prepare the precursor fibers for DMA, sections of fiber were epoxied to paper frames with a 1 cm gauge length, the sides of which were removed after the fiber was clamped inside the instrument furnace. Samples were subjected to a temperature ramp from 22 to 250° C. at 3° C./min under an oscillatory strain of 20 μm at 1 Hz. The DMA furnace was purged with clean dry air for the duration of the experiment. The glass transition temperature was calculated from the resulting thermograms by finding the maxima of the loss tangent. FIG. 10 includes plots of the loss modulus and loss tangent curves, the calculated glass transition temperature (Tg) is shown using arrows. Table 14 (below) includes the calculated glass transition temperature for the different samples. As with fibers created using 18B powder, a higher glass transition temperature was observed in annealed reconstituted *Bombyx mori* fibers.

TABLE 14

Glass transition temperature of annealed and precursor *Bombyx mori* RSF fibers

| | | Storage modulus (degC.) | | Loss modulus peak (degC.) | | Tan delta peak (degC.) | |
|---|---|---|---|---|---|---|---|
| Treatment | N | AVG | 95% CI | AVG | 95% CI | AVG | 95% CI |
| *Bombyx mori* RSF As-is (precursor) | 2 | 163.3 | 6.2 | 160.5 | 6.0 | 180.9 | N/A |
| *Bombyx mori* RSF Annealed (precursor) | 2 | 202.3 | 38.5 | 202.3 | 45.1 | 224.8 | 14.6 |

Example 11—Fibers Spun Using N-Methyl Morpholine N-Oxide (NMMO) as a Dope Solvent N-methyl morpholine N-oxide was used as a dope solvent to determine whether the same properties could be observed using a different dope solvent. 18B powder with the same purity profile referenced in Example 9 was stored at 60° C. under vacuum to reduce water content to below 4 wt %. A mixture containing 24 wt % 18B powder, 75 wt % NMMO monohydrate, and 1 wt % propyl gallate was mixed with an anchor impeller at 250 RPM in a glass reactor heated to 100° C. via oil bath for 90 minutes until a viscous solution was formed. The reactor was purged with nitrogen at 5 SCFM for the duration of mixing. After dissolution, the dope was degassed by stirring at 25-50 rpm and applying vacuum starting at 200 torr and increasing to 50 torr over the course of 16 minutes. The dope was then harvested from the reactor and further degassed via centrifugation at 15317 RCF, reheated at 80° C. for 30 minutes, and centrifuged a final time at 15317 RCF. Dope was stored at 80° C. until it was used for spinning.

Figure 11:
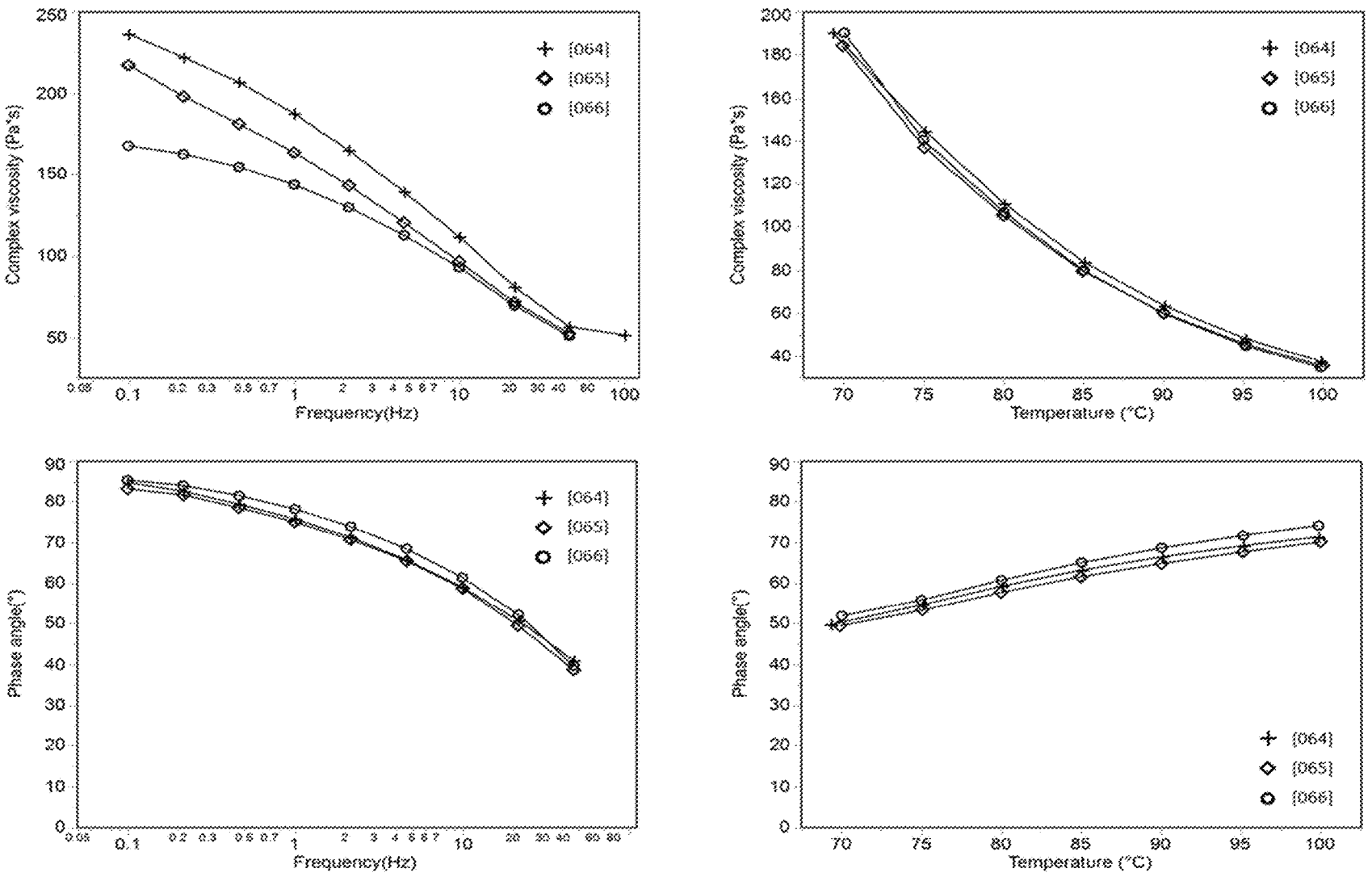
FIG. 11 depicts a plot of complex viscosity and phase angle of 3 NMMO-based dopes as a function of frequency and temperature.

The rheological properties of NMMO-based dopes were measured using a rotational rheometer (Malvern Panalytical Kinexus lab+) configured with a cone (2°, 20 mm diameter) and plate geometry. To measure the frequency response at a single temperature, dope samples were heated to 80° C. and subjected to a 1% oscillatory strain as the frequency ranged from 100-0.1 Hz, with 3 samples taken per decade. To measure the temperature response, dope samples were subjected to a 1% oscillatory strain at 10 Hz as the temperature was increased from 70° C. to 100° C. FIG. 11 shows that the complex viscosity and phase angle of NMMO-based dopes as a function of frequency and temperature. Data is shown from three independent repeat dope preparations. Table 15 below includes the mean values calculated from the repeat dope preparations at 85° C.

TABLE 15

Mean Complex Viscosity and Phase Angle of NMMO-based 18B Dopes at 85° C. and 10 Hz

| | Mean | 95% CI of mean | n |
|---|---|---|---|
| Complex viscosity (Pa · s) | 100 | 25 | 3 |
| Phase angle (°) | 60 | 4 | 3 |

To generate fiber, dope was loaded in a syringe pump (Teledyne Isco 260D) equipped with a temperature control jacket connected to a recirculating oil heater. Dope was pumped through a custom-built jacketed extrusion line and spinneret, both of which were also connected to the oil heater. The oil temperature was maintained at 85° C. for the duration of spinning. Dope was extruded at 40 μl/min through a spinneret with a 125 μm diameter capillary, through a 5 cm air gap, and into a coagulation bath of 100% reagent alcohol (88.5-92.5 vol % ethanol; 4-6 vol % isopropanol; 3.5-5.5 vol % methanol). The fiber was reeled through the 1.5 m coagulation bath at 7 m/min (corresponding to a residence time of 12.8 s) and then wrapped 5 times around a set of godets onto which methanol was dripped at an average rate of 15 ml/min via a peristaltic pump. The total path length of the wraps around the first set of godets was 5 m. From there, the fiber was passed through a 1.5 m wash bath containing 80 vol % methanol and 20 vol % DI water at 10 m/min, corresponding to a residence time of 9 s. The fiber was then wrapped 5 times around another set of godets onto which a mixture of 75 vol % methanol and 25 vol % DI water was dripped at an average rate of 7 ml/min via peristaltic pump. The total path length of the wraps around the second set of godets was 3.3 m. Finally, the fiber was collected on a take-up godet at a rate of 10.5 m/min. Spools were stored at 22° C. and ambient relative humidity before characterization and post-processing.

NMMO-based precursor fibers were drawn by hand (referred to as "manual hot draw") by bringing them in contact with a hot surface (20 cm length) at 200° C. and stretching them at a draw ratio of approximately 3.4×. In addition, NMMO-based precursor fibers were continuously hot drawn in two stages by passing the fiber over a hot surface (20 cm path length) at 200° C. at a feed rate of 1.5 m/min, and collecting on a take-up godet at 3 m/min, followed by another draw step at a feed rate of 1.5 m/min and collecting on a take-up godet at 2.8 m/min, resulting in a total draw ratio of 3.73 m/min. The length between the feed and take-up godets was 40 cm.

The mechanical properties of hot drawn NMMO-based fibers were measured using a TexTechno Favimat+ at 65% relative humidity, according to ASTM standard D1776. Table 16 (below) lists the tenacity, linear density, and percent elongation at break for manually and continuously hot drawn NMMO-based fibers. Fibers were generated from independent dope preparation/spinning runs (denoted by spool). Data is presented as the average value±the 95% confidence interval of the average.

TABLE 16

Mechanical Properties of NMMO-based fibers

| Spool | Hot draw method | Tenacity (cN/tex) | Linear density (dtex) | Elongation at break (%) | n |
|---|---|---|---|---|---|
| [064]_F6 | Manual | 19.5 ± 0.8 | 3.8 ± 0.4 | 17 ± 2 | 23 |
| [064]_F6 | Continuous | 17.9 ± 0.4 | 3.5 ± 0.1 | 26 ± 2 | 20 |
| [065]_F2 | Manual | 18 ± 1 | 3.7 ± 0.2 | 18 ± 3 | 25 |
| [065]_F2 | Continuous | 19.5 ± 0.4 | 3.7 ± 0.1 | 22 ± 2 | 18 |
| [066]_F2 | Manual | 17 ± 1 | 3.7 ± 0.3 | 18 ± 4 | 25 |

Figure 12:
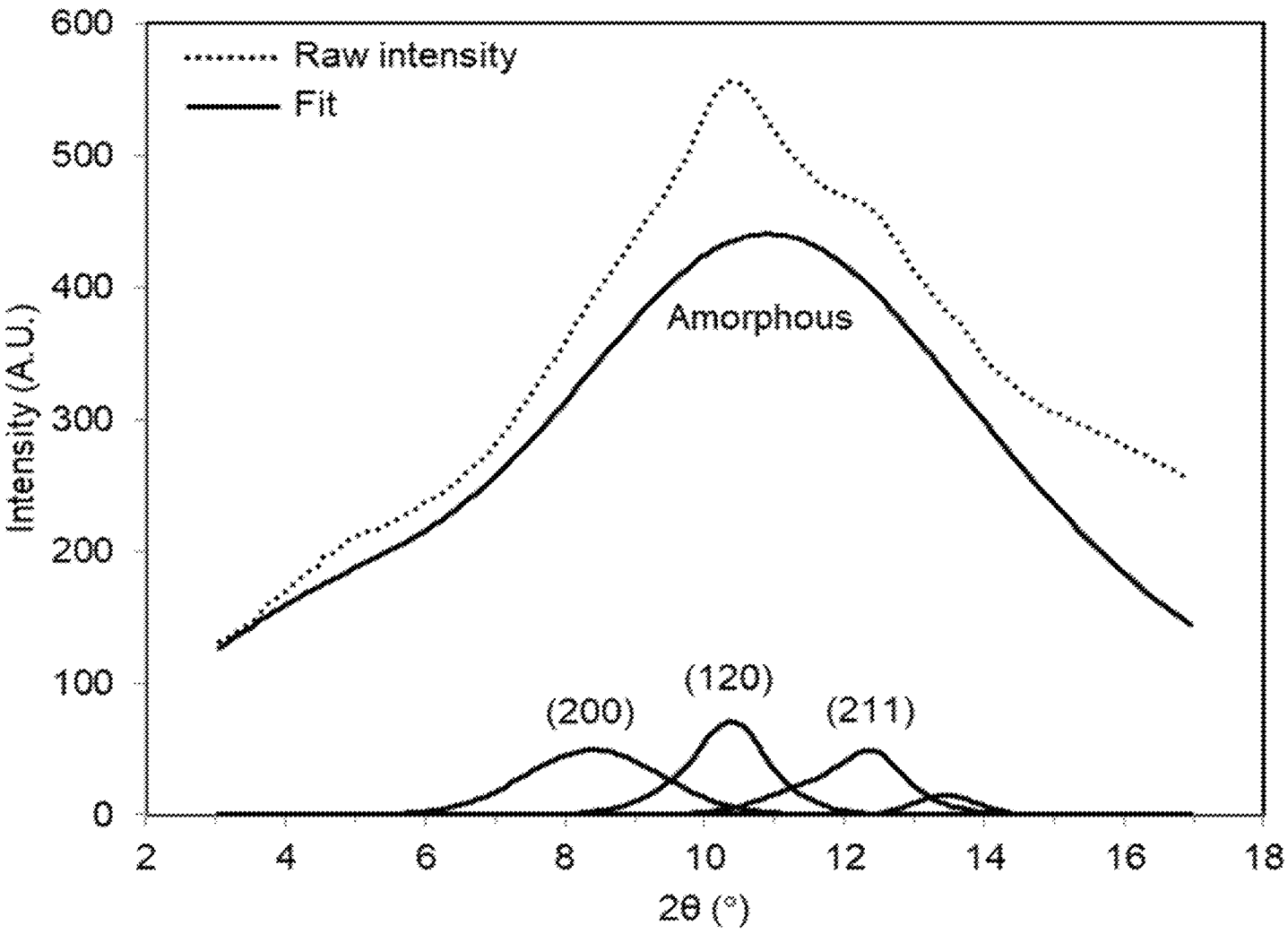
FIG. 12 depicts radially integrated intensity through equatorial reflections generated from X-Ray diffraction of continuously hot drawn NMMO-based fibers.
Figure 13:
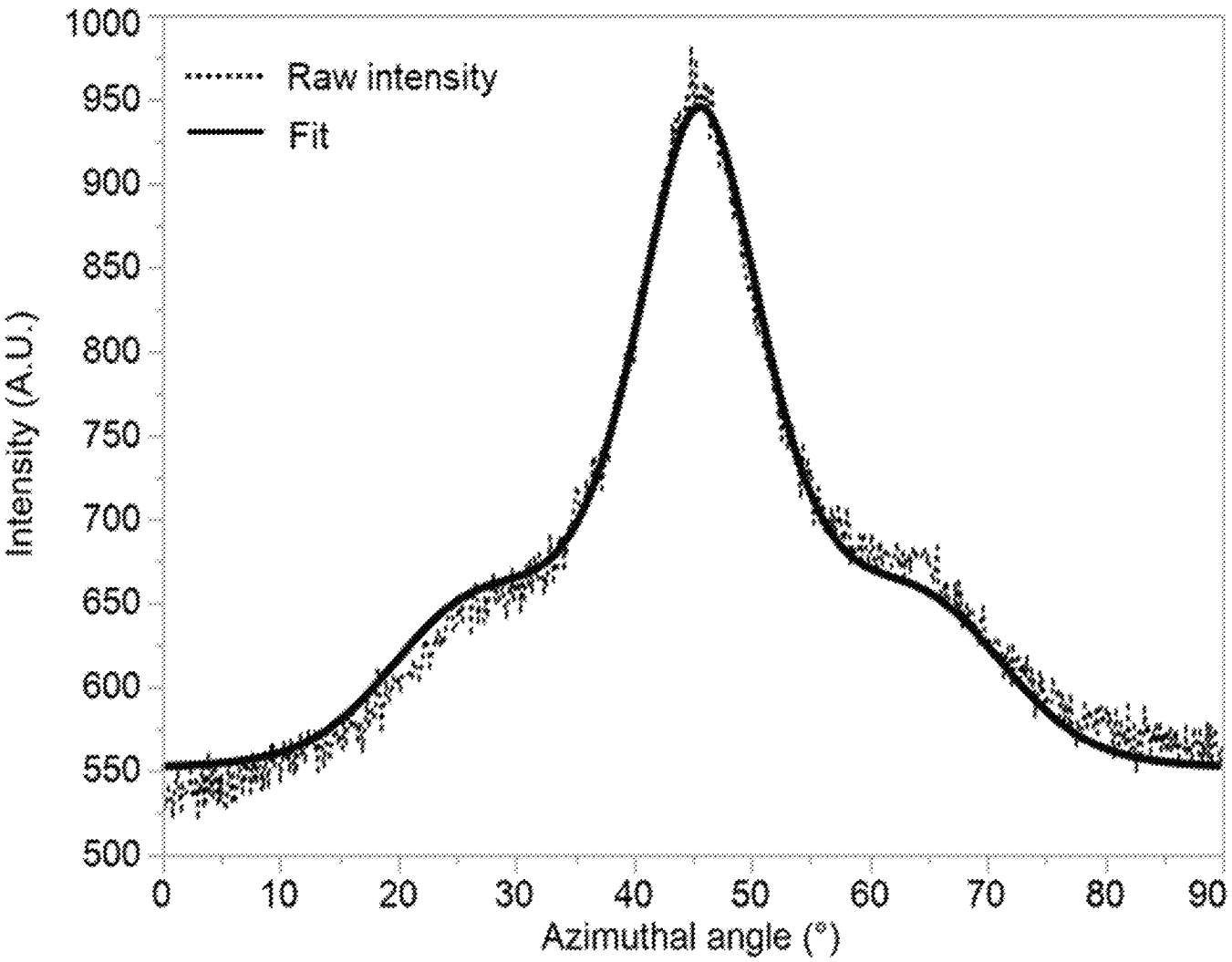
FIG. 13 depicts Azimuthally integrated intensity through the (120) reflection generated from X-Ray diffraction of continuously hot drawn NMMO-based fibers.
Figure 14:
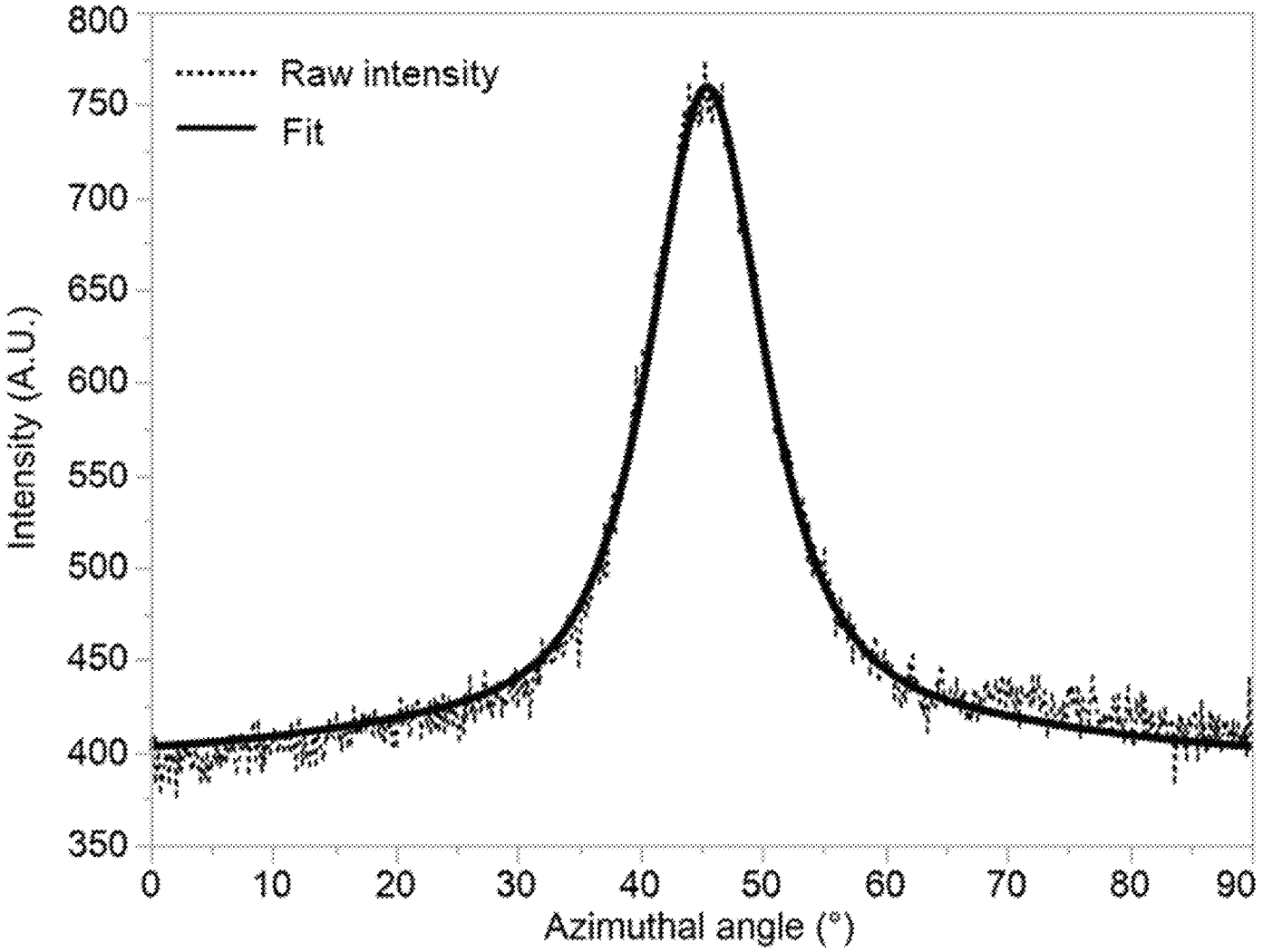
FIG. 14 depicts Azimuthally integrated intensity through the (200) reflection generated from X-Ray diffraction of continuously hot drawn NMMO-based fibers.

X-ray diffraction was performed in order to measure crystallinity of the fibers. To prepare samples for XRD, fibers were bundled (~10-20 filaments/bundle) and affixed to a frame. XRD was performed on beamline 4-2 at the Stanford Synchrotron Radiation Lightsource with a beam energy of 15.5 keV (0.799 Å), spot size of 100×100 μm, and a sample to detector distance of 327.5 mm. Diffraction patterns were collected using a Rayonix MX225-HE detector with a 10 second exposure time. Three exposures were taken at 3 different points along the fiber bundle. Data was analyzed as described above with respect to Example 8. Figures E-G include the integrated radial and azimuthal intensity profiles generated from XRD of continuously hot drawn NMMO-based fibers. FIG. 12 depicts radially integrated intensity through equatorial reflections. FIG. 13 depicts Azimuthally integrated intensity through the (120) reflection. FIG. 14 depicts Azimuthally integrated intensity through the (200) reflection. Table 17 includes the estimated percent crystallinity and Herman's orientation factor for continuously hot drawn NMMO-based fibers. Data is presented as the average±the standard deviation of 3 exposures at 3 different locations on the fiber bundle.

TABLE 17

Crystallinity of hot drawn NMMQ-based fibers

| Sample | Estimated crystallinity (%) | Herman's orientation factor |
|---|---|---|
| Continuously hot drawn NMMO-based fiber | 6.70 ± 0.09 | 0.79 ± 0.00 |

Example 12—Elevated Take-Up Throughput Hot Draw Process

Elevated uptake speeds are beneficial in that they allow for rapid processing of precursor fiber. To investigate the effects of various uptake speeds on the hot draw process, precursor fiber was spun using NMMO-based dope as described above in Example 11. Precursor fibers were then continuously hot drawn by passing the fiber over a hot surface (20 cm path length) in three stages with the feed rate, take-up rate, and hot surface temperature or each stage as follows: stage 1: 10.5 m/min, 26.3 m/min (2.5×), 200° C.; stage 2: 26.3 m/min, 34 m/min (1.3×), 220° C.; stage 3: 34 m/min, 37 m/min (1.08×), 220° C. The total draw ratio was thus 3.52×. The length between the feed and take-up godets for each stage was 40 cm.

The mechanical properties of hot drawn NMMO-based fibers were measured using a TexTechno Favimat+ at 65% relative humidity, according to ASTM standard D1776. Table 18 (below) includes tenacity, linear density, and elongation at break of the fibers produced from the elevated take-up throughput hot draw process.

TABLE 18

Tenacity, linear density, and elongation at break of the fibers produced from the elevated take-up throughput hot draw process.

| | Tenacity (cN/tex) | Linear density (dtex) | Elongation at break (%) |
|---|---|---|---|
| Mean | 15.9 | 3.7 | 29 |
| Standard deviation | 0.9 | 0.5 | 5 |
| 95% confidence interval of mean | 0.1 | 0.06 | 0.6 |
| n | 305 | 305 | 305 |

Example 13—Batch Mode Hot Drawing Precursor Fibers

An apparatus for performing hot draw in a batch manner was constructed by attaching parallel steel rods to both the traveler and the end of a linear actuator (Zaber T-LSR450D) and positioning the apparatus over a hot surface, the temperature of which could be controlled. The position of the hot surface was adjustable such that it could be brought in and out of contact with the steel rods. In this way, precursor fibers strung between the rods could be hot drawn at controlled temperatures and rates.

Formic acid-based precursor fibers were spun as described Example 9 from 18B powder of the same purity profile described therein. Precursor fibers were affixed between the rods of the batch hot drawing apparatus using Kapton tape. The length of the fibers between the rods exposed to the hot surface was 2.5 cm. After bringing the hot surface in contact with the mounted fibers, the linear actuator was used to increase the distance between the rods (thus drawing the fibers) in steps of 5 mm at a rate of 5 mm/s until all of the fibers were broken. During this process, the number of unbroken fibers remaining after each draw step was recorded, from which the percent elongation at break distribution could be approximated.

Figure 15:
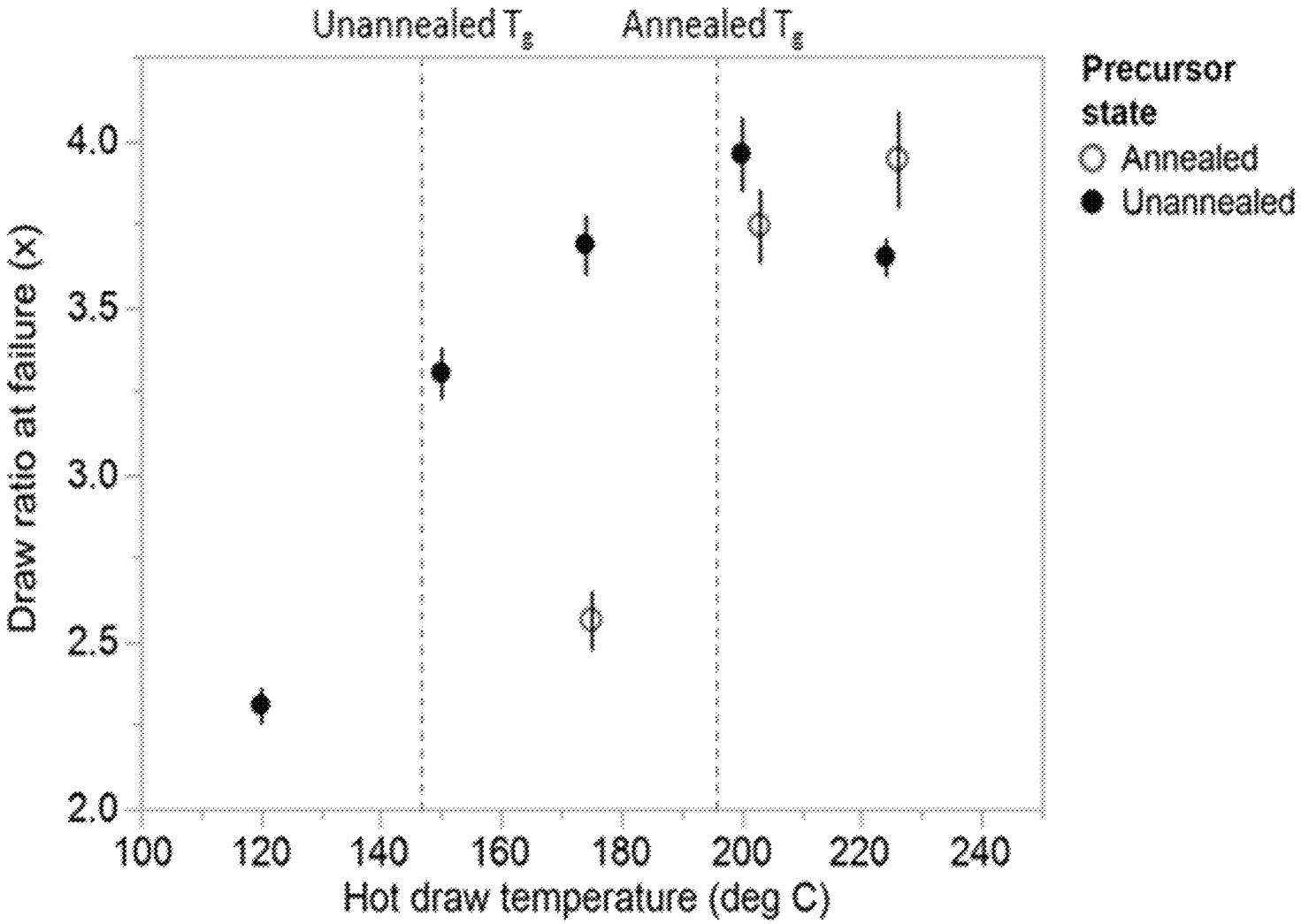
FIG. 15 depicts the draw ratio at failure of methanol vapor annealed and CDA-stored (unannealed) precursors drawn over a hot surface ranging from 120° C. to 225° C.

To study the effects of precursor processing history on hot draw behavior, batch hot draw was performed on both methanol vapor annealed and CDA-stored precursors (the preparation of which is described in Example 9) as the temperature of the hot surface ranged from 120° C. to 225° C. FIG. 15 depicts the draw ratio at failure of these fibers over various temperatures.

Figure 16:
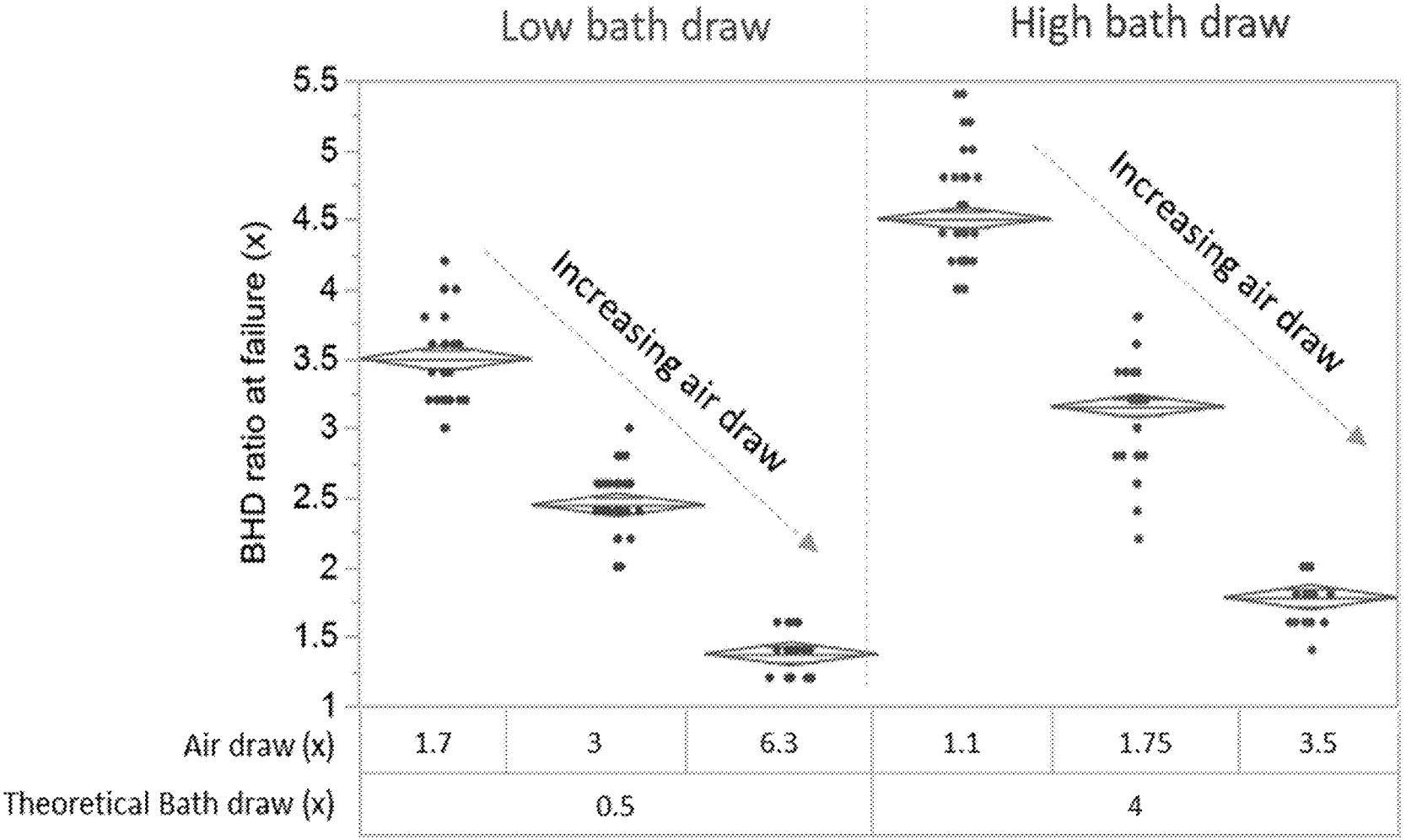
FIG. 16 depicts the draw ratio at failure for formic acid-based fibers spun with varying theoretical bath draw ratios and air draw ratios for fibers hot drawn at 200° C.

In addition, batch hot draw was performed at 200° C. on formic acid-based fibers spun with varying theoretical bath draw ratios and air draw ratios. Theoretical bath draw ratios are calculated by dividing the rate at which the fiber is reeled from the coagulation bath by the theoretical jet velocity, which in turn is defined as the rate of change of the length of a cylinder whose diameter equals the diameter of the spinneret capillary and whose volume as a function of time is equal to the volumetric flow rate of dope through the capillary. For these fibers, the theoretical bath draw ratios ranged from 0.5×-4× and the air draw ratios ranged from 1.1×-6.3×. FIG. 16 depicts the draw ratio at failure for these fibers. As shown in FIG. 16, the draw ratio at failure decreased in proportion to estimated air draw ratio of the fibers. However, the fibers with a higher theoretical bath draw had much higher draw ratios at failure.

Figure 17:
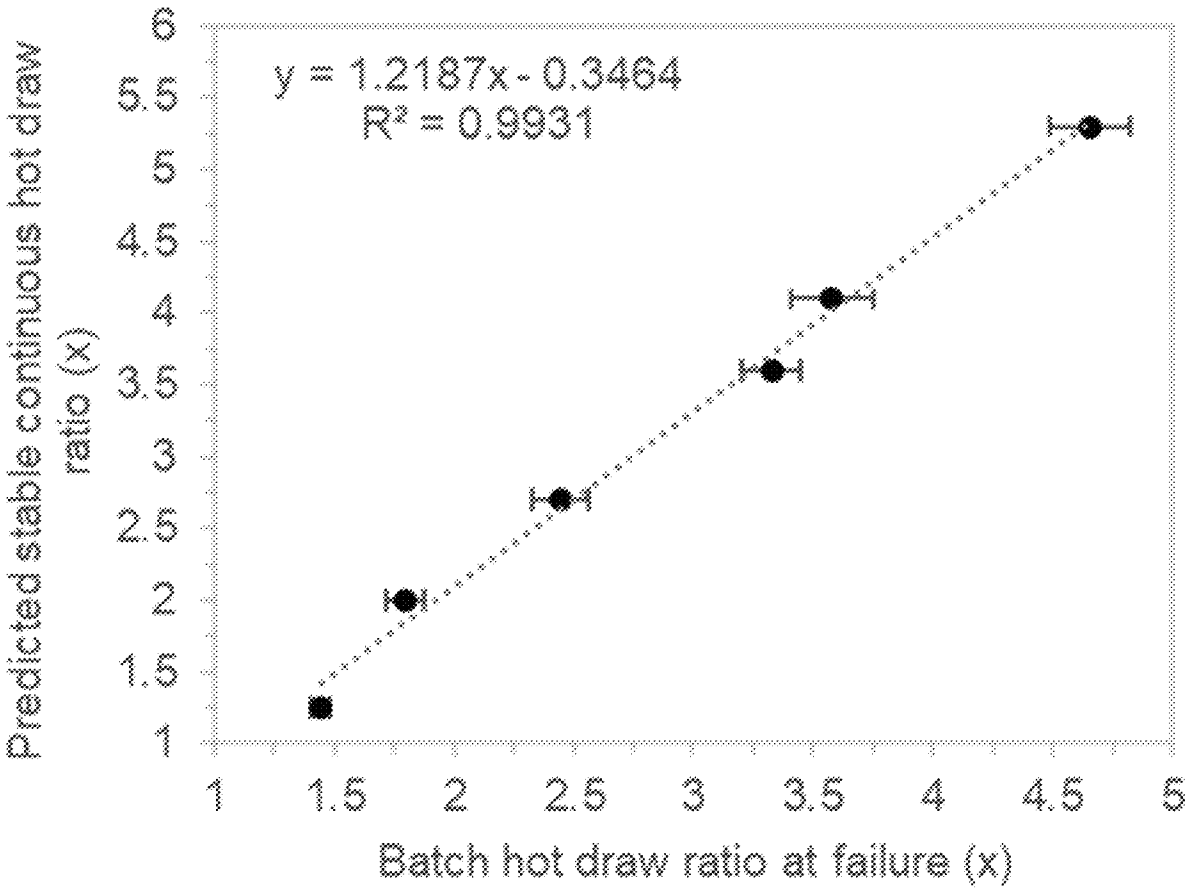
FIG. 17 shows a plot of predicted continuous hot draw ratio vs. batch hot draw ratio at failure for formic-acid based precursors, illustrating a correspondence between the predicted and observed draw ratio at break.

Using batch hot draw, the percent elongation at break distribution of fibers spun with varying theoretical bath draws and air draws was determined. The same fibers were also continuously hot drawn as described in Example 9, and their maximum stable continuous hot draw ratio was determined. The maximum stable continuous hot draw ratio was defined as the hot draw ratio at which at least 5 m of hot drawn fiber could be collected without breaking. The maximum stable continuous hot draw ratio of each fiber was then plotted against the corresponding average draw ratio at break (determined from the percent elongation at break distribution from batch hot draw) and a linear model was fit to the data. In this way, the maximum stable continuous hot draw ratio of a precursor with arbitrary processing history may be predicted by using a small (~1 m) amount of precursor to perform batch hot draw, rather than using a larger (~10 m) amount of precursor to naively optimize for the maximum stable continuous hot draw ratio in continuous hot drawing. FIG. 17 depicts the correspondence between the predicted and observed draw ratio at break.

SEQUENCE LISTING

```
<160> NUMBER OF SEQ ID NOS: 7

<210> SEQ ID NO 1
<211> LENGTH: 945
<212> TYPE: PRT
<213> ORGANISM: Artificial Sequence
<220> FEATURE:
<223> OTHER INFORMATION: Description of Artificial Sequence: Synthetic
      polypeptide

<400> SEQUENCE: 1

Gly Gly Tyr Gly Pro Gly Ala Gly Gln Gln Gly Pro Gly Ser Gly Gly
1               5                   10                  15
```

```
Gln Gln Gly Pro Gly Gly Gln Gly Pro Tyr Gly Ser Gly Gln Gln Gly
            20                  25                  30

Pro Gly Gly Ala Gly Gln Gln Gly Pro Gly Gly Gln Gly Pro Tyr Gly
        35                  40                  45

Pro Gly Ala Ala Ala Ala Ala Ala Ala Ala Ala Gly Gly Tyr Gly Pro
    50                  55                  60

Gly Ala Gly Gln Gln Gly Pro Gly Gly Ala Gly Gln Gln Gly Pro Gly
65                  70                  75                  80

Ser Gln Gly Pro Gly Gly Gln Gly Pro Tyr Gly Pro Gly Ala Gly Gln
                85                  90                  95

Gln Gly Pro Gly Ser Gln Gly Pro Gly Ser Gly Gly Gln Gln Gly Pro
            100                 105                 110

Gly Gly Gln Gly Pro Tyr Gly Pro Ser Ala Ala Ala Ala Ala Ala Ala
        115                 120                 125

Ala Ala Gly Gly Tyr Gly Pro Gly Ala Gly Gln Arg Ser Gln Gly Pro
    130                 135                 140

Gly Gly Gln Gly Pro Tyr Gly Pro Gly Ala Gly Gln Gln Gly Pro Gly
145                 150                 155                 160

Ser Gln Gly Pro Gly Ser Gly Gly Gln Gln Gly Pro Gly Gly Gln Gly
                165                 170                 175

Pro Tyr Gly Pro Ser Ala Ala Ala Ala Ala Ala Ala Ala Gly Gly Tyr
            180                 185                 190

Gly Pro Gly Ala Gly Gln Gln Gly Pro Gly Ser Gln Gly Pro Gly Ser
        195                 200                 205

Gly Gly Gln Gln Gly Pro Gly Gly Gln Gly Pro Tyr Gly Pro Gly Ala
    210                 215                 220

Ala Ala Ala Ala Ala Ala Val Gly Gly Tyr Gly Pro Gly Ala Gly Gln
225                 230                 235                 240

Gln Gly Pro Gly Ser Gln Gly Pro Gly Ser Gly Gly Gln Gln Gly Pro
                245                 250                 255

Gly Gly Gln Gly Pro Tyr Gly Pro Ser Ala Ala Ala Ala Ala Ala Ala
            260                 265                 270

Ala Gly Gly Tyr Gly Pro Gly Ala Gly Gln Gln Gly Pro Gly Ser Gln
        275                 280                 285

Gly Pro Gly Ser Gly Gly Gln Gln Gly Pro Gly Gly Gln Gly Pro Tyr
    290                 295                 300

Gly Pro Ser Ala Ala Ala Ala Ala Ala Ala Ala Gly Gly Tyr Gly Pro
305                 310                 315                 320

Gly Ala Gly Gln Gln Gly Pro Gly Ser Gly Gly Gln Gln Gly Pro Gly
                325                 330                 335

Gly Gln Gly Pro Tyr Gly Ser Gly Gln Gln Gly Pro Gly Gly Ala Gly
            340                 345                 350

Gln Gln Gly Pro Gly Gly Gln Gly Pro Tyr Gly Pro Gly Ala Ala Ala
        355                 360                 365

Ala Ala Ala Ala Ala Ala Gly Gly Tyr Gly Pro Gly Ala Gly Gln Gln
    370                 375                 380

Gly Pro Gly Gly Ala Gly Gln Gln Gly Pro Gly Ser Gln Gly Pro Gly
385                 390                 395                 400

Gly Gln Gly Pro Tyr Gly Pro Gly Ala Gly Gln Gln Gly Pro Gly Ser
                405                 410                 415

Gln Gly Pro Gly Ser Gly Gly Gln Gln Gly Pro Gly Gly Gln Gly Pro
            420                 425                 430

Tyr Gly Pro Ser Ala Ala Ala Ala Ala Ala Ala Ala Ala Gly Gly Tyr
```

```
        435                 440                 445

Gly Pro Gly Ala Gly Gln Arg Ser Gln Gly Pro Gly Gly Gln Gly Pro
    450                 455                 460

Tyr Gly Pro Gly Ala Gly Gln Gln Gly Pro Gly Ser Gln Gly Pro Gly
465                 470                 475                 480

Ser Gly Gly Gln Gln Gly Pro Gly Gly Gln Gly Pro Tyr Gly Pro Ser
                485                 490                 495

Ala Ala Ala Ala Ala Ala Ala Ala Gly Gly Tyr Gly Pro Gly Ala Gly
            500                 505                 510

Gln Gln Gly Pro Gly Ser Gln Gly Pro Gly Ser Gly Gly Gln Gln Gly
        515                 520                 525

Pro Gly Gly Gln Gly Pro Tyr Gly Pro Gly Ala Ala Ala Ala Ala Ala
    530                 535                 540

Ala Val Gly Gly Tyr Gly Pro Gly Ala Gly Gln Gln Gly Pro Gly Ser
545                 550                 555                 560

Gln Gly Pro Gly Ser Gly Gly Gln Gln Gly Pro Gly Gly Gln Gly Pro
                565                 570                 575

Tyr Gly Pro Ser Ala Ala Ala Ala Ala Ala Ala Ala Gly Gly Tyr Gly
            580                 585                 590

Pro Gly Ala Gly Gln Gln Gly Pro Gly Ser Gln Gly Pro Gly Ser Gly
        595                 600                 605

Gly Gln Gln Gly Pro Gly Gly Gln Gly Pro Tyr Gly Pro Ser Ala Ala
    610                 615                 620

Ala Ala Ala Ala Ala Ala Gly Gly Tyr Gly Pro Gly Ala Gly Gln Gln
625                 630                 635                 640

Gly Pro Gly Ser Gly Gly Gln Gln Gly Pro Gly Gly Gln Gly Pro Tyr
                645                 650                 655

Gly Ser Gly Gln Gln Gly Pro Gly Gly Ala Gly Gln Gln Gly Pro Gly
            660                 665                 670

Gly Gln Gly Pro Tyr Gly Pro Gly Ala Ala Ala Ala Ala Ala Ala Ala
        675                 680                 685

Ala Gly Gly Tyr Gly Pro Gly Ala Gly Gln Gln Gly Pro Gly Gly Ala
    690                 695                 700

Gly Gln Gln Gly Pro Gly Ser Gln Gly Pro Gly Gly Gln Gly Pro Tyr
705                 710                 715                 720

Gly Pro Gly Ala Gly Gln Gln Gly Pro Gly Ser Gln Gly Pro Gly Ser
                725                 730                 735

Gly Gly Gln Gln Gly Pro Gly Gly Gln Gly Pro Tyr Gly Pro Ser Ala
            740                 745                 750

Ala Ala Ala Ala Ala Ala Ala Ala Gly Gly Tyr Gly Pro Gly Ala Gly
        755                 760                 765

Gln Arg Ser Gln Gly Pro Gly Gly Gln Gly Pro Tyr Gly Pro Gly Ala
    770                 775                 780

Gly Gln Gln Gly Pro Gly Ser Gln Gly Pro Gly Ser Gly Gly Gln Gln
785                 790                 795                 800

Gly Pro Gly Gly Gln Gly Pro Tyr Gly Pro Ser Ala Ala Ala Ala Ala
                805                 810                 815

Ala Ala Ala Gly Gly Tyr Gly Pro Gly Ala Gly Gln Gln Gly Pro Gly
            820                 825                 830

Ser Gln Gly Pro Gly Ser Gly Gly Gln Gln Gly Pro Gly Gly Gln Gly
        835                 840                 845

Pro Tyr Gly Pro Gly Ala Ala Ala Ala Ala Ala Ala Val Gly Gly Tyr
    850                 855                 860
```

```
Gly Pro Gly Ala Gly Gln Gln Gly Pro Gly Ser Gln Gly Pro Gly Ser
865                 870                 875                 880

Gly Gly Gln Gln Gly Pro Gly Gly Gln Gly Pro Tyr Gly Pro Ser Ala
                885                 890                 895

Ala Ala Ala Ala Ala Ala Ala Gly Gly Tyr Gly Pro Gly Ala Gly Gln
            900                 905                 910

Gln Gly Pro Gly Ser Gln Gly Pro Gly Ser Gly Gly Gln Gln Gly Pro
        915                 920                 925

Gly Gly Gln Gly Pro Tyr Gly Pro Ser Ala Ala Ala Ala Ala Ala Ala
    930                 935                 940

Ala
945


<210> SEQ ID NO 2
<211> LENGTH: 315
<212> TYPE: PRT
<213> ORGANISM: Artificial Sequence
<220> FEATURE:
<223> OTHER INFORMATION: Description of Artificial Sequence: Synthetic
      polypeptide

<400> SEQUENCE: 2

Gly Gly Tyr Gly Pro Gly Ala Gly Gln Gln Gly Pro Gly Ser Gly Gly
1               5                   10                  15

Gln Gln Gly Pro Gly Gly Gln Gly Pro Tyr Gly Ser Gly Gln Gln Gly
            20                  25                  30

Pro Gly Gly Ala Gly Gln Gln Gly Pro Gly Gly Gln Gly Pro Tyr Gly
        35                  40                  45

Pro Gly Ala Ala Ala Ala Ala Ala Ala Ala Ala Gly Gly Tyr Gly Pro
    50                  55                  60

Gly Ala Gly Gln Gln Gly Pro Gly Gly Ala Gly Gln Gln Gly Pro Gly
65                  70                  75                  80

Ser Gln Gly Pro Gly Gly Gln Gly Pro Tyr Gly Pro Gly Ala Gly Gln
                85                  90                  95

Gln Gly Pro Gly Ser Gln Gly Pro Gly Ser Gly Gly Gln Gln Gly Pro
            100                 105                 110

Gly Gly Gln Gly Pro Tyr Gly Pro Ser Ala Ala Ala Ala Ala Ala Ala
        115                 120                 125

Ala Ala Gly Gly Tyr Gly Pro Gly Ala Gly Gln Arg Ser Gln Gly Pro
    130                 135                 140

Gly Gly Gln Gly Pro Tyr Gly Pro Gly Ala Gly Gln Gln Gly Pro Gly
145                 150                 155                 160

Ser Gln Gly Pro Gly Ser Gly Gly Gln Gln Gly Pro Gly Gly Gln Gly
                165                 170                 175

Pro Tyr Gly Pro Ser Ala Ala Ala Ala Ala Ala Ala Ala Gly Gly Tyr
            180                 185                 190

Gly Pro Gly Ala Gly Gln Gln Gly Pro Gly Ser Gln Gly Pro Gly Ser
        195                 200                 205

Gly Gly Gln Gln Gly Pro Gly Gly Gln Gly Pro Tyr Gly Pro Gly Ala
    210                 215                 220

Ala Ala Ala Ala Ala Ala Val Gly Gly Tyr Gly Pro Gly Ala Gly Gln
225                 230                 235                 240

Gln Gly Pro Gly Ser Gln Gly Pro Gly Ser Gly Gly Gln Gln Gly Pro
                245                 250                 255

Gly Gly Gln Gly Pro Tyr Gly Pro Ser Ala Ala Ala Ala Ala Ala Ala
```

```
            260                 265                 270

Ala Gly Gly Tyr Gly Pro Gly Ala Gly Gln Gln Gly Pro Gly Ser Gln
        275                 280                 285

Gly Pro Gly Ser Gly Gly Gln Gln Gly Pro Gly Gly Gln Gly Pro Tyr
    290                 295                 300

Gly Pro Ser Ala Ala Ala Ala Ala Ala Ala Ala
305                 310                 315


<210> SEQ ID NO 3
<211> LENGTH: 1800
<212> TYPE: PRT
<213> ORGANISM: Artificial Sequence
<220> FEATURE:
<223> OTHER INFORMATION: Description of Artificial Sequence: Synthetic
      polypeptide
<220> FEATURE:
<221> NAME/KEY: MISC_FEATURE
<222> LOCATION: (7)..(11)
<223> OTHER INFORMATION: This region may encompass "SGGQQ," "GAGQQ,"
      "GQGPY," "AGQQ" or "SQ," wherein some positions may be absent
<220> FEATURE:
<221> NAME/KEY: MISC_FEATURE
<222> LOCATION: (15)..(19)
<223> OTHER INFORMATION: This region may encompass "SGGQQ," "GAGQQ,"
      "GQGPY," "AGQQ" or "SQ," wherein some positions may be absent
<220> FEATURE:
<221> NAME/KEY: MISC_FEATURE
<222> LOCATION: (23)..(27)
<223> OTHER INFORMATION: This region may encompass "SGGQQ," "GAGQQ,"
      "GQGPY," "AGQQ" or "SQ," wherein some positions may be absent
<220> FEATURE:
<221> NAME/KEY: MISC_FEATURE
<222> LOCATION: (31)..(35)
<223> OTHER INFORMATION: This region may encompass "SGGQQ," "GAGQQ,"
      "GQGPY," "AGQQ" or "SQ," wherein some positions may be absent
<220> FEATURE:
<221> NAME/KEY: MISC_FEATURE
<222> LOCATION: (39)..(43)
<223> OTHER INFORMATION: This region may encompass "SGGQQ," "GAGQQ,"
      "GQGPY," "AGQQ" or "SQ," wherein some positions may be absent
<220> FEATURE:
<221> NAME/KEY: MISC_FEATURE
<222> LOCATION: (47)..(51)
<223> OTHER INFORMATION: This region may encompass "SGGQQ," "GAGQQ,"
      "GQGPY," "AGQQ" or "SQ," wherein some positions may be absent
<220> FEATURE:
<221> NAME/KEY: MISC_FEATURE
<222> LOCATION: (55)..(59)
<223> OTHER INFORMATION: This region may encompass "SGGQQ," "GAGQQ,"
      "GQGPY," "AGQQ" or "SQ," wherein some positions may be absent
<220> FEATURE:
<221> NAME/KEY: MISC_FEATURE
<222> LOCATION: (63)..(67)
<223> OTHER INFORMATION: This region may encompass "SGGQQ," "GAGQQ,"
      "GQGPY," "AGQQ" or "SQ," wherein some positions may be absent
<220> FEATURE:
<221> NAME/KEY: MISC_FEATURE
<222> LOCATION: (4)..(67)
<223> OTHER INFORMATION: This region may encompass 4-8 repeating
      "GPG-X1" repeating units, wherein X1 is "SGGQQ," "GAGQQ,"
      "GQGPY," "AGQQ" or "SQ," and some positions may be absent
<220> FEATURE:
<221> NAME/KEY: MISC_FEATURE
<222> LOCATION: (71)..(90)
<223> OTHER INFORMATION: This region may encompass 6-20 residues
<220> FEATURE:
<221> NAME/KEY: MISC_FEATURE
<222> LOCATION: (97)..(101)
<223> OTHER INFORMATION: This region may encompass "SGGQQ," "GAGQQ,"
      "GQGPY," "AGQQ" or "SQ," wherein some positions may be absent
<220> FEATURE:
<221> NAME/KEY: MISC_FEATURE
<222> LOCATION: (105)..(109)
<223> OTHER INFORMATION: This region may encompass "SGGQQ," "GAGQQ,"
      "GQGPY," "AGQQ" or "SQ," wherein some positions may be absent
```

<220> FEATURE:
<221> NAME/KEY: MISC_FEATURE
<222> LOCATION: (113)..(117)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (121)..(125)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (129)..(133)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (137)..(141)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (145)..(149)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (153)..(157)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (94)..(157)
<223> OTHER INFORMATION: This region may encompass 4-8 repeating "GPG-X1" repeating units, wherein X1 is "SGGQQ," "GAGQQ," "GQGPY," "AGQQ" or "SQ," and some positions may be absent
<220> FEATURE:
<221> NAME/KEY: MISC_FEATURE
<222> LOCATION: (161)..(180)
<223> OTHER INFORMATION: This region may encompass 6-20 residues
<220> FEATURE:
<221> NAME/KEY: MISC_FEATURE
<222> LOCATION: (187)..(191)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (195)..(199)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (203)..(207)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (211)..(215)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (219)..(223)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (227)..(231)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (235)..(239)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (243)..(247)
<223> OTHER INFORMATION: This region may encompass "SGGQQ," "GAGQQ,"

"GQGPY," "AGQQ" or "SQ," wherein some positions may be absent
<220> FEATURE:
<221> NAME/KEY: MISC_FEATURE
<222> LOCATION: (184)..(247)
<223> OTHER INFORMATION: This region may encompass 4-8 repeating "GPG-X1" repeating units, wherein X1 is "SGGQQ," "GAGQQ," "GQGPY," "AGQQ" or "SQ," and some positions may be absent
<220> FEATURE:
<221> NAME/KEY: MISC_FEATURE
<222> LOCATION: (251)..(270)
<223> OTHER INFORMATION: This region may encompass 6-20 residues
<220> FEATURE:
<221> NAME/KEY: MISC_FEATURE
<222> LOCATION: (277)..(281)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (285)..(289)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (293)..(297)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (301)..(305)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (309)..(313)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (317)..(321)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (325)..(329)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (333)..(337)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (274)..(337)
<223> OTHER INFORMATION: This region may encompass 4-8 repeating "GPG-X1" repeating units, wherein X1 is "SGGQQ," "GAGQQ," "GQGPY," "AGQQ" or "SQ," and some positions may be absent
<220> FEATURE:
<221> NAME/KEY: MISC_FEATURE
<222> LOCATION: (341)..(360)
<223> OTHER INFORMATION: This region may encompass 6-20 residues
<220> FEATURE:
<221> NAME/KEY: MISC_FEATURE
<222> LOCATION: (367)..(371)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (375)..(379)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (383)..(387)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (391)..(395)

<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (399)..(403)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (407)..(411)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (415)..(419)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (423)..(427)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (364)..(427)
<223> OTHER INFORMATION: This region may encompass 4-8 repeating
"GPG-X1" repeating units, wherein X1 is "SGGQQ," "GAGQQ,"
"GQGPY," "AGQQ" or "SQ," and some positions may be absent
<220> FEATURE:
<221> NAME/KEY: MISC_FEATURE
<222> LOCATION: (431)..(450)
<223> OTHER INFORMATION: This region may encompass 6-20 residues
<220> FEATURE:
<221> NAME/KEY: MISC_FEATURE
<222> LOCATION: (457)..(461)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (465)..(469)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (473)..(477)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (481)..(485)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (489)..(493)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (497)..(501)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (505)..(509)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (513)..(517)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (454)..(517)
<223> OTHER INFORMATION: This region may encompass 4-8 repeating
"GPG-X1" repeating units, wherein X1 is "SGGQQ," "GAGQQ,"
"GQGPY," "AGQQ" or "SQ," and some positions may be absent
<220> FEATURE:

<221> NAME/KEY: MISC_FEATURE
<222> LOCATION: (521)..(540)
<223> OTHER INFORMATION: This region may encompass 6-20 residues
<220> FEATURE:
<221> NAME/KEY: MISC_FEATURE
<222> LOCATION: (547)..(551)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (555)..(559)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (563)..(567)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (571)..(575)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (579)..(583)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (587)..(591)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (595)..(599)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (603)..(607)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (544)..(607)
<223> OTHER INFORMATION: This region may encompass 4-8 repeating "GPG-X1" repeating units, wherein X1 is "SGGQQ," "GAGQQ," "GQGPY," "AGQQ" or "SQ," and some positions may be absent
<220> FEATURE:
<221> NAME/KEY: MISC_FEATURE
<222> LOCATION: (611)..(630)
<223> OTHER INFORMATION: This region may encompass 6-20 residues
<220> FEATURE:
<221> NAME/KEY: MISC_FEATURE
<222> LOCATION: (637)..(641)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (645)..(649)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (653)..(657)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (661)..(665)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (669)..(673)
<223> OTHER INFORMATION: This region may encompass "SGGQQ," "GAGQQ," "GQGPY," "AGQQ" or "SQ," wherein some positions may be absent
<220> FEATURE:

<221> NAME/KEY: MISC_FEATURE
<222> LOCATION: (677)..(681)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (685)..(689)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (693)..(697)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (634)..(697)
<223> OTHER INFORMATION: This region may encompass 4-8 repeating "GPG-X1" repeating units, wherein X1 is "SGGQQ," "GAGQQ," "GQGPY," "AGQQ" or "SQ," and some positions may be absent
<220> FEATURE:
<221> NAME/KEY: MISC_FEATURE
<222> LOCATION: (701)..(720)
<223> OTHER INFORMATION: This region may encompass 6-20 residues
<220> FEATURE:
<221> NAME/KEY: MISC_FEATURE
<222> LOCATION: (727)..(731)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (735)..(739)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (743)..(747)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (751)..(755)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (759)..(763)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (767)..(771)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (775)..(779)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (783)..(787)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (724)..(787)
<223> OTHER INFORMATION: This region may encompass 4-8 repeating "GPG-X1" repeating units, wherein X1 is "SGGQQ," "GAGQQ," "GQGPY," "AGQQ" or "SQ," and some positions may be absent
<220> FEATURE:
<221> NAME/KEY: MISC_FEATURE
<222> LOCATION: (791)..(810)
<223> OTHER INFORMATION: This region may encompass 6-20 residues
<220> FEATURE:
<221> NAME/KEY: MISC_FEATURE
<222> LOCATION: (817)..(821)
<223> OTHER INFORMATION: This region may encompass "SGGQQ," "GAGQQ," "GQGPY," "AGQQ" or "SQ," wherein some positions may be absent <220> FEATURE:
<221> NAME/KEY: MISC_FEATURE
<222> LOCATION: (825)..(829)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (833)..(837)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (841)..(845)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (849)..(853)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (857)..(861)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (865)..(869)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (873)..(877)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (814)..(877)
<223> OTHER INFORMATION: This region may encompass 4-8 repeating "GPG-X1" repeating units, wherein X1 is "SGGQQ," "GAGQQ," "GQGPY," "AGQQ" or "SQ," and some positions may be absent
<220> FEATURE:
<221> NAME/KEY: MISC_FEATURE
<222> LOCATION: (881)..(900)
<223> OTHER INFORMATION: This region may encompass 6-20 residues
<220> FEATURE:
<221> NAME/KEY: MISC_FEATURE
<222> LOCATION: (907)..(911)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (915)..(919)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (923)..(927)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (931)..(935)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (939)..(943)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (947)..(951)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (955)..(959)
<223> OTHER INFORMATION: This region may encompass "SGGQQ," "GAGQQ,"

"GQGPY," "AGQQ" or "SQ," wherein some positions may be absent
<220> FEATURE:
<221> NAME/KEY: MISC_FEATURE
<222> LOCATION: (963)..(967)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (904)..(967)
<223> OTHER INFORMATION: This region may encompass 4-8 repeating
"GPG-X1" repeating units, wherein X1 is "SGGQQ," "GAGQQ,"
"GQGPY," "AGQQ" or "SQ," and some positions may be absent
<220> FEATURE:
<221> NAME/KEY: MISC_FEATURE
<222> LOCATION: (971)..(990)
<223> OTHER INFORMATION: This region may encompass 6-20 residues
<220> FEATURE:
<221> NAME/KEY: MISC_FEATURE
<222> LOCATION: (997)..(1001)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1005)..(1009)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1013)..(1017)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1021)..(1025)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1029)..(1033)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1037)..(1041)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1045)..(1049)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1053)..(1057)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (994)..(1057)
<223> OTHER INFORMATION: This region may encompass 4-8 repeating
"GPG-X1" repeating units, wherein X1 is "SGGQQ," "GAGQQ,"
"GQGPY," "AGQQ" or "SQ," and some positions may be absent
<220> FEATURE:
<221> NAME/KEY: MISC_FEATURE
<222> LOCATION: (1061)..(1080)
<223> OTHER INFORMATION: This region may encompass 6-20 residues
<220> FEATURE:
<221> NAME/KEY: MISC_FEATURE
<222> LOCATION: (1087)..(1091)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1095)..(1099)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1103)..(1107)

<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1111)..(1115)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1119)..(1123)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1127)..(1131)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1135)..(1139)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1143)..(1147)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1084)..(1147)
<223> OTHER INFORMATION: This region may encompass 4-8 repeating "GPG-X1" repeating units, wherein X1 is "SGGQQ," "GAGQQ," "GQGPY," "AGQQ" or "SQ," and some positions may be absent
<220> FEATURE:
<221> NAME/KEY: MISC_FEATURE
<222> LOCATION: (1151)..(1170)
<223> OTHER INFORMATION: This region may encompass 6-20 residues
<220> FEATURE:
<221> NAME/KEY: MISC_FEATURE
<222> LOCATION: (1177)..(1181)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1185)..(1189)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1193)..(1197)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1201)..(1205)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1209)..(1213)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1217)..(1221)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1225)..(1229)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1233)..(1237)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE <222> LOCATION: (1174)..(1237)
<223> OTHER INFORMATION: This region may encompass 4-8 repeating
"GPG-X1" repeating units, wherein X1 is "SGGQQ," "GAGQQ,"
"GQGPY," "AGQQ" or "SQ," and some positions may be absent
<220> FEATURE:
<221> NAME/KEY: MISC_FEATURE
<222> LOCATION: (1241)..(1260)
<223> OTHER INFORMATION: This region may encompass 6-20 residues
<220> FEATURE:
<221> NAME/KEY: MISC_FEATURE
<222> LOCATION: (1267)..(1271)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1275)..(1279)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1283)..(1287)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1291)..(1295)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1299)..(1303)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1307)..(1311)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1315)..(1319)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1323)..(1327)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1264)..(1327)
<223> OTHER INFORMATION: This region may encompass 4-8 repeating
"GPG-X1" repeating units, wherein X1 is "SGGQQ," "GAGQQ,"
"GQGPY," "AGQQ" or "SQ," and some positions may be absent
<220> FEATURE:
<221> NAME/KEY: MISC_FEATURE
<222> LOCATION: (1331)..(1350)
<223> OTHER INFORMATION: This region may encompass 6-20 residues
<220> FEATURE:
<221> NAME/KEY: MISC_FEATURE
<222> LOCATION: (1357)..(1361)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1365)..(1369)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1373)..(1377)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1381)..(1385)
<223> OTHER INFORMATION: This region may encompass "SGGQQ," "GAGQQ,"
"GQGPY," "AGQQ" or "SQ," wherein some positions may be absent
<220> FEATURE:

<221> NAME/KEY: MISC_FEATURE
<222> LOCATION: (1389)..(1393)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1397)..(1401)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1405)..(1409)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1413)..(1417)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1354)..(1417)
<223> OTHER INFORMATION: This region may encompass 4-8 repeating "GPG-X1" repeating units, wherein X1 is "SGGQQ," "GAGQQ," "GQGPY," "AGQQ" or "SQ," and some positions may be absent
<220> FEATURE:
<221> NAME/KEY: MISC_FEATURE
<222> LOCATION: (1421)..(1440)
<223> OTHER INFORMATION: This region may encompass 6-20 residues
<220> FEATURE:
<221> NAME/KEY: MISC_FEATURE
<222> LOCATION: (1447)..(1451)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1455)..(1459)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1463)..(1467)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1471)..(1475)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1479)..(1483)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1487)..(1491)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1495)..(1499)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1503)..(1507)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1444)..(1507)
<223> OTHER INFORMATION: This region may encompass 4-8 repeating "GPG-X1" repeating units, wherein X1 is "SGGQQ," "GAGQQ," "GQGPY," "AGQQ" or "SQ," and some positions may be absent
<220> FEATURE:
<221> NAME/KEY: MISC_FEATURE
<222> LOCATION: (1511)..(1530)
<223> OTHER INFORMATION: This region may encompass 6-20 residues <220> FEATURE:
<221> NAME/KEY: MISC_FEATURE
<222> LOCATION: (1537)..(1541)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1545)..(1549)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1553)..(1557)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1561)..(1565)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1569)..(1573)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1577)..(1581)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1585)..(1589)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1593)..(1597)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1534)..(1597)
<223> OTHER INFORMATION: This region may encompass 4-8 repeating "GPG-X1" repeating units, wherein X1 is "SGGQQ," "GAGQQ," "GQGPY," "AGQQ" or "SQ," and some positions may be absent
<220> FEATURE:
<221> NAME/KEY: MISC_FEATURE
<222> LOCATION: (1601)..(1620)
<223> OTHER INFORMATION: This region may encompass 6-20 residues
<220> FEATURE:
<221> NAME/KEY: MISC_FEATURE
<222> LOCATION: (1627)..(1631)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1635)..(1639)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1643)..(1647)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1651)..(1655)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1659)..(1663)
<223> OTHER INFORMATION: This region may encompass "SGGQQ," "GAGQQ," "GQGPY," "AGQQ" or "SQ," wherein some positions may be absent
<220> FEATURE:
<221> NAME/KEY: MISC_FEATURE
<222> LOCATION: (1667)..(1671)
<223> OTHER INFORMATION: This region may encompass "SGGQQ," "GAGQQ,"

"GQGPY," "AGQQ" or "SQ," wherein some positions may be absent
<220> FEATURE:
<221> NAME/KEY: MISC_FEATURE
<222> LOCATION: (1675)..(1679)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1683)..(1687)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1624)..(1687)
<223> OTHER INFORMATION: This region may encompass 4-8 repeating
"GPG-X1" repeating units, wherein X1 is "SGGQQ," "GAGQQ,"
"GQGPY," "AGQQ" or "SQ," and some positions may be absent
<220> FEATURE:
<221> NAME/KEY: MISC_FEATURE
<222> LOCATION: (1691)..(1710)
<223> OTHER INFORMATION: This region may encompass 6-20 residues
<220> FEATURE:
<221> NAME/KEY: MISC_FEATURE
<222> LOCATION: (1717)..(1721)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1725)..(1729)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1733)..(1737)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1741)..(1745)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1749)..(1753)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1757)..(1761)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1765)..(1769)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1773)..(1777)
<223> OTHER INFORMATION: This region may encompass "SGGQQ," "GAGQQ,"
"GQGPY," "AGQQ" or "SQ," wherein some positions may be absent
<220> FEATURE:
<221> NAME/KEY: MISC_FEATURE
<222> LOCATION: (1714)..(1777)
<223> OTHER INFORMATION: This region may encompass 4-8 repeating
"GPG-X1" repeating units, wherein X1 is "SGGQQ," "GAGQQ,"
"GQGPY," "AGQQ" or "SQ," and some positions may be absent
<220> FEATURE:
<221> NAME/KEY: MISC_FEATURE
<222> LOCATION: (1781)..(1800)
<223> OTHER INFORMATION: This region may encompass 6-20 residues
<220> FEATURE:
<221> NAME/KEY: MISC_FEATURE
<222> LOCATION: (1)..(1800)
<223> OTHER INFORMATION: This sequence may encompass 2-20
"GGY-[GPG-X1]n1-GPS-(A)n2" repeating units, wherein X1 is "SGGQQ,"
"GAGQQ," "GQGPY," "AGQQ" or "SQ," n1 is 4-8 and n2 is 6-20 and
some positions may be absent

<400> SEQUENCE: 3

Gly Gly Tyr Gly Pro Gly Xaa Xaa Xaa Xaa Xaa Gly Pro Gly Xaa Xaa
1 5 10 15

Xaa Xaa Xaa Gly Pro Gly Xaa Xaa Xaa Xaa Xaa Gly Pro Gly Xaa Xaa
20 25 30

Xaa Xaa Xaa Gly Pro Gly Xaa Xaa Xaa Xaa Xaa Gly Pro Gly Xaa Xaa
35 40 45

Xaa Xaa Xaa Gly Pro Gly Xaa Xaa Xaa Xaa Xaa Gly Pro Gly Xaa Xaa
50 55 60

Xaa Xaa Xaa Gly Pro Ser Ala Ala Ala Ala Ala Ala Ala Ala Ala Ala
65 70 75 80

Ala Ala Ala Ala Ala Ala Ala Ala Ala Ala Gly Gly Tyr Gly Pro Gly
85 90 95

Xaa Xaa Xaa Xaa Xaa Gly Pro Gly Xaa Xaa Xaa Xaa Xaa Gly Pro Gly
100 105 110

Xaa Xaa Xaa Xaa Xaa Gly Pro Gly Xaa Xaa Xaa Xaa Xaa Gly Pro Gly
115 120 125

Xaa Xaa Xaa Xaa Xaa Gly Pro Gly Xaa Xaa Xaa Xaa Xaa Gly Pro Gly
130 135 140

Xaa Xaa Xaa Xaa Xaa Gly Pro Gly Xaa Xaa Xaa Xaa Xaa Gly Pro Ser
145 150 155 160

Ala Ala Ala Ala Ala Ala Ala Ala Ala Ala Ala Ala Ala Ala Ala Ala
165 170 175

Ala Ala Ala Ala Gly Gly Tyr Gly Pro Gly Xaa Xaa Xaa Xaa Xaa Gly
180 185 190

Pro Gly Xaa Xaa Xaa Xaa Xaa Gly Pro Gly Xaa Xaa Xaa Xaa Xaa Gly
195 200 205

Pro Gly Xaa Xaa Xaa Xaa Xaa Gly Pro Gly Xaa Xaa Xaa Xaa Xaa Gly
210 215 220

Pro Gly Xaa Xaa Xaa Xaa Xaa Gly Pro Gly Xaa Xaa Xaa Xaa Xaa Gly
225 230 235 240

Pro Gly Xaa Xaa Xaa Xaa Xaa Gly Pro Ser Ala Ala Ala Ala Ala Ala
245 250 255

Ala Ala Ala Ala Ala Ala Ala Ala Ala Ala Ala Ala Ala Ala Gly Gly
260 265 270

Tyr Gly Pro Gly Xaa Xaa Xaa Xaa Xaa Gly Pro Gly Xaa Xaa Xaa Xaa
275 280 285

Xaa Gly Pro Gly Xaa Xaa Xaa Xaa Xaa Gly Pro Gly Xaa Xaa Xaa Xaa
290 295 300

Xaa Gly Pro Gly Xaa Xaa Xaa Xaa Xaa Gly Pro Gly Xaa Xaa Xaa Xaa
305 310 315 320

Xaa Gly Pro Gly Xaa Xaa Xaa Xaa Xaa Gly Pro Gly Xaa Xaa Xaa Xaa
325 330 335

Xaa Gly Pro Ser Ala Ala Ala Ala Ala Ala Ala Ala Ala Ala Ala Ala
340 345 350

Ala Ala Ala Ala Ala Ala Ala Ala Gly Gly Tyr Gly Pro Gly Xaa Xaa
355 360 365

Xaa Xaa Xaa Gly Pro Gly Xaa Xaa Xaa Xaa Xaa Gly Pro Gly Xaa Xaa
370 375 380

Xaa Xaa Xaa Gly Pro Gly Xaa Xaa Xaa Xaa Xaa Gly Pro Gly Xaa Xaa
385 390 395 400

Xaa Xaa Xaa Gly Pro Gly Xaa Xaa Xaa Xaa Xaa Gly Pro Gly Xaa Xaa
405 410 415

```
Xaa Xaa Xaa Gly Pro Gly Xaa Xaa Xaa Xaa Xaa Gly Pro Ser Ala Ala
            420                 425                 430

Ala Ala Ala Ala Ala Ala Ala Ala Ala Ala Ala Ala Ala Ala Ala Ala
        435                 440                 445

Ala Ala Gly Gly Tyr Gly Pro Gly Xaa Xaa Xaa Xaa Xaa Gly Pro Gly
    450                 455                 460

Xaa Xaa Xaa Xaa Xaa Gly Pro Gly Xaa Xaa Xaa Xaa Xaa Gly Pro Gly
465                 470                 475                 480

Xaa Xaa Xaa Xaa Xaa Gly Pro Gly Xaa Xaa Xaa Xaa Xaa Gly Pro Gly
                485                 490                 495

Xaa Xaa Xaa Xaa Xaa Gly Pro Gly Xaa Xaa Xaa Xaa Xaa Gly Pro Gly
            500                 505                 510

Xaa Xaa Xaa Xaa Xaa Gly Pro Ser Ala Ala Ala Ala Ala Ala Ala Ala
        515                 520                 525

Ala Ala Ala Ala Ala Ala Ala Ala Ala Ala Ala Ala Gly Gly Tyr Gly
    530                 535                 540

Pro Gly Xaa Xaa Xaa Xaa Xaa Gly Pro Gly Xaa Xaa Xaa Xaa Xaa Gly
545                 550                 555                 560

Pro Gly Xaa Xaa Xaa Xaa Xaa Gly Pro Gly Xaa Xaa Xaa Xaa Xaa Gly
                565                 570                 575

Pro Gly Xaa Xaa Xaa Xaa Xaa Gly Pro Gly Xaa Xaa Xaa Xaa Xaa Gly
            580                 585                 590

Pro Gly Xaa Xaa Xaa Xaa Xaa Gly Pro Gly Xaa Xaa Xaa Xaa Xaa Gly
        595                 600                 605

Pro Ser Ala Ala Ala Ala Ala Ala Ala Ala Ala Ala Ala Ala Ala Ala
    610                 615                 620

Ala Ala Ala Ala Ala Ala Gly Gly Tyr Gly Pro Gly Xaa Xaa Xaa Xaa
625                 630                 635                 640

Xaa Gly Pro Gly Xaa Xaa Xaa Xaa Xaa Gly Pro Gly Xaa Xaa Xaa Xaa
                645                 650                 655

Xaa Gly Pro Gly Xaa Xaa Xaa Xaa Xaa Gly Pro Gly Xaa Xaa Xaa Xaa
            660                 665                 670

Xaa Gly Pro Gly Xaa Xaa Xaa Xaa Xaa Gly Pro Gly Xaa Xaa Xaa Xaa
        675                 680                 685

Xaa Gly Pro Gly Xaa Xaa Xaa Xaa Xaa Gly Pro Ser Ala Ala Ala Ala
    690                 695                 700

Ala Ala Ala Ala Ala Ala Ala Ala Ala Ala Ala Ala Ala Ala Ala Ala
705                 710                 715                 720

Gly Gly Tyr Gly Pro Gly Xaa Xaa Xaa Xaa Xaa Gly Pro Gly Xaa Xaa
                725                 730                 735

Xaa Xaa Xaa Gly Pro Gly Xaa Xaa Xaa Xaa Xaa Gly Pro Gly Xaa Xaa
            740                 745                 750

Xaa Xaa Xaa Gly Pro Gly Xaa Xaa Xaa Xaa Xaa Gly Pro Gly Xaa Xaa
        755                 760                 765

Xaa Xaa Xaa Gly Pro Gly Xaa Xaa Xaa Xaa Xaa Gly Pro Gly Xaa Xaa
    770                 775                 780

Xaa Xaa Xaa Gly Pro Ser Ala Ala Ala Ala Ala Ala Ala Ala Ala Ala
785                 790                 795                 800

Ala Ala Ala Ala Ala Ala Ala Ala Ala Ala Gly Gly Tyr Gly Pro Gly
                805                 810                 815

Xaa Xaa Xaa Xaa Xaa Gly Pro Gly Xaa Xaa Xaa Xaa Xaa Gly Pro Gly
            820                 825                 830
```

```
Xaa Xaa Xaa Xaa Xaa Gly Pro Gly Xaa Xaa Xaa Xaa Xaa Gly Pro Gly
        835                 840                 845

Xaa Xaa Xaa Xaa Xaa Gly Pro Gly Xaa Xaa Xaa Xaa Xaa Gly Pro Gly
    850                 855                 860

Xaa Xaa Xaa Xaa Xaa Gly Pro Gly Xaa Xaa Xaa Xaa Xaa Gly Pro Ser
865                 870                 875                 880

Ala Ala Ala Ala Ala Ala Ala Ala Ala Ala Ala Ala Ala Ala Ala Ala
                885                 890                 895

Ala Ala Ala Ala Gly Gly Tyr Gly Pro Gly Xaa Xaa Xaa Xaa Xaa Gly
            900                 905                 910

Pro Gly Xaa Xaa Xaa Xaa Xaa Gly Pro Gly Xaa Xaa Xaa Xaa Xaa Gly
        915                 920                 925

Pro Gly Xaa Xaa Xaa Xaa Xaa Gly Pro Gly Xaa Xaa Xaa Xaa Xaa Gly
    930                 935                 940

Pro Gly Xaa Xaa Xaa Xaa Xaa Gly Pro Gly Xaa Xaa Xaa Xaa Xaa Gly
945                 950                 955                 960

Pro Gly Xaa Xaa Xaa Xaa Xaa Gly Pro Ser Ala Ala Ala Ala Ala Ala
                965                 970                 975

Ala Ala Ala Ala Ala Ala Ala Ala Ala Ala Ala Ala Ala Ala Gly Gly
            980                 985                 990

Tyr Gly Pro Gly Xaa Xaa Xaa Xaa  Xaa Gly Pro Gly Xaa  Xaa Xaa Xaa
        995                 1000                1005

Xaa Gly  Pro Gly Xaa Xaa Xaa  Xaa Xaa Gly Pro Gly  Xaa Xaa Xaa
    1010                1015                1020

Xaa Xaa  Gly Pro Gly Xaa Xaa  Xaa Xaa Xaa Gly Pro  Gly Xaa Xaa
    1025                1030                1035

Xaa Xaa  Xaa Gly Pro Gly Xaa  Xaa Xaa Xaa Xaa Gly  Pro Gly Xaa
    1040                1045                1050

Xaa Xaa  Xaa Xaa Gly Pro Ser  Ala Ala Ala Ala Ala  Ala Ala Ala
    1055                1060                1065

Ala Ala  Ala Ala Ala Ala Ala  Ala Ala Ala Ala Ala  Gly Gly Tyr
    1070                1075                1080

Gly Pro  Gly Xaa Xaa Xaa Xaa  Xaa Gly Pro Gly Xaa  Xaa Xaa Xaa
    1085                1090                1095

Xaa Gly  Pro Gly Xaa Xaa Xaa  Xaa Xaa Gly Pro Gly  Xaa Xaa Xaa
    1100                1105                1110

Xaa Xaa  Gly Pro Gly Xaa Xaa  Xaa Xaa Xaa Gly Pro  Gly Xaa Xaa
    1115                1120                1125

Xaa Xaa  Xaa Gly Pro Gly Xaa  Xaa Xaa Xaa Xaa Gly  Pro Gly Xaa
    1130                1135                1140

Xaa Xaa  Xaa Xaa Gly Pro Ser  Ala Ala Ala Ala Ala  Ala Ala Ala
    1145                1150                1155

Ala Ala  Ala Ala Ala Ala Ala  Ala Ala Ala Ala Ala  Gly Gly Tyr
    1160                1165                1170

Gly Pro  Gly Xaa Xaa Xaa Xaa  Xaa Gly Pro Gly Xaa  Xaa Xaa Xaa
    1175                1180                1185

Xaa Gly  Pro Gly Xaa Xaa Xaa  Xaa Xaa Gly Pro Gly  Xaa Xaa Xaa
    1190                1195                1200

Xaa Xaa  Gly Pro Gly Xaa Xaa  Xaa Xaa Xaa Gly Pro  Gly Xaa Xaa
    1205                1210                1215

Xaa Xaa  Xaa Gly Pro Gly Xaa  Xaa Xaa Xaa Xaa Gly  Pro Gly Xaa
    1220                1225                1230

Xaa Xaa  Xaa Xaa Gly Pro Ser  Ala Ala Ala Ala Ala  Ala Ala Ala
```

```
    1235                1240                1245

Ala Ala  Ala Ala Ala Ala Ala  Ala Ala Ala Ala Ala  Gly Gly Tyr
    1250                1255                1260

Gly Pro  Gly Xaa Xaa Xaa Xaa  Xaa Gly Pro Gly Xaa  Xaa Xaa Xaa
    1265                1270                1275

Xaa Gly  Pro Gly Xaa Xaa Xaa  Xaa Xaa Gly Pro Gly  Xaa Xaa Xaa
    1280                1285                1290

Xaa Xaa  Gly Pro Gly Xaa Xaa  Xaa Xaa Xaa Gly Pro  Gly Xaa Xaa
    1295                1300                1305

Xaa Xaa  Xaa Gly Pro Gly Xaa  Xaa Xaa Xaa Xaa Gly  Pro Gly Xaa
    1310                1315                1320

Xaa Xaa  Xaa Xaa Gly Pro Ser  Ala Ala Ala Ala Ala  Ala Ala Ala
    1325                1330                1335

Ala Ala  Ala Ala Ala Ala Ala  Ala Ala Ala Ala Ala  Gly Gly Tyr
    1340                1345                1350

Gly Pro  Gly Xaa Xaa Xaa Xaa  Xaa Gly Pro Gly Xaa  Xaa Xaa Xaa
    1355                1360                1365

Xaa Gly  Pro Gly Xaa Xaa Xaa  Xaa Xaa Gly Pro Gly  Xaa Xaa Xaa
    1370                1375                1380

Xaa Xaa  Gly Pro Gly Xaa Xaa  Xaa Xaa Xaa Gly Pro  Gly Xaa Xaa
    1385                1390                1395

Xaa Xaa  Xaa Gly Pro Gly Xaa  Xaa Xaa Xaa Xaa Gly  Pro Gly Xaa
    1400                1405                1410

Xaa Xaa  Xaa Xaa Gly Pro Ser  Ala Ala Ala Ala Ala  Ala Ala Ala
    1415                1420                1425

Ala Ala  Ala Ala Ala Ala Ala  Ala Ala Ala Ala Ala  Gly Gly Tyr
    1430                1435                1440

Gly Pro  Gly Xaa Xaa Xaa Xaa  Xaa Gly Pro Gly Xaa  Xaa Xaa Xaa
    1445                1450                1455

Xaa Gly  Pro Gly Xaa Xaa Xaa  Xaa Xaa Gly Pro Gly  Xaa Xaa Xaa
    1460                1465                1470

Xaa Xaa  Gly Pro Gly Xaa Xaa  Xaa Xaa Xaa Gly Pro  Gly Xaa Xaa
    1475                1480                1485

Xaa Xaa  Xaa Gly Pro Gly Xaa  Xaa Xaa Xaa Xaa Gly  Pro Gly Xaa
    1490                1495                1500

Xaa Xaa  Xaa Xaa Gly Pro Ser  Ala Ala Ala Ala Ala  Ala Ala Ala
    1505                1510                1515

Ala Ala  Ala Ala Ala Ala Ala  Ala Ala Ala Ala Ala  Gly Gly Tyr
    1520                1525                1530

Gly Pro  Gly Xaa Xaa Xaa Xaa  Xaa Gly Pro Gly Xaa  Xaa Xaa Xaa
    1535                1540                1545

Xaa Gly  Pro Gly Xaa Xaa Xaa  Xaa Xaa Gly Pro Gly  Xaa Xaa Xaa
    1550                1555                1560

Xaa Xaa  Gly Pro Gly Xaa Xaa  Xaa Xaa Xaa Gly Pro  Gly Xaa Xaa
    1565                1570                1575

Xaa Xaa  Xaa Gly Pro Gly Xaa  Xaa Xaa Xaa Xaa Gly  Pro Gly Xaa
    1580                1585                1590

Xaa Xaa  Xaa Xaa Gly Pro Ser  Ala Ala Ala Ala Ala  Ala Ala Ala
    1595                1600                1605

Ala Ala  Ala Ala Ala Ala Ala  Ala Ala Ala Ala Ala  Gly Gly Tyr
    1610                1615                1620

Gly Pro  Gly Xaa Xaa Xaa Xaa  Xaa Gly Pro Gly Xaa  Xaa Xaa Xaa
    1625                1630                1635
```

```
Xaa Gly  Pro Gly Xaa Xaa Xaa  Xaa Xaa Gly Pro Gly  Xaa Xaa Xaa
    1640                 1645                 1650

Xaa Xaa  Gly Pro Gly Xaa Xaa  Xaa Xaa Xaa Gly Pro  Gly Xaa Xaa
    1655                 1660                 1665

Xaa Xaa  Xaa Gly Pro Gly Xaa  Xaa Xaa Xaa Xaa Gly  Pro Gly Xaa
    1670                 1675                 1680

Xaa Xaa  Xaa Xaa Gly Pro Ser  Ala Ala Ala Ala Ala  Ala Ala Ala
    1685                 1690                 1695

Ala Ala  Ala Ala Ala Ala Ala  Ala Ala Ala Ala Ala  Gly Gly Tyr
    1700                 1705                 1710

Gly Pro  Gly Xaa Xaa Xaa Xaa  Xaa Gly Pro Gly Xaa  Xaa Xaa Xaa
    1715                 1720                 1725

Xaa Gly  Pro Gly Xaa Xaa Xaa  Xaa Xaa Gly Pro Gly  Xaa Xaa Xaa
    1730                 1735                 1740

Xaa Xaa  Gly Pro Gly Xaa Xaa  Xaa Xaa Xaa Gly Pro  Gly Xaa Xaa
    1745                 1750                 1755

Xaa Xaa  Xaa Gly Pro Gly Xaa  Xaa Xaa Xaa Xaa Gly  Pro Gly Xaa
    1760                 1765                 1770

Xaa Xaa  Xaa Xaa Gly Pro Ser  Ala Ala Ala Ala Ala  Ala Ala Ala
    1775                 1780                 1785

Ala Ala  Ala Ala Ala Ala Ala  Ala Ala Ala Ala Ala
    1790                 1795                 1800


<210> SEQ ID NO 4
<211> LENGTH: 5
<212> TYPE: PRT
<213> ORGANISM: Artificial Sequence
<220> FEATURE:
<223> OTHER INFORMATION: Description of Artificial Sequence: Synthetic
      peptide

<400> SEQUENCE: 4

Ser Gly Gly Gln Gln
1               5


<210> SEQ ID NO 5
<211> LENGTH: 5
<212> TYPE: PRT
<213> ORGANISM: Artificial Sequence
<220> FEATURE:
<223> OTHER INFORMATION: Description of Artificial Sequence: Synthetic
      peptide

<400> SEQUENCE: 5

Gly Ala Gly Gln Gln
1               5


<210> SEQ ID NO 6
<211> LENGTH: 5
<212> TYPE: PRT
<213> ORGANISM: Artificial Sequence
<220> FEATURE:
<223> OTHER INFORMATION: Description of Artificial Sequence: Synthetic
      peptide

<400> SEQUENCE: 6

Gly Gln Gly Pro Tyr
1               5


<210> SEQ ID NO 7
<211> LENGTH: 4
```

-continued

```
<212> TYPE: PRT
<213> ORGANISM: Artificial Sequence
<220> FEATURE:
<223> OTHER INFORMATION: Description of Artificial Sequence: Synthetic
      peptide

<400> SEQUENCE: 7

Ala Gly Gln Gln
1
```

The invention claimed is:

1. A method for generating a drawn fiber comprising a silk polypeptide, the method comprising:

dissolving a powder comprising the silk polypeptide into a solvent to generate a spin dope;

extruding the spin dope into a coagulation bath to form a precursor fiber;

collecting the precursor fiber without drawing the precursor fiber;

annealing the precursor fiber prior to drawing the fiber; and drawing the precursor fiber only over a surface having a temperature of at least 190° C. to generate a drawn fiber, wherein the drawn fiber has a crystallinity index of at least 6% as measured using X-ray diffraction.

2. The method of claim 1, wherein said silk polypeptide is a recombinant silk polypeptide.

3. The method of claim 2, wherein said recombinant silk polypeptide comprises two or more repeat units of a proteinaceous block copolymer.

4. The method of claim 1, wherein said silk polypeptide is a recombinant spider silk polypeptide.

5. The method of claim 4, wherein the recombinant spider silk polypeptide comprises SEQ ID NO: 1.

6. The method of claim 1, wherein the powder comprising the silk polypeptide is comprised of at least 60% silk polypeptide by weight.

7. The method of claim 1, wherein the drawn fiber is drawn over the surface at a draw ratio of at least 2×.

8. The method of claim 7, wherein the draw ratio is computed by determining the draw ratio at failure.

9. The method of claim 8, wherein determining the draw ratio at failure comprises determining the distribution of maximum elongation at break of one or more precursor fibers using an apparatus designed to draw the fiber over a surface having a temperature of at least 190° C. while increasing the draw ratio.

10. The method of claim 1, further comprising drawing the drawn fiber over the surface having a temperature of at least 190° C. one or more times.

11. The method of claim 10, wherein the sum of the draw ratios at each drawing step is approximately equal to or less than the draw ratio at failure of the precursor fiber.

12. The method of claim 10, wherein the generation of the drawn fiber comprises:

determining a draw ratio at failure of the precursor fiber; and distributing the draw ratio at failure of the precursor fiber over each of said drawing steps.

13. The method of claim 1, wherein annealing the precursor fiber comprises annealing the precursor fiber with alcohol vapor.

14. The method of claim 1, wherein the solvent comprises N-methyl morpholine N-oxide (NMMO) or formic acid.

15. The method of claim 14, wherein the solvent comprises 20% to 60% by weight NMMO.

16. The method of claim 14, wherein generating said drawn fiber comprises heating said spin dope before said step of extruding the spin dope into said coagulation bath.

17. The method of claim 14, wherein extruding the spin dope into said coagulation bath comprises extruding the spin dope through an air in the range of 2 to 20 cm.

18. The method of claim 1, wherein the drawn fiber has increased beta-sheet formation relative to the precursor fiber.

19. The method of claim 18, wherein the drawn fiber has increased beta-sheet formation relative to the precursor fiber proportional to the draw ratio used to draw the fiber over the surface.

20. The method of claim 1, wherein the surface is at least 200 degrees Celsius.

21. The method of claim 1, wherein the surface is at least 20 degrees Celsius greater than the glass transition temperature of the precursor fiber.

22. The method of claim 1, wherein the tenacity of the drawn fiber is greater than 20 cN/tex.

23. The method of claim 1, wherein the Herman orientation factor of the drawn fiber is approximately the same as native silk fiber.

24. The method of claim 1, wherein the drawn fiber has a crystallinity index of at least 7% as measured using X-ray diffraction.

25. The method of claim 1, wherein the drawn fiber has more than 1.5 times increased beta-sheet content as compared to air drawn fibers subject to identical drawing conditions except not drawn over a surface having a temperature of at least 190° C.

26. The method of claim 1, wherein the drawn fiber has an increased 3D β-sheet content as compared to air drawn fibers subject to identical drawing conditions except not drawn over a surface having a temperature of at least 190° C.

27. The method of claim 1, further comprising drying the precursor fiber after the collecting and before the annealing to form a dried precursor fiber, wherein the drawing comprises drawing the dried precursor fiber only over the surface to generate the drawn fiber.

* * * * *